US012503916B2

(12) United States Patent
Teslyuk

(10) Patent No.: US 12,503,916 B2
(45) Date of Patent: Dec. 23, 2025

(54) MOBILE INTEGRATED CORE DRILLING SYSTEM AND METHOD WITH CONTAINERIZED DRILLING EQUIPMENT AND OPERATOR HOUSING

(71) Applicant: EARTH AI INC., San Mateo, CA (US)

(72) Inventor: Roman Teslyuk, Sydney Olympic Park (AU)

(73) Assignee: EARTH AI INC., San Mateo, CA (US)

( * ) Notice: Subject to any disclaimer, the term of this patent is extended or adjusted under 35 U.S.C. 154(b) by 0 days.

(21) Appl. No.: 18/850,848

(22) PCT Filed: Mar. 29, 2023

(86) PCT No.: PCT/US2023/065097
§ 371 (c)(1),
(2) Date: Sep. 25, 2024

(87) PCT Pub. No.: WO2023/196752
PCT Pub. Date: Oct. 12, 2023

(65) Prior Publication Data

US 2025/0215758 A1 Jul. 3, 2025

Related U.S. Application Data

(60) Provisional application No. 63/328,117, filed on Apr. 6, 2022.

(51) Int. Cl.
*E21B 7/02* (2006.01)
*E21B 19/15* (2006.01)
(Continued)

(52) U.S. Cl.
CPC ..... *E21B 7/02* (2013.01); *E21B 19/15* (2013.01); *E21B 21/01* (2013.01); *E21B 25/005* (2013.01); *E21B 41/00* (2013.01)

(58) Field of Classification Search
CPC . E21B 7/02; E21B 19/15; E21B 21/01; E21B 25/005
See application file for complete search history.

(56) References Cited

U.S. PATENT DOCUMENTS 3,717,379 A 2/1973 Fletcher et al.
4,899,832 A * 2/1990 Bierscheid, Jr. ..... E21B 15/00 173/217

(Continued)

OTHER PUBLICATIONS

Oxford Languages. (2025). Containerized. In google.com, retrieved Jul. 23, 2025. (Year: 2025).*

(Continued)

*Primary Examiner* — Robert E Fuller
(74) *Attorney, Agent, or Firm* — Orrick, Herrington & Sutcliffe LLP

(57) ABSTRACT

A surface drilling system for performing surface mineral exploration diamond core drilling and methods for making and utilizing the same. The surface drilling system can include a drill rig system and one or more drill rig support systems for supporting drill rig operations. If including as support vehicles, the drill rig support systems can comprise a tilt-tray vehicle and an offroad-capable vehicle that can be configured for towing one or more trailers. The tilt-tray vehicle can be equipped with a standardized shipping container for facilitating loading and transporting of equipment associated with the surface drilling system. The surface drilling system advantageously can comprise a set of equipment for surface mineral exploration diamond core drilling that enables highly-mobile, cost-efficient drilling operations to be performed at a predetermined drill site, which can include remote environments with temperature and other climate extremes.

20 Claims, 49 Drawing Sheets

(51) Int. Cl.

| | |
|---|---|
| ***E21B 21/01*** | (2006.01) |
| ***E21B 25/00*** | (2006.01) |
| ***E21B 41/00*** | (2006.01) |

(56) References Cited

U.S. PATENT DOCUMENTS

| | | | | |
|---|---|---|---|---|
| 10,711,539 | B1 * | 7/2020 | Nolan | F24F 7/003 |
| 11,028,681 | B2 | 6/2021 | Dasys et al. | |
| 11,041,383 | B2 | 6/2021 | Hao et al. | |
| 2003/0182997 | A1 | 10/2003 | Williams | |
| 2005/0241857 | A1 * | 11/2005 | Beato | E21B 19/08<br>175/203 |
| 2009/0071720 | A1 | 3/2009 | Cowan | |
| 2017/0101826 | A1 * | 4/2017 | Sigmar | E21B 15/00 |
| 2018/0149011 | A1 | 5/2018 | Dykstra et al. | |
| 2020/0392814 | A1 | 12/2020 | Krippner et al. | |
| 2021/0301630 | A1 | 9/2021 | Krippner et al. | |

OTHER PUBLICATIONS

International Search Report and Written Opinion for PCT/US2023/065097, mailed Aug. 30, 2023, 14 pages.

* cited by examiner

100

MOBILE INTEGRATED CORE DRILLING SYSTEM AND METHOD WITH CONTAINERIZED DRILLING EQUIPMENT AND OPERATOR HOUSING

CROSS-REFERENCE TO RELATED APPLICATIONS

This application is a national phase application from International Application No. PCT/US2023/065097, filed on Mar. 29, 2023, which claims the benefit of, and priority to, U.S. Provisional Application Ser. No. 63/328,117, filed on Apr. 6, 2022, the disclosures of which are hereby incorporated herein by reference in their entireties and for all purposes.

FIELD

The disclosed embodiments relate generally to the field of surface drilling systems and more particularly, but not exclusively, to systems and methods for performing surface mineral exploration diamond core drilling.

BACKGROUND

Exploration diamond drilling currently is used for probing contents of known ore deposits and potential ore deposits within drilling sites. The extracted cores can be analyzed to determine whether the core contents include ore deposits and the extent of the ore deposits.

Currently-available exploration diamond drilling equipment is expensive and, comprising numerous separate systems, is difficult to transport, not time efficient and expensive to use. The assembly and operation of such exploration diamond drilling equipment can result in significant operational delays, cost overruns and environmental disturbance at the drilling sites.

In view of the foregoing, a need exists for a system and method for performing surface mineral exploration diamond core drilling that overcome the aforementioned obstacles and deficiencies of currently-available surface drilling systems.

SUMMARY

The present disclosure relates to a surface drilling system for performing surface mineral exploration diamond core drilling and methods for making and utilizing the same. The surface drilling system can include a drill rig system and one or more drill rig support systems for supporting drill rig operations. If including as support vehicles, the drill rig support systems can comprise a tilt-tray vehicle and an offroad-capable vehicle that can be configured for towing one or more trailers. The tilt-tray vehicle can be equipped with a standardized shipping container for facilitating loading and transporting of equipment associated with the surface drilling system. The surface drilling system advantageously can comprise a set of equipment for surface mineral exploration diamond core drilling that enables highly-mobile, cost-efficient drilling operations to be performed at a predetermined drill site, which can include remote environments with temperature and other climate extremes.

In accordance with a first aspect disclosed herein, there is set forth a surface drilling system for surface mineral exploration diamond core drilling at a predetermined drill site via a drill rig means having a drill rig mast system coupled with a drill bit for cutting a drillhole within a ground at a drilling location of the drill site. The surface drilling system can comprise:

- a containerized rod skid means for transporting one or more drill rods for coupling the drill rig mast system with the drill bit;
- a containerized mud tank means for providing drilling fluid to the drill rig system and cleaning return drilling fluid received from the drill rig system; and/or
- a containerized water skid means for providing water to the mud tank means for mixing the drilling fluid and cleaning the return drilling fluid,
- wherein the rod skid means, the mud tank means and the water skid means are configured for transport via a tilt-tray means of a logistics vehicle and support mobile, cost-efficient drilling operations.

In some embodiments of the disclosed system of the first aspect, the rod skid means, the mud tank means and the water skid means each can comprise a standardized shipping container, such as, for example, a standard twenty-foot shipping container with corner fittings for a twist-locking mechanism. The mud tank means and the water skid means optionally can provide storage for selected equipment associated with the surface drilling system during transport.

In some embodiments of the disclosed system of the first aspect, the surface drilling system can include a collar tray means for capturing and reconditioning the return drilling fluid for use by the drill rig system, the collar tray means defining an elongate opening for supporting a predetermined range of drilling angles for the drill rig system and can include one or more suction inlets for receiving the return drilling fluid from the drill rig system, at least one external outlet for providing reconditioned drilling fluid to the drill rig system, a foam ground seal support means for preventing leaks of the return drilling fluid and the reconditioned drilling fluid and/or a wooden damper for reducing drilling vibration, In some embodiments of the disclosed system of the first aspect, the rod skid means can include:

- an adjustable ramp means having a surface for supporting the drill rods and having distal and proximal end regions;
- dunnage for being disposed between the ramp means and the drill rods and protecting the drill rods from damage;
- at least one mechanical jack means being coupled with the proximal end region of the ramp means and being configured to elevate the proximal end region of the ramp means relative to the distal end region of the ramp means; and/or
- a headboard means, a backboard means and a plurality of support beams being disposed around a periphery of the ramp means and being configured to retain the drill rods within the rod skid means.

The rod skid means optionally can maintain a safe lifting height for the drill rods. For example, the rod skid means can maintain a predetermined lifting height at all times throughout the use and depletion of the drill rods.

Additionally and/or alternatively, the headboard means can comprise a plurality of headboard inserts can include a first headboard insert that can be added to the headboard means for increasing a height of the headboard means and a second headboard insert that can be removed from the headboard means for decreasing the height of the headboard means. In selected embodiments, the backboard means can comprise a plurality of backboard inserts can include a first backboard insert that can be added to the backboard means for increasing a height of the backboard means and a second backboard insert that can be removed from the backboard means for decreasing the height of the backboard means.

In some embodiments of the disclosed system of the first aspect, the surface drilling system can further comprise an inner tube and core processing means for removing core material collected within an inner tube of a selected drill rod previously coupled with the drill rig mast system with the drill bit during drilling operations. The inner tube and core processing means, for example, can comprise:

- a flat table top defining at least one water catchment drain and can include an inner tube processing means having a grill means for stabilizing the selected drill rod when disposed on the table top;
- one or more table legs for supporting the table top; and/or
- at least one water catchment tray for receiving water draining from the table top via the water catchment drain during removal of the core material from the selected drill rod.

At least one of the table legs optionally can comprise a jack table leg for levelling the table top when the inner tube and core processing means can be disposed on an uneven surface.

In some embodiments of the disclosed system of the first aspect, the mud tank means can comprise a plurality of holding cells with adjacent first and second holding cells being separated by an intermediate barrier with a valve device disposed at an upper portion of the intermediate barrier, the valve device being configured to be alternately closed to inhibit communication between the first and second holding cells and opened to enable communication between the first and second holding cells, selected valve devices being opened to enable circulation of the return drilling fluid received from the drill rig system at an initial holding cell through a preselected number of intermediate holding cells to a final holding cell for providing the drilling fluid to the drill rig system.

The mud tank means, for example, can comprise a leveling means with a mud tank support framework means for supporting the holding cells and a jack means for elevating first holding cells associated with a proximal end region of the mud tank support framework means relative to second holding cells associated with a distal end region of the mud tank support framework means, wherein the leveling means levels the first and second holding cells when the mud tank means can be disposed on an uneven surface. The mud tank support framework means optionally can organize the holding cells in a cascading configuration.

Additionally and/or alternatively, circulation of the return drilling through the holding cells of the mud tank means can clean the return drilling fluid received from the drill rig system and generates clean drilling fluid for the drill rig system. A number of the selected valve devices optionally can be controlled for adjusting the preselected number of intermediate holding cells through which the return drilling fluid can be circulated.

In selected embodiments, a bulk bag means can be disposed in a selected holding cell of the mud tank means and collects water and settled drill cuttings from the circulated return drilling fluid. A fluid containment means alternatively can receive the bulk bag means from the selected holding cell, the fluid containment means can include a watertight bunding means for containing water seeping from the bulk bag means and maintaining the drill cuttings in the bulk bag for disposal. In selected embodiments, a vacuum pump means can pump the water and the drill cuttings from the selected holding cell of the mud tank means to the fluid containment means, wherein the vacuum pump means can be stored in a predetermined holding cell of the mud tank means during transport.

In some embodiments of the disclosed system of the first aspect, the predetermined range of drilling angles supported by the elongate opening defined by the collar tray means can be between thirty degrees and ninety degrees.

In some embodiments of the disclosed system of the first aspect, the surface drilling system can further comprise a camping means being disposed at a camping site that can be proximal to the predetermined drill site and being configured for housing surface drilling system personnel, the camping means can include a containerized living means, a containerized kitchen means and/or a containerized utility means.

The living means, the kitchen means and/or the utility means each can comprise a standardized shipping container, such as, for example, a standard twenty-foot shipping container with corner fittings for a twist-locking mechanism.

The living means, for example, can include an external air conditioning means and provides at least one sleeping room with a bed, a bedside table and an internal sleeping room air conditioning means and living room with a refrigerator, a table with chairs and an internal living room air conditioning means. The kitchen means optionally can provide food storage and can include at least one electrical appliance, an internal kitchen air conditioning means, a faucet with a faucet drain, a shower with a shower drain and a toilet. Additionally and/or alternatively, the utility means can include a clean water tank means for providing clean water to the faucet and the shower, a blackwater tank means for receiving greywater from the faucet drain and the shower drain and blackwater from the toilet and a generator means for providing electrical power to the external air conditioning means, the internal sleeping room air conditioning means, the internal living room air conditioning means, the internal kitchen air conditioning means and the electrical appliance.

An optionally elevated deck means can be disposed between the living means and the kitchen means, the elevated deck means can include plurality of deck support beams each having a proximal end region coupled with the living means and a distal end region coupled with the kitchen means, at least one deck platform disposed on the deck support beams, and a set of deck stairs spanning between a ground level of the camp site and the deck platform.

In accordance with a second aspect disclosed herein, there is set forth a method for making the surface drilling system of the first aspect.

In accordance with a second aspect disclosed herein, there is set forth a method for using the surface drilling system of the first aspect.

Figure 1:
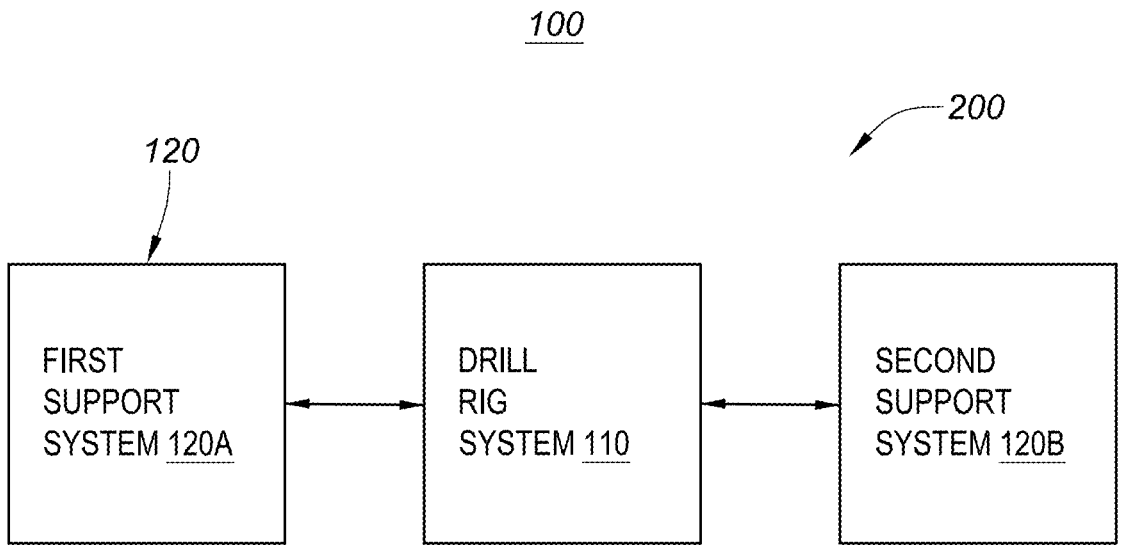
FIG. 1 is a top level block diagram illustrating an exemplary embodiment of a surface drilling system that includes a drill rig system and one or more drill rig support systems.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Since conventional exploration diamond drilling equipment is expensive, comprises numerous separate systems, is difficult to transport and can result in significant operational delays, cost overruns and environmental disturbance, a system for performing surface mineral exploration diamond core drilling that is highly-mobile, cost-efficient, integrated, and involves low environmental disturbance can prove desirable and provide a basis for a wide range of applications. This result can be achieved, according to one embodiment disclosed herein, by a surface drilling system (or means) 100 as illustrated in FIG. 1.

Turning to FIG. 1, the surface drilling system 100 is shown as including a drill rig system (or means) 110 and one or more drill rig support systems (or means) 120 for supporting the drill rig system 110. The drill rig system 110, in selected embodiments, can comprise any suitable type of conventional diamond core drilling rig system. The surface drilling system 100 of FIG. 1 is shown as being disposed within a predetermined drill site 200 and as including first and second drill rig support systems 120A, 120B.

The first and second drill rig support systems 120A, 120B can comprise vehicles and/or other equipment associated with the surface drilling system 100. If the first and second drill rig support systems 120A, 120B are provided as (support) vehicles, the first drill rig support system 120A can include an offroad-capable car or other vehicle that can be configured for towing one or more trailers. The first drill rig support system 120A, for example, can be configured to tow as at least one trailer with a weight of up to three and one-half tons or more. Additionally and/or alternatively, the second drill rig support system 120B can comprise a truck or other vehicle 160 with a tilt-tray system (or means) 160B (shown in FIG. 2). The second drill rig support system 120B can be configured to carrying a load of up to fifteen tons or more and/or can be equipped with a standardized shipping container, such as a standard twenty-foot shipping container with corner fittings for a twist-locking mechanism, in selected embodiments.

The surface drilling system 100 advantageously can comprise a set of equipment for surface mineral exploration diamond core drilling that enables highly-mobile, cost-efficient drilling operations to be performed at the predetermined drill site 200, which can include remote environments and/or temperature and other climate extremes. The surface drilling system 100, for example, can increase operational redundancy and thus reduce downtime and otherwise increase a speed at which drilling operations are conducted and/or reduce operational costs and/or capital costs. Maintenance of the surface drilling system 100 likewise can be simplified compared to conventional exploration diamond drilling equipment systems. In selected embodiments, the surface drilling system 100 can be highly-integrated and organized, reducing chances for human error and/or simplifying drilling operations.

Stated somewhat differently, the surface drilling system 100 can provide a plurality of benefits relative to conventional exploration diamond drilling equipment. The benefits of the surface drilling system 100 can include, but are not limited to, increased system mobility, increased speed of system mobilization, multipurpose use of system vehicles, reduced environmental impact and/or reduced system costs. With regard to increased system mobility and/or increased speed of system mobilization, the increased system mobility, the surface drilling system 100 advantageously can comprise an integrated set of equipment that is self-contained and/or can support a standardized packing process for facilitating mobilization. The surface drilling system 100, in other words, does not require additional containers and/or vehicles for supporting transport of the equipment associated with the surface drilling system 100.

The equipment associated with the surface drilling system 100, for example, can be based on the size, shape or other dimensions of a standardized shipping container (not shown). Use of the standardized bases can help facilitate loading and transporting of the equipment associated with the surface drilling system 100. By providing standardized shipping container size bases for selected equipment, such as a rod skid system (or means) 121 (shown in FIG. 2), a water skid system (or means) 140 (shown in FIG. 2) and/or a mud tank system (or means) 157 (shown in FIG. 2), associated with the surface drilling system 100, the equipment can be transported via one or more trucks or other vehicles to the predetermined drill site 200. The truck utilized for transporting the water skid system 140, for example, can be repurposed or otherwise converted into a water truck to supply water for drilling operations by filling the water skid system 140 with water at the predetermined drill site 200.

Additionally and/or alternatively, the equipment associated with the surface drilling system 100 can be transported via one or more specialized light-vehicle trailers (not shown). Use of the specialized trailers can allow for a light vehicle (not shown) to seamlessly switch from carting fuel to transporting cores long distances and/or to carting a logistics vehicle 160 (shown in FIG. 2) to a warehouse for resupply. In selected embodiments, the logistics vehicle 160 can support standardized logistics. The logistics vehicle 160, for example, can contain a full set of drilling tools and consumables, similar to a mobile warehouse, which has substantially identical storage arrangement but with larger stock capacity.

The surface drilling system 100 likewise can offer reduced environmental impact. In selected embodiments, the surface drilling system, unlike conventional drilling systems, 100 can operate without utilizing groundworks to build in-ground mud pits. The surface drilling system 100, for example, can include a collar tray system (or means) 156 (shown in FIG. 2) for capturing and reconditioning return drilling fluid and/or water (not shown) during operations. The captured return drilling fluid optionally can be moved to the mud tank system 157 in any suitable manner, including, for example, by utilizing a diaphragm pump system (or means) 174 (shown in FIG. 2). The stored return drilling fluid can be reconditioned by permitting any suspended rock cuttings to settle or otherwise separate from the circulating return drilling fluid to the bottom of the tank or in bags, within the mud tank system 157. The reconditioned return drilling fluid then can be reused during further operations of the surface drilling system 100. Additionally and/or alternatively, the surface drilling system 100 can support complete or nearly-complete waste collection and/or disposal. The surface drilling system 100, for instance, can collect waste generated while drilling a hole at the predetermined drill site 200 in bags that are located in each mud tank cell or by via moving the waste into bags outside of the mud tank, for example utilizing a vacuum pump system (or means) 173 (shown in FIG. 2) and/or a vacuum pump standpipe system (or means) 158B (shown in FIG. 2).

In the manner set forth above, the surface drilling system 100 can support reduced system costs. Deployment and use of the surface drilling system 100, for example, can result in reduced capital expenditure, independent operation and increased redundancy and/or reduced operational costs relative to conventional exploration diamond drilling equipment. In selected embodiments, the surface drilling system 100 further can make minimum economically viable size of a drilling campaign to one drillhole compared with conventional exploration diamond drilling equipment that requires several drillholes. The increased mobility of the surface drilling system 100 can enable these reductions by enabling the surface drilling system 100 to switch between projects after each drillhole rapidly and without a large reduction in productivity.

In selected embodiments, the surface drilling system 100 can comprise a surface mineral exploration diamond core drilling system in the manner illustrated in FIGS. 2 and 3A-E. Turning to FIGS. 2 and 3A-E, the drill rig system 110 of the surface drilling system 100 can comprise a diamond core drilling rig system and/or can be mounted on a track system (or means), a vehicle system or other mobile platform 111. The drill rig system 110 is illustrated as including one or more drill rig component such as a drill rig mast system (or means) 112, a drill chuck system (or means) 113, a drill rig control panel system (or means) 114 and/or a drill rig deck system (or means) 115, without limitation. The drill rig system 110 can be configured for at least one drilling hole into the ground at the predetermined drill site 200 and obtaining undisturbed core samples of rock in the ground.

The drill rig system 110 can consist of a diesel engine (not shown) that can power one or more hydraulic pumps (not shown). The hydraulic pumps, in turn, can drive at least one hydraulic motor (not shown) and at least one hydraulic cylinders (not shown). The hydraulic motors and cylinders can be used to power winches, water pumps, drill chuck, jacks and/or auxiliary equipment, without limitation. In selected embodiments, the hydraulic motors and cylinders can be used to power movement of various parts of the drill rig system 110, such as mast incline, mast dump, drill head movements, foot clamp (rod holder) and others.

In operation, an onboard triplex pump system (or means) 171 of the surface drilling system 100 can draw water from the mud tank system 157 and pump the water into the hole.

A hydraulics system (not shown), such as an onboard hydraulics can power an agitator system (or means) 180 of the surface drilling system 100. The onboard triplex pump system 171 advantageously can supply water to an inner tube pump out attachment system (or means) 152, a hopper system (or means) 153 and/or a water swivel system (or means) 154 of the surface drilling system 100. In selected embodiments, the onboard triplex pump system 171 can supply water to the inner tube pump out attachment system 152, the hopper system 153 and/or the water swivel system 154 via an optional water distribution box system 151 of the surface drilling system 100.

The drill rig mast system 112, for example, can be lowered into the collar tray system 156 and can rest on at least one collar tray support system (or means) 156B associated with the collar tray system 156. In selected embodiments, the collar tray support system 156B can include, but is not limited to, a wooden collar tray support system (or means) and/or a ground seal support system (or means), for example, a foam collar tray support system (or means). Stated somewhat differently, the collar tray support system 156B can include, but is not limited to, the wooden support 156X and/or the foam insert 156Y. The collar tray support system 156B, for example, can be at least partially disposed within the collar tray system 156.

Additionally and/or alternatively, the drill rig system 110 can be aligned with the drill rig deck system 115. The drill rig deck system 115 can be supported by one or more deck jack legs (not shown) and/or advantageously can provide a platform upon which a drill rig operator can stand for accessing the drill rig control panel system 114. The drill rig control panel system 114, for example, can be mounted on the drill rig system 110.

The drill rig mast system 112 of the drill rig system 110 can comprise of a frame and other special equipment for drilling. Advantageously, the drill rig mast system 112 can support the weight of a rod string (not shown) and/or can allow for drill head travel. The drill rig mast system 112 optionally can include one or more mounts (not shown) for a foot clamp (or rod holder), one or more pulleys (not shown) at a tip for winch cables, at least one hydraulic motor (not shown) and/or at least one jack (not shown).

In selected embodiments, the drill rig mast system 112 can enable sliding movement of the drill head with the drill chuck system 113. The drill rig mast system 112 optionally can be lowered into the collar tray system 156 and/or can rest on one or more supports, such as one or more wooden supports 156X and/or one or more foam inserts 156Y, associated with the collar tray system 156.

Figure 3A:
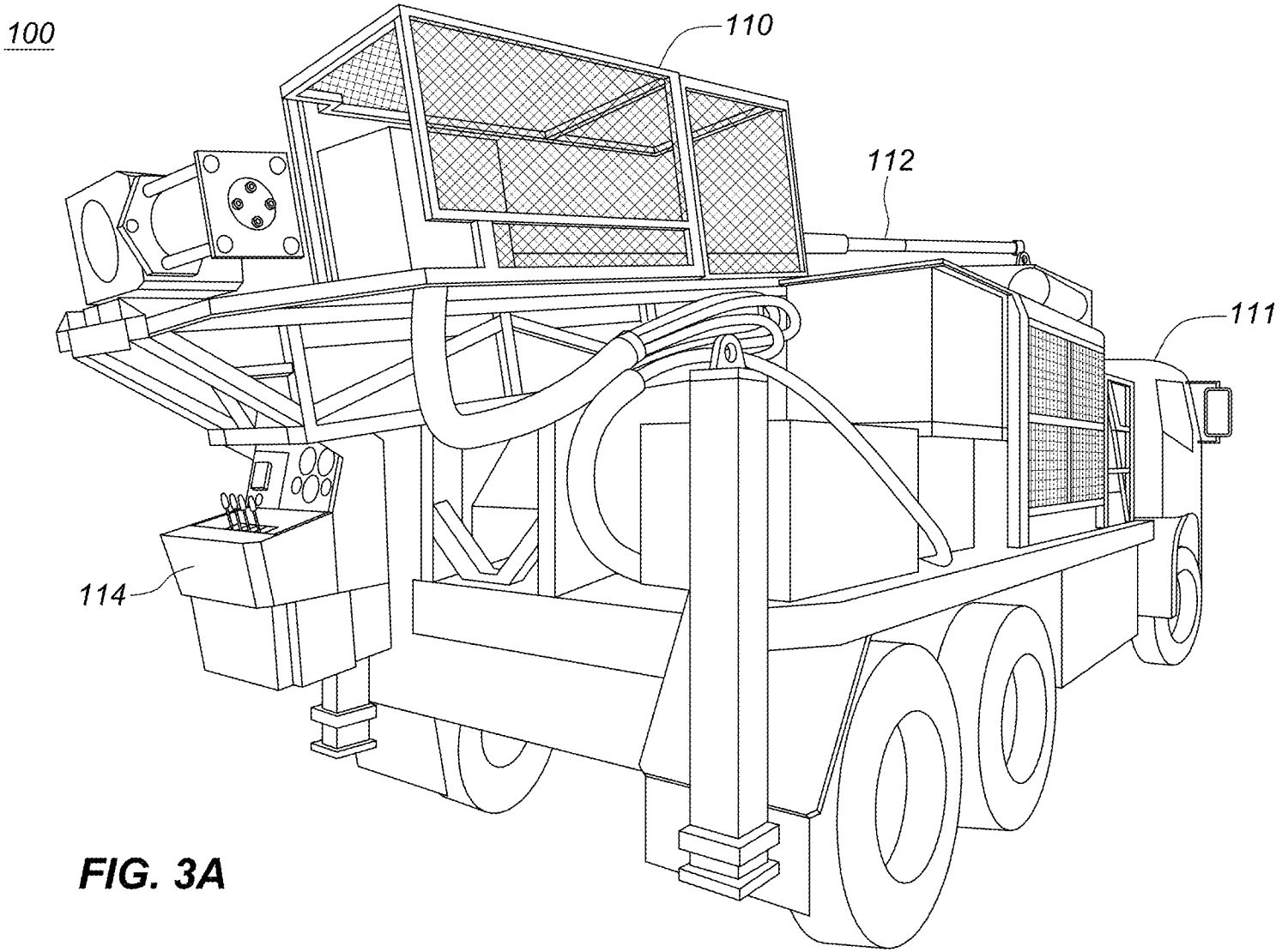
FIGS. 3A-E are a detail drawing illustrating an exemplary embodiment of the drill rig system of FIG. 1.
Figure 3B:
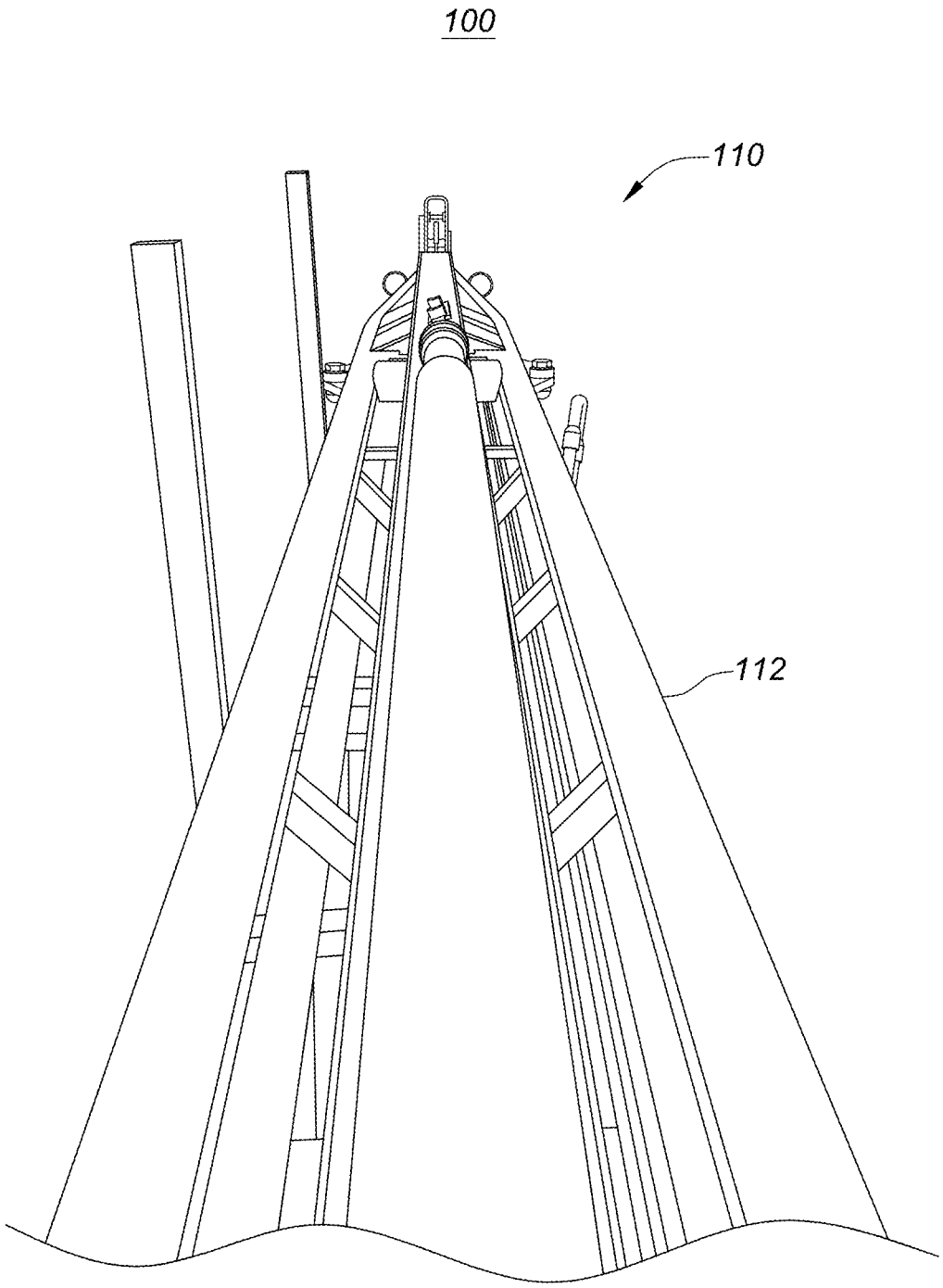
Figure 3C:
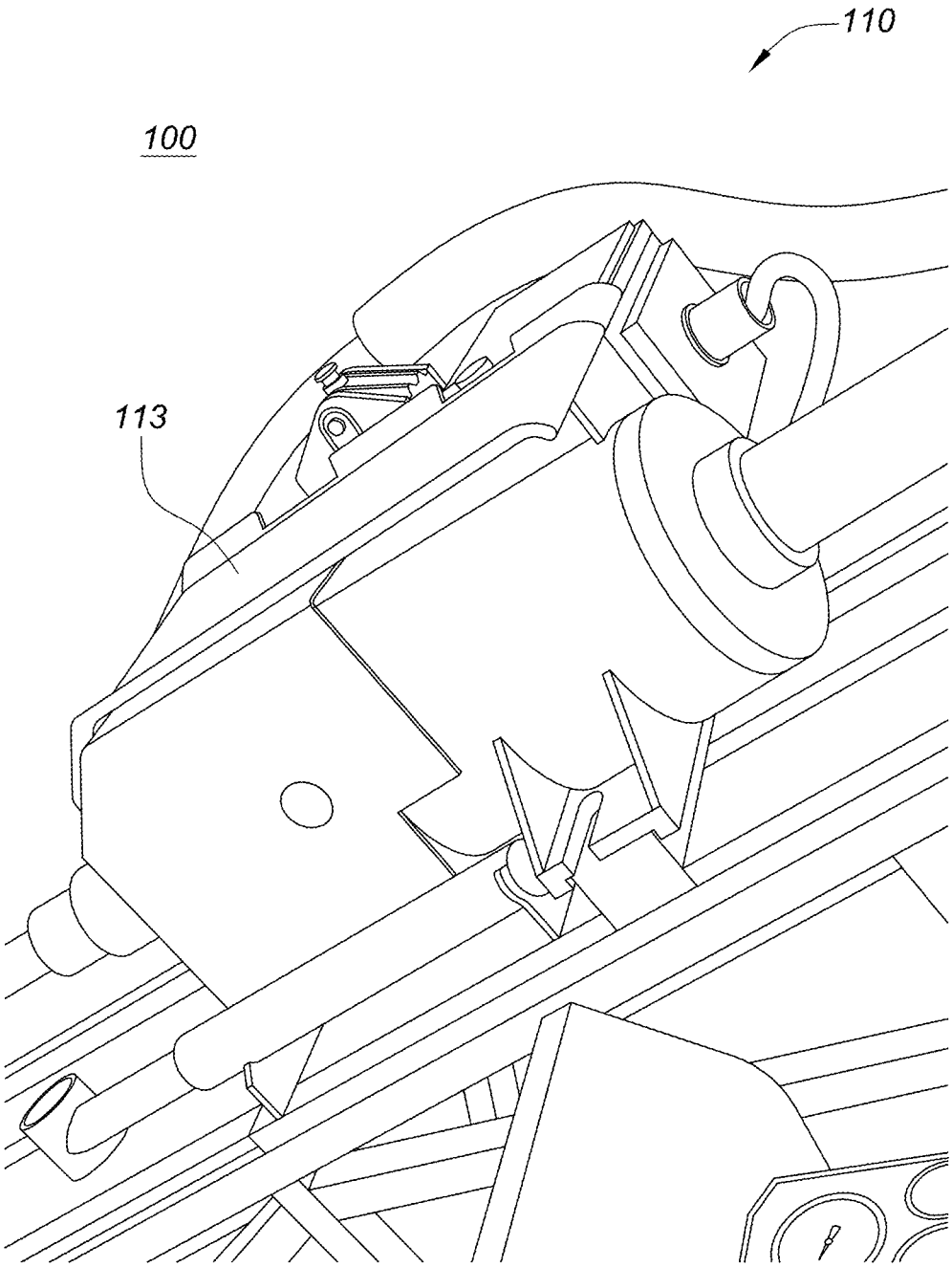
Figure 3D:
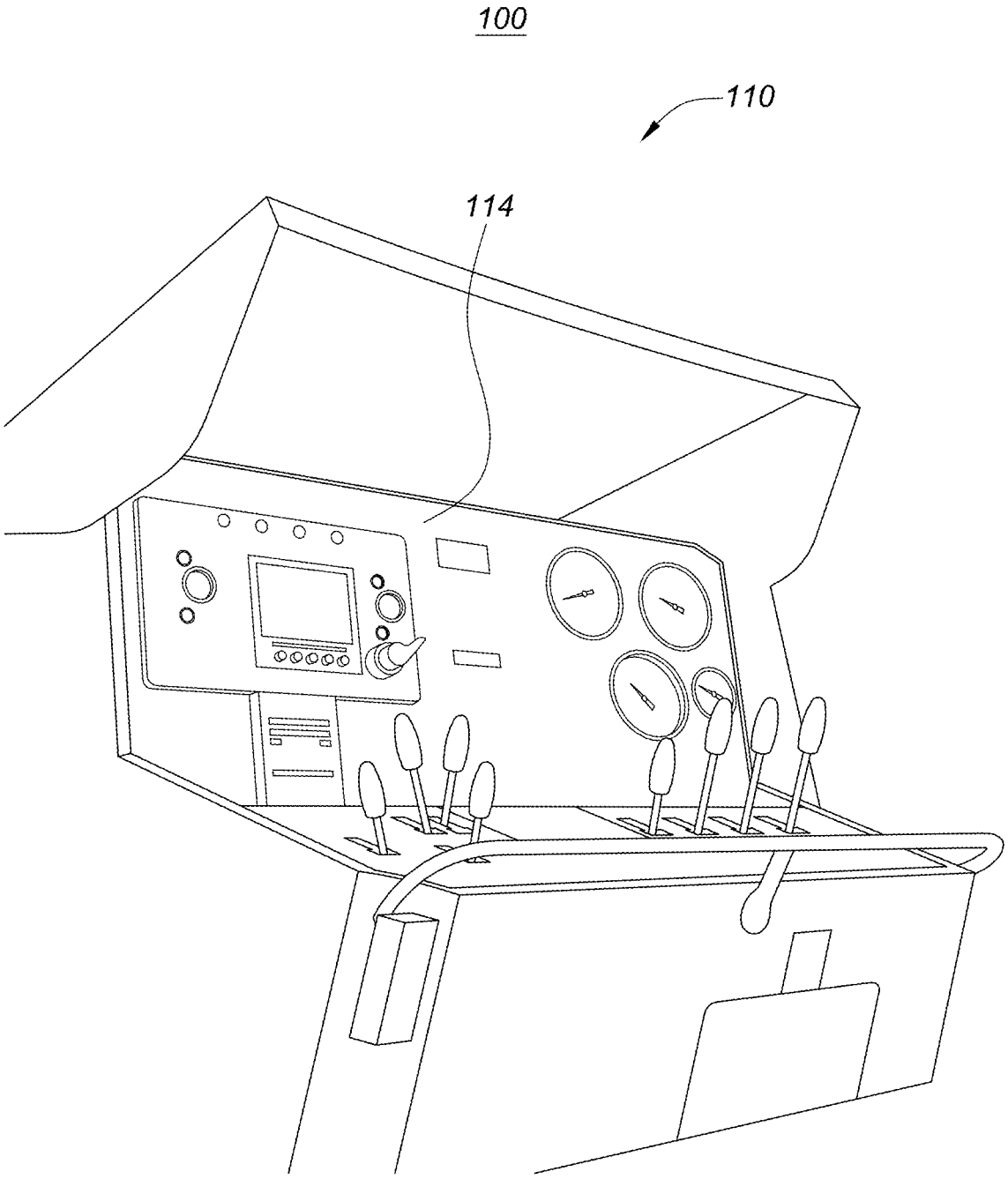

The drill chuck system 113 of the drill rig system 110 can comprise a clamping mechanism (or system or means) for engaging the drill rod string and/or a rotational mechanism (or system or means) for rotating the drill rod string. As shown in FIG. 3C, the drill chuck system 113 can be mounted on, or otherwise coupled with, the drill rig mast system 112.

The drill rig control panel system 114 can comprise a series of gauges, levers, buttons and/or other control devices for controlling one or more functions of the drill rig system 110. Operation of the engine, electrical systems and/or hydraulic systems of the drill rig system 110, for example, can be controlled via the drill rig control panel system 114. The drill rig control panel system 114 can be separate from, and/or at least partially integrated with, the drill rig system 110.

Figure 3E:
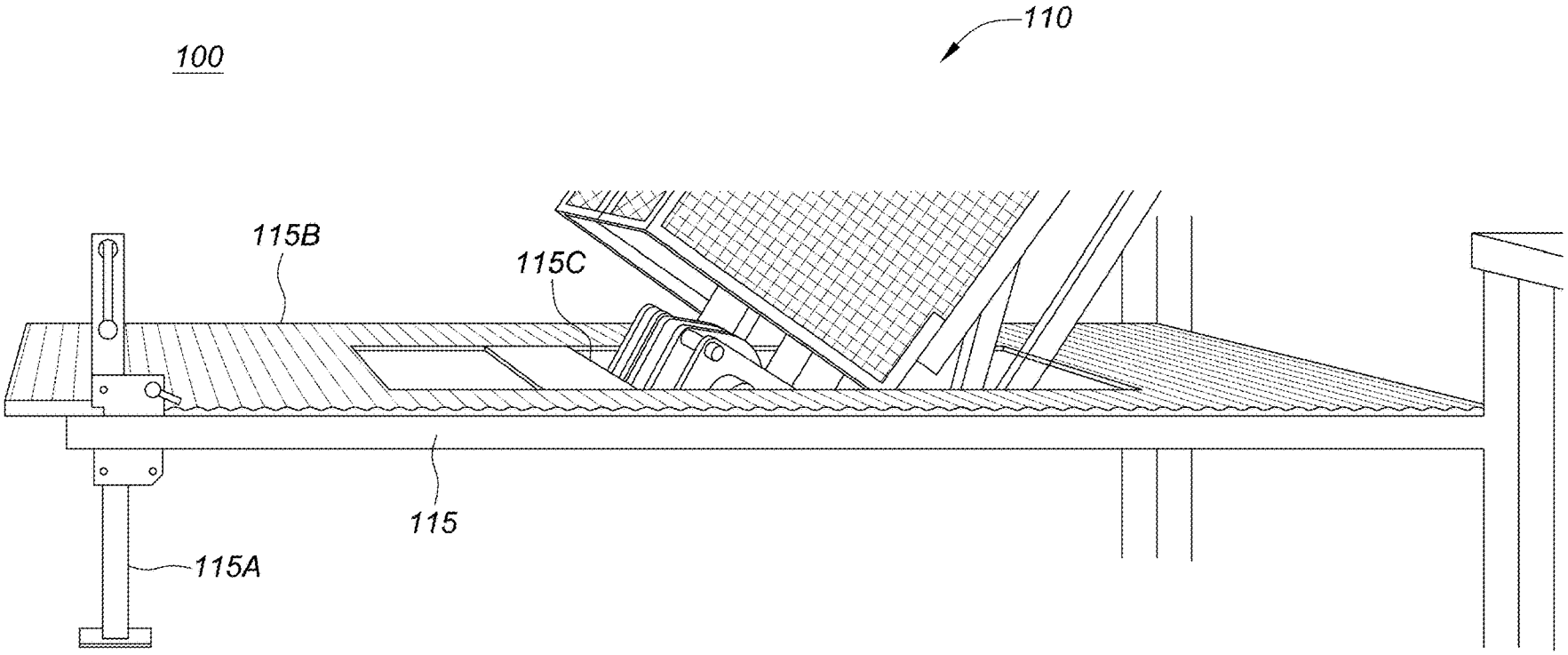

In the manner discussed above, the drill rig deck system 115 can provide a platform 115B upon which one or more drill rig operators can stand for accessing the drill rig control panel system 114. The drill rig deck system 115 advantageously can help keep the drill operators off of the ground, which can be wet and/or muddy. As illustrated in FIG. 3E, the drill rig deck system 115 can include one or more support devices 115A for supporting the platform 115B. The support devices 115A preferably comprise adjustable support devices, such as jack systems (or means), for leveling the platform 115B regardless of a geographic topology of the ground of the predetermined drill site 200 beneath the drill rig deck system 115.

In selected embodiments, the platform 115B can define a central opening 115C with a predetermined size, shape and/or other dimension for receiving one or more selected drill rig components. The central opening 115C optionally can have an adjustable size, shape and/or other dimension. The drill rig deck system 115, for example, can include one or more insert devices or other adjustment systems (or means) for adjusting the central opening 115C depending on the relevant drill rig system 110 and/or the angle of drilling. Exemplary angle of drilling can include, but are not limited to, drilling angles between thirty degrees and ninety degrees. The adjustment systems can have uniform and/or different sizes, shapes and/or dimensions.

The drill rig deck system 115, in selected embodiments, can be configured for transport atop or otherwise adjacent to the mud tank system 157. Transporting the drill rig deck system 115 with the mud tank system 157 advantageously can reduce mobilization time. Optionally, the drill rig deck system 115 can be independent of the drill rig system 110. The drill rig deck system 115 can be suitable for use with any drill rig system 110. For example, the drill rig deck system 115 can enable changing drill rig systems 110 at any time unlike conventional drill rig mounted platforms that vary in size and design.

The drill rig deck system 115 can be disposed on top of the collar tray system 156 in selected embodiments and/or can (seamlessly) integrate with the collar tray system 156, the rod skid system 121 and/or the mud tank system 157. Additionally and/or alternatively, the drill rig deck system 115 can comprise an adjustable drill rig deck system and/or can provide access to the drill rig control panel system 114 and/or the water distribution box system 151 of the surface drilling system 100. The drill rig deck system 115 optionally can be adjusted to a suitable height, such as a suitable lifting height for facilitating loading of drill rods 121A from the rod skid system 121. An optional drill rig winch system (or means) (not shown) can be utilized to load the drill rods 121A from the rod skid system 121 onto the drill rig deck system 115.

Turning to FIGS. 2 and 4A-C, the rod skid system 121 is illustrated as comprising a container for transporting and containing one or more drill rods 121A. Each drill rod 121A can comprise a hollow rod that is used in drilling. During drilling operations, a selected drill rod 121A can be disposed in the drill chuck system 113 and/or a water swivel system (or means) 154 can be disposed on top of the selected drill rod 121A to provide water circulation. The rod skid system 121 preferably can include sufficient drill rods 121A for one drillhole. An exemplary rod skid system 121 can contain 30 HWT-size rods, 80 HQ-size rods and 200 NQ-size rods.

These drill rods 121A amount to 60 m HWT-size rods, 240 m HQ-size rods and 600 m NQ-size rods. In selected embodiments, a water pump standpipe system (or means) 140B, a vacuum pump standpipe system (or means) 158B and/or a tool rack system (or means) 165 can be transported via the rod skid system 121. The water pump standpipe system 140B, the vacuum pump standpipe system 158B and/or the tool rack system 165, for example, can be disposed on top of the drill rods 121A and/or the rod skid system 121 during transport. The rod skid system 121 advantageously can be used with the vehicle 160 with a tilt-tray system (or means) 160B and can feature a standardized container system, such as a twenty-foot container twist locks 121E. The size of the standardized container system can help facilitate and accelerate locking the drill rod pile 121B in place for transport. The rod skid system 121 can include an optional winch/tow anchor system (or means) 121C to facilitate transport of the rod skid system 121. In selected embodiments, the drill rig deck system 115 can be shaped to accommodate a notch associated with the winch/tow anchor system 121C of the rod skid system 121.

In selected embodiments, the rod skid system 121 advantageously can maintain a predetermined lifting height at all times throughout the use and depletion of the drill rod pile 121B. When drilling operations commence, a height of the drill rods 121A preferably is ideal for lifting and/or slotting into the drill chuck system 113, one by one. This ideal height preferably is adjusted or otherwise maintained as drill rods 121A are removed from the drill rod pile 121B.

Figure 4A:
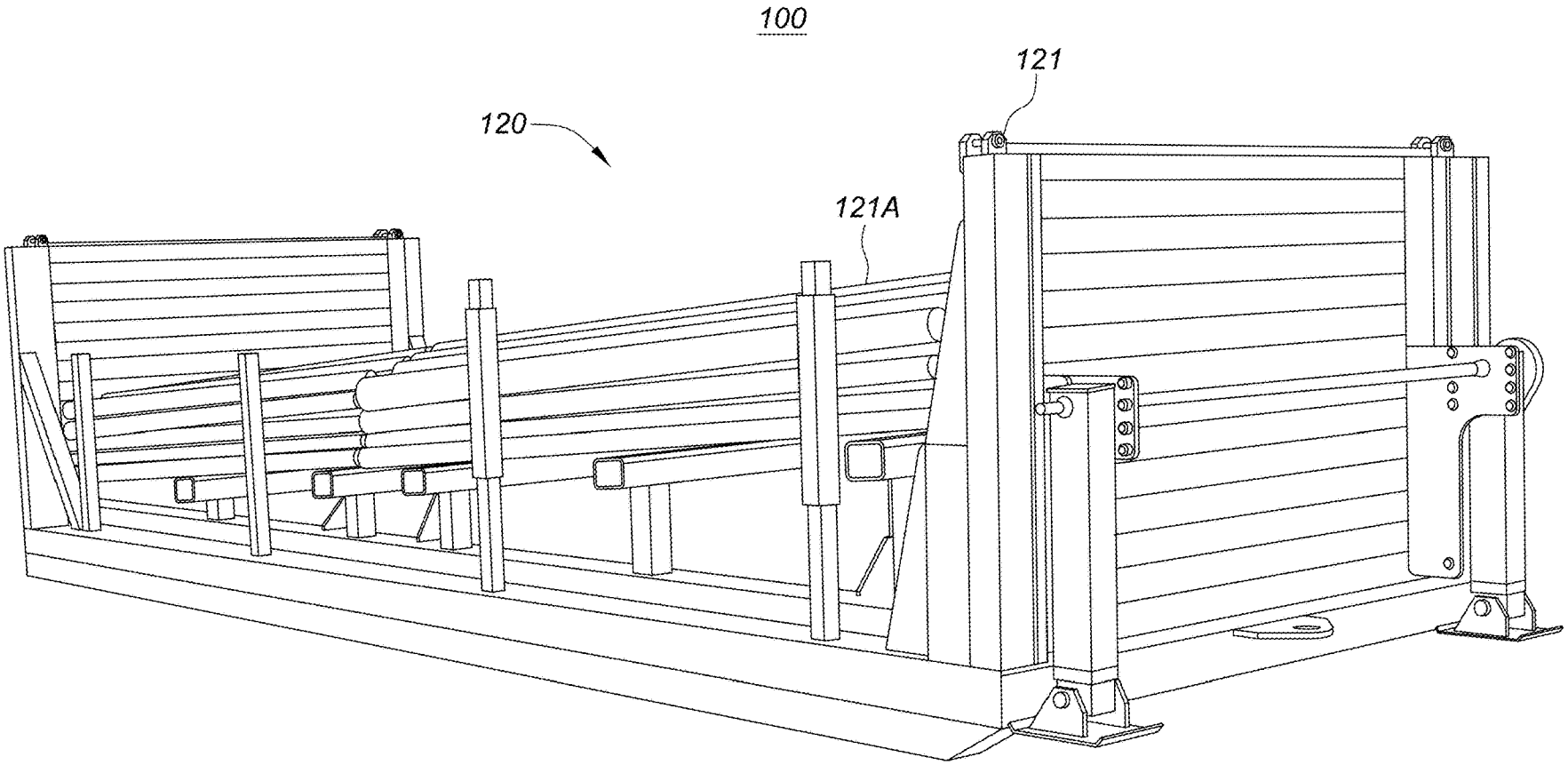
FIG. 4A is a detail drawing illustrating an exemplary embodiment of a rod skid system for the surface drilling system of FIG. 1.
Figure 4B:
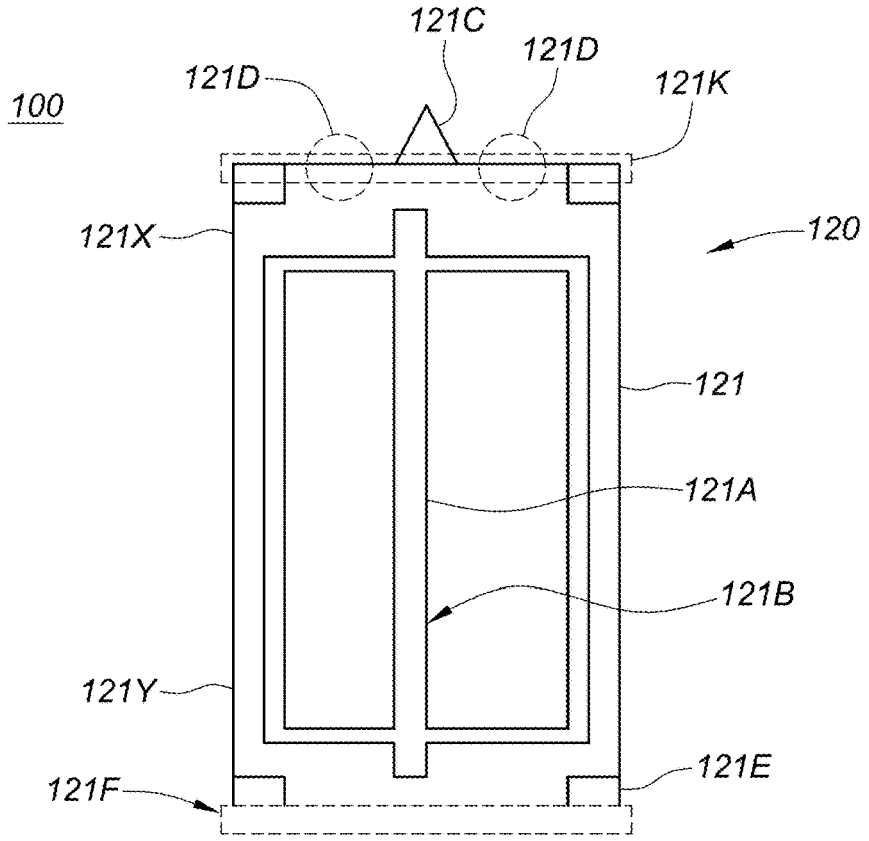
FIG. 4B is a detail drawing illustrating a top view of an exemplary alternative embodiment of the rod skid system of FIG. 4A.

As illustrated in FIG. 4B, for example, the rod skid system 121 can include at least one jack system (or means) 121D, such as a standard semi-trailer mechanical jack and/or a self-primed jack. The jack system 121D advantageously can elevate proximal end regions of the drill rods 121A disposed adjacent to a proximal end region 121X of the rod skid system 121 relative to distal end regions of the drill rods 121A disposed adjacent to a distal end region 121Y of the rod skid system 121. As needed, the elevation of the proximal end regions of the drill rods 121A can be adjusted as drill rods 121A are removed from the drill rod pile 121B. Stated somewhat differently, if the drill rod pile 121B begins to deplete, a level of drill rods 121A can become too low for safe lifting. The jack system 121D can be utilized to raise a selected drill rod 121A, skid the selected drill rod 121A above the ground and maintain a safe lifting height.

Figure 4C:
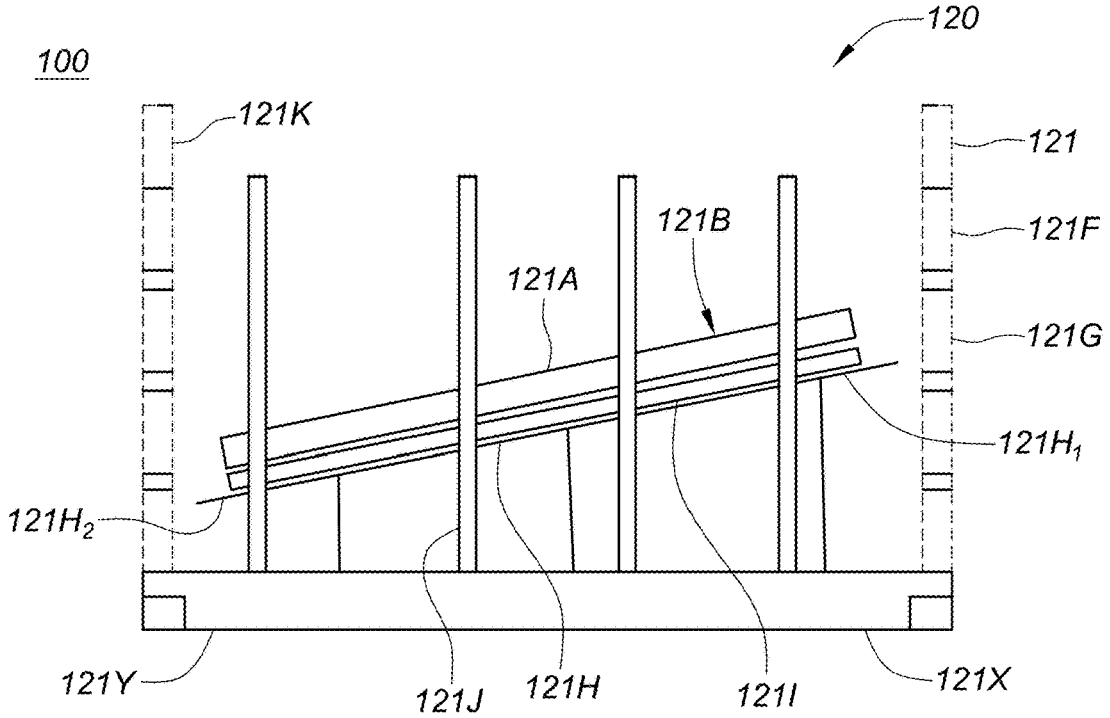
FIG. 4C is a detail drawing illustrating a side view of the rod skid system of FIG. 4B.

The rod skid system 121, additionally and/or alternatively, can include a ramp system (or means) 121H for maintaining the predetermined lifting height of the drill rod pile 121B. Turning to FIG. 4C, the drill rod pile 121B can be disposed on the ramp system 121H with the proximal end regions of the drill rods 121A being disposed adjacent to a proximal end region 121$H_1$ of the ramp system 121H and the distal end regions of the drill rods 121A being disposed adjacent to a distal end region 121$H_2$ of the ramp system 121H. The ramp system 121H advantageously can elevate the proximal end regions of the drill rods 121A relative to the distal end regions of the drill rods 121A. As needed, the elevation of the proximal end regions of the drill rods 121A can be adjusted as drill rods 121A are removed from the drill rod pile 121B. In other words, if the drill rod pile 121B begins to deplete, a level of drill rods 121A can become too low for safe lifting. The ramp system 121H can be utilized to raise a selected drill rod 121A, skid the selected drill rod 121A above the ground and maintain a safe lifting height. In selected embodiments, the ramp system 121H can have dunnage 121I, such as wood dunnage, to help avoid damage to the drill rods 121A that are placed on the ramp system 121H.

The drill rods 121A can tend to shift or otherwise move within the rod skid system 121 when the proximal end regions of the drill rods 121A during and/or after elevation. The rod skid system 121 advantageously can be configured to retain the drill rods 121A during and/or after elevation. The rod skid system 121, for example, can include a headboard system (or means) 121K and/or a backboard system (or means) 121F. The headboard system 121K and/or the backboard system 121F can be made from slotted drop-in steel inserts 121G, which can feature wooden dunnage (not shown) on the inside to help avoid damage to the drill rods 121A that are placed on the headboard system 121K and/or the backboard system 121F.

The backboard system 121F, for example, can help retain the drill rods 121A within the rod skid system 121 while the proximal end regions of the drill rods 121A are elevated. In selected embodiments, the backboard system 121F can comprise one or more backboard inserts 121H for adjusting a height of the backboard system 121F, for example, to keep the height of the backboard system 121F consistent with a height of the drill rod pile 121B. A first backboard insert 121G, for example, can be added to the backboard system 121F for increasing the height of the backboard system 121F and/or a second backboard insert 121G can be removed from the backboard system 121F for decreasing the height of the backboard system 121F. In an analogous manner, the headboard system 121K can be associated with one or more headboard inserts that can be added to, and/or removed from, the headboard system 121K for adjusting a height of the headboard system 121K.

Additionally and/or alternatively, the rod skid system 121 can include one or more support beams (or posts) 121J, preferably five support beams, to help retain the drill rods 121A within the rod skid system 121. The support beams 121J, for example, can be disposed along a length of the rod skid system 121 as illustrated in FIG. 4C. In other words, the support beams 121J can be disposed along at least one side of the rod skid system 121. The support beams 121J can be tilted with tops of support beams being within one tilted plane and/or can be removable from the rod skid system 121.

Advantageously, the rod skid system 121 can comprise a simple, fail-safe design. The rod skid system 121, for instance, can offer reduced manufacturing costs and/or can be substantially maintenance free to operate. By removing a need for eight hydraulic jacks and hydraulic power pack required by conventional drill rod skids or sloops, the rod skid system 121 can increase reliability and lower manufacturing costs. The rod skid system 121, unlike conventional drill rod sloops, does not require its own truck and thereby can lower maintenance costs and capital expenditure for the drilling operation.

Figure 5A:
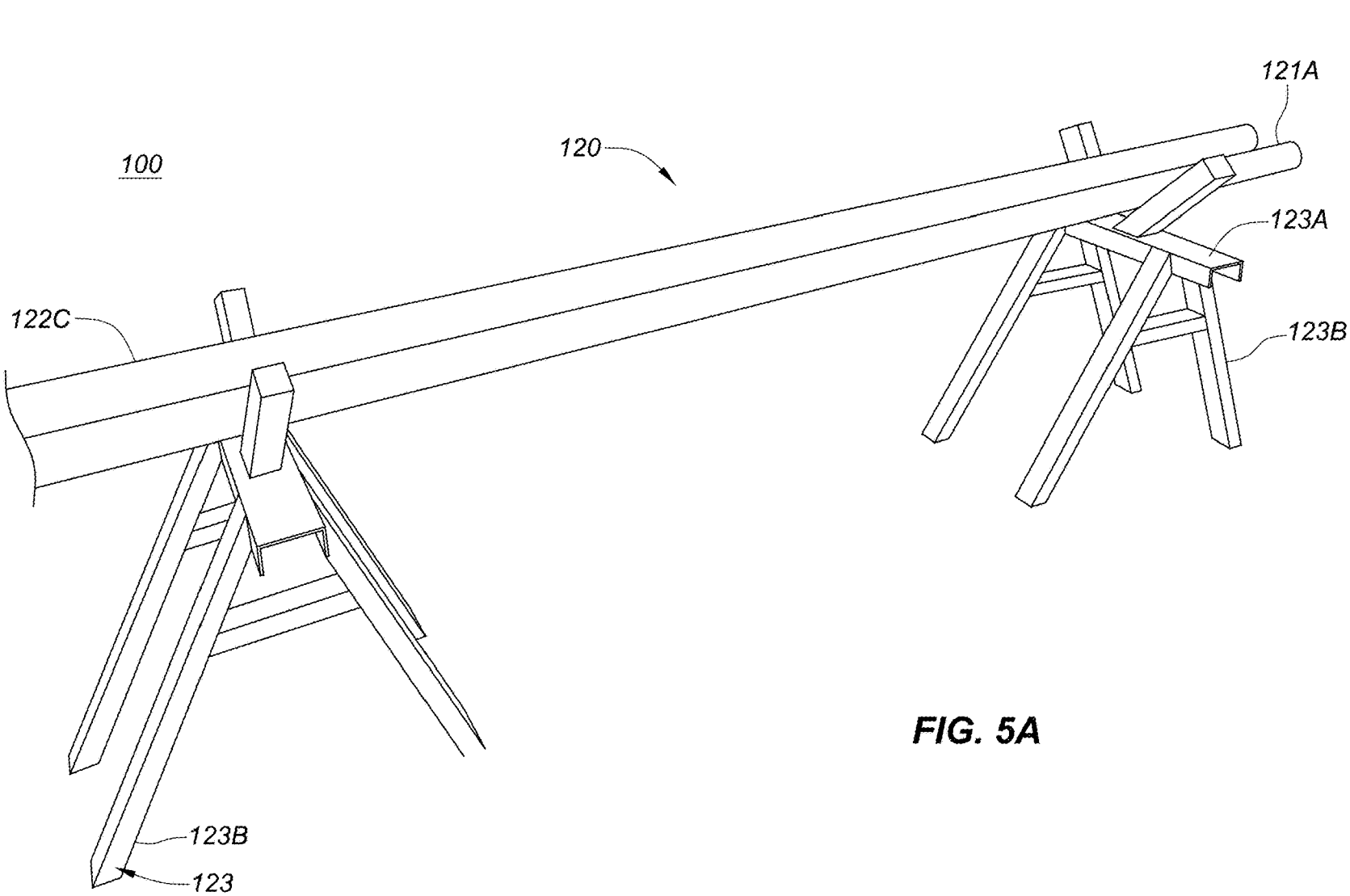
FIGS. 5A-B are detail drawings illustrating an exemplary embodiment of an inner tube and core processing system for the surface drilling system of FIG. 1.
Figure 5B:
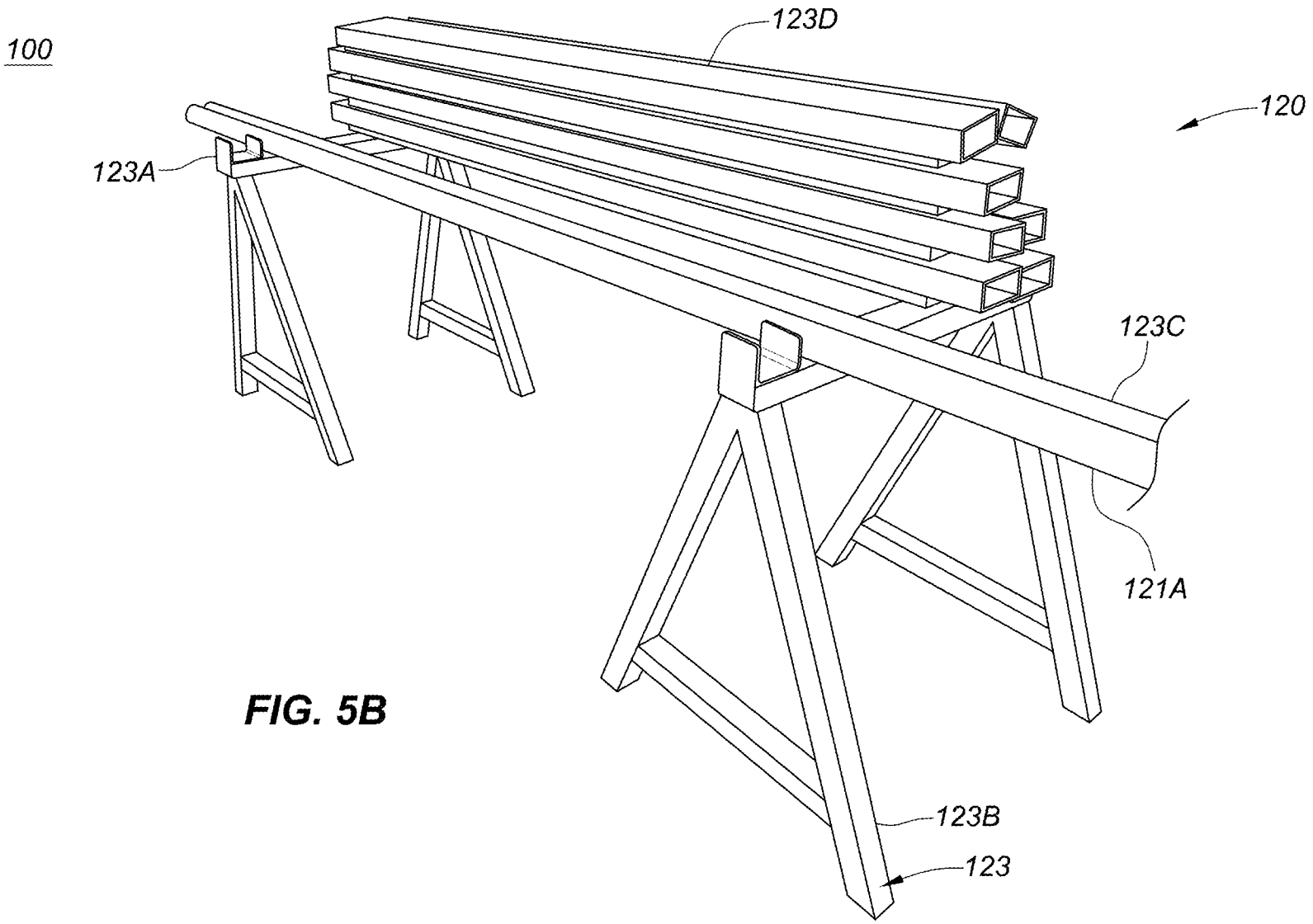
Figure 6A:
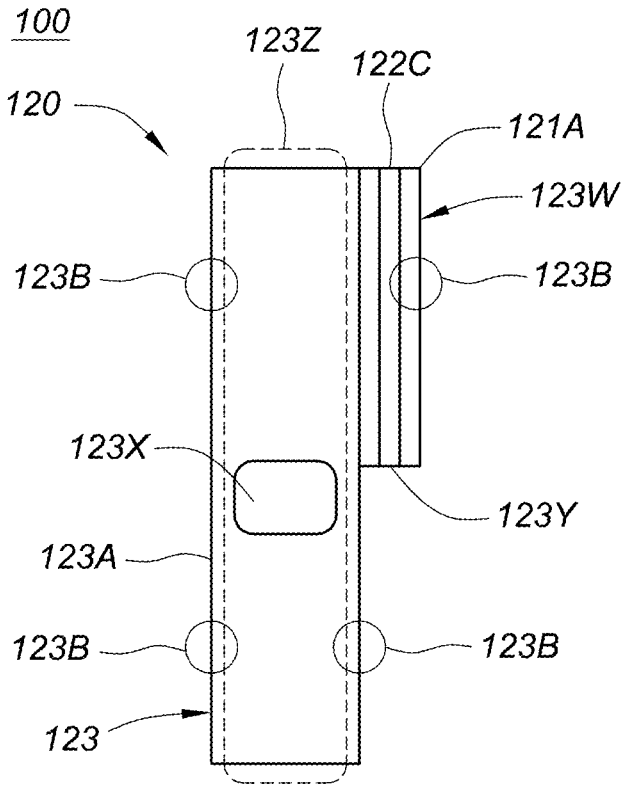
FIG. 6A is a detail drawing illustrating a top view of an exemplary alternative embodiment of the inner tube and core processing system of FIG. 5.
Figure 6B:
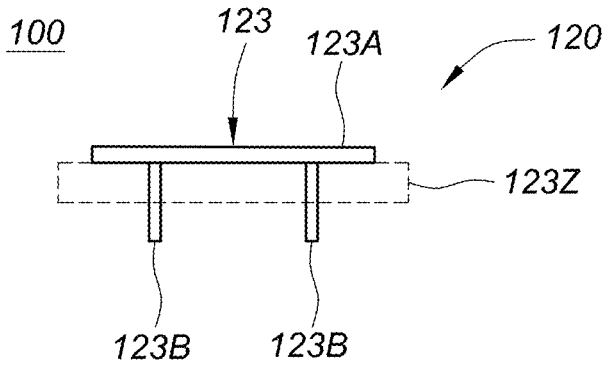
FIG. 6B is a detail drawing illustrating a side view of the inner tube and core processing system of FIG. 6A.

An exemplary inner tube and core processing system (or means) 123 is shown in FIGS. 5A-B with an alternative embodiment of the inner tube and core processing system 123 being illustrated in FIGS. 6A-B. The inner tube and core processing system 123 can be utilized to unscrew an inner tube 122C associated with a selected drill rod 121A and pump out or otherwise remove core material from the inner tube 122C. Turning to FIGS. 2, 5A-B and 6A-B, the inner tube and core processing system 123 can include a table system (or means) comprising a table top 123A and one or more table legs 123B coupled with the table top 123A and being configured to support the table top 123A. The table legs 123B can be disposed at respective corner regions of a rectangular table top 123A. In selected embodiments, the table legs 123B can comprise jack table legs for levelling the table top 123A when the inner tube and core processing system 123 is disposed on an uneven surface.

The table top 123A preferably comprises a flat table top formed from metal or any other suitable material and/or can define one or more water catchment drains 123X. The inner tube and core processing system 123 can include at least one water catchment tray 123Z disposed beneath the table top 123A and be configured to receive water draining from the table top 123A via the water catchment drains 123X. Each water catchment tray 123Z can be at least partial integrated with the table system. Stated somewhat differently, the water catchment tray 123Z can be fixedly coupled with the table system, slidably coupled with the table system and/or slidable coupled with the table system.

The inner tube and core processing system 123 advantageously can include an optional inner tube processing system (or means) 123W. The inner tube processing system 123W can receive and/or support one or more drill rods 121A and/or one or more inner tubes 122C. In selected embodiments, the inner tube processing system 123W can comprise a grill system (or means) 123Y for stabilizing the drill rods 121A and/or inner tubes 122C disposed at the inner tube processing system 123W. The grill system 123Y, for example, can be formed via one or more angled rods, bars or other elongated members (not shown). The inner tube processing system 123W thereby can stabilize drill rods 121A and/or inner tubes 122C of any size and allow for ergonomic work, such as service, repairs, assembly and/or disassembly.

In use, the table top 123A and the water catchment drains 123X can be used to support the inner tube 122C during removal of the core material as well as supporting a drill core tray 123D where the core will be placed afterwards for storage. During the pumping out of the core, the fluid can drain via the drains into the water catchment drains 123X and later can be reused in the drilling operation. The catchment tray can be connected to the collar tray system 156 to drain and reuse the fluid. The inner tube and core processing system 123 can be transported in any suitable manner, for example, secured to an upper portion of the rod skid system 121 or the mud tank system 157 for transport.

Figure 2:
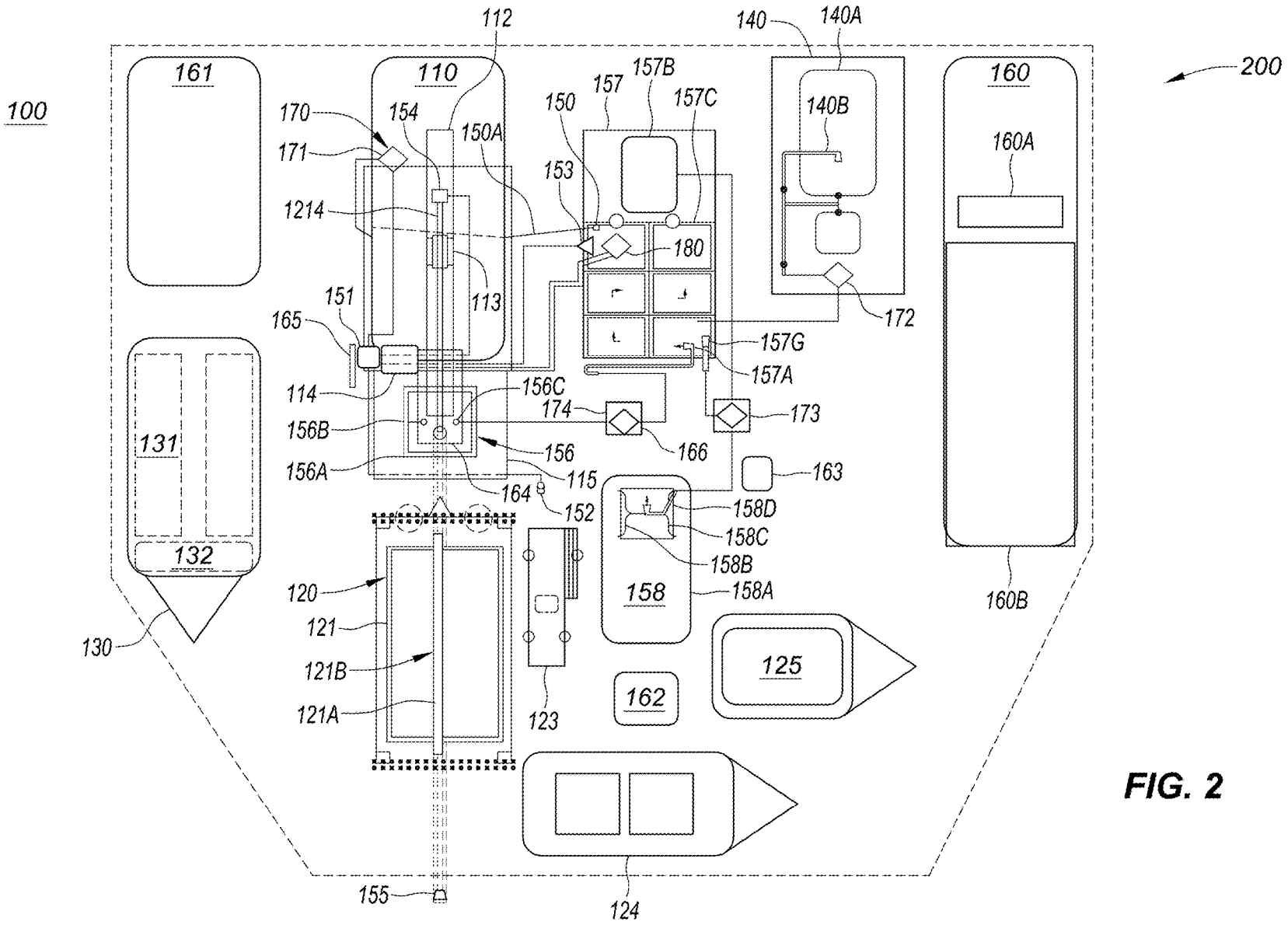
FIG. 2 is a detail drawing illustrating an exemplary alternative embodiment of the surface drilling system of FIG. 1, wherein the surface drilling system comprises a surface mineral exploration diamond core drilling system.
Figure 7:
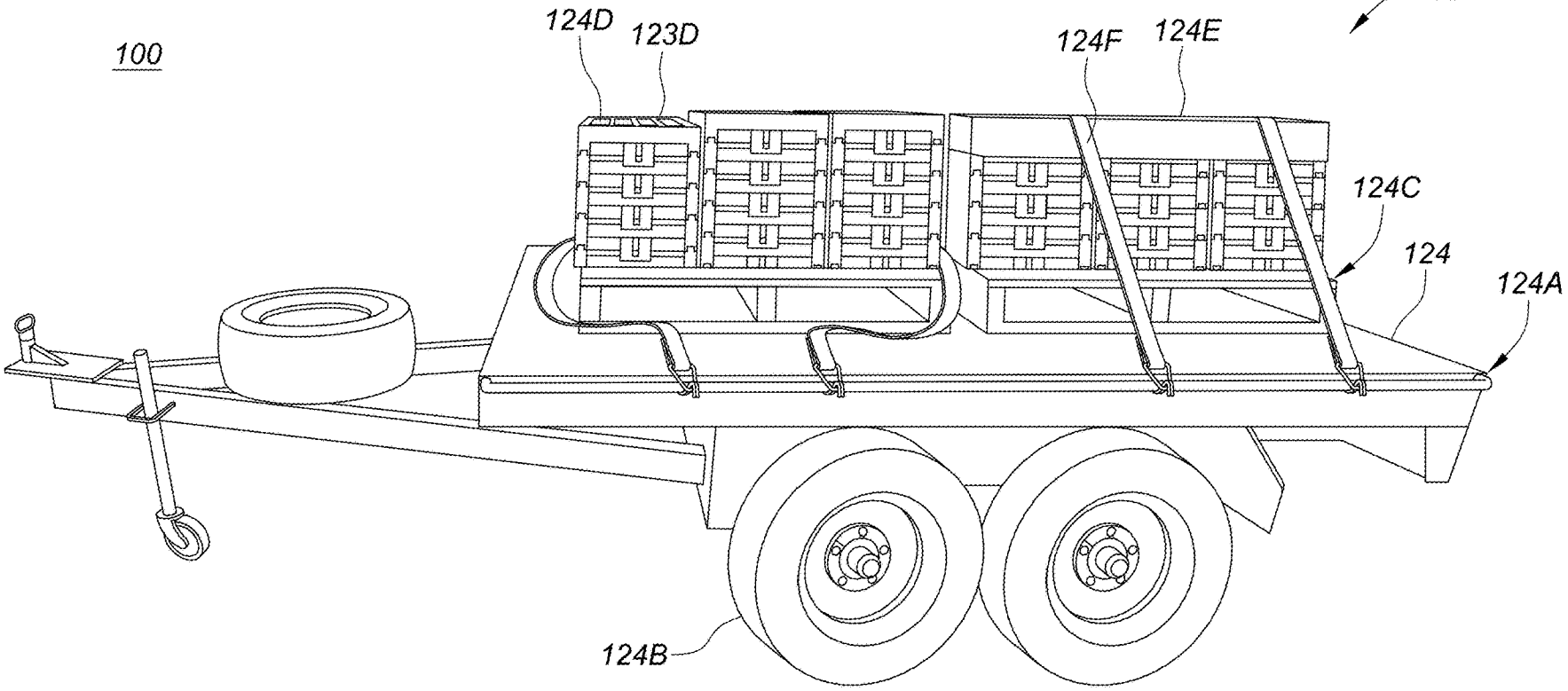
FIG. 7 is a detail drawing illustrating an exemplary embodiment of a core transport system for the surface drilling system of FIG. 1.

The surface drilling system 100 optionally can include a core transport system (or means) 124 for transporting the drill core trays 123D as shown in FIGS. 2 and 7. The core transport system 124 can be configured to safely transport the drill core trays 123D from the predetermined drill site 200 to any destination by any quality road. As shown in FIG. 7, for example, the core transport system 124 can comprise a trailer, such as a trailer with load rating of between one-half ton and nine tons.

The core transport system 124 can include, but is not limited to, a movable transport system base 124A that is supported by a suspension system for providing full shock absorption, which can help prevent damage to the core material during transport. The core material, for example, can be inhibited from slide out from core transport system 124 or from being shaken or otherwise damaged by other loads falling onto the core material. As illustrated in FIG. 7, the suspension system of the core transport system 124 can include two or more wheels 124B and an optional spare wheel. The core transport system 124, for instance, can include high-clearance, all terrain tires and suspension.

In selected embodiments, the core transport system 124 can comprise a special-purpose system that is configured for safe core transport compared to using pickup truck beds that cannot accommodate the full amount of core material and do not provide secure mounting capability. The transport system base 124A, for example, can define a plurality of transport slots 124C for receiving the drill core trays 123D. The drill core trays 123D optionally can be stacked on top of or otherwise disposed within respective pallets 124D before being received by the transport slots 124C. Stated somewhat differently, the pallets 124D containing the drill core trays 123D can be disposed in the transport slots 124C. A tray lid 124E can be disposed on the drill core trays 123D. If the tray lid 124E includes a strap slot, the drill core trays 123D can be secured to the transport system base 124A via one or more tie-down straps 124F. The tie-down straps 124F can be mounted on each side of the transport system base 124A that ties down the tray lid 124E.

The core transport system 124 can repeatedly take empty drill core trays 123D to the predetermined drill site 200 and return from the predetermined drill site 200 with full drill core trays 123D. The core transport system 124 preferably is configured to transport a full amount of core material, which can comprise between fifteen day output and a forty-five day output from the drilling operations or more.

Advantageously, the core transport system 124 can help reduce core handling times and/or reduce risk of core sample and/or tray damage. The core transport system 124 for example, can be parked or otherwise disposed adjacent to the inner tube and core processing system 123, such that the material need be loaded and unloaded only once and/or without a crane system (or means) 160A, a forklift or any other auxiliary equipment. If a crane system 160A, a forklift or other auxiliary equipment is used the core transport system 124 can be quickly loaded and/or unloaded. The transport slots 124C, for example, can have three walls, allowing for fast forklift-assisted unloading of the core pallets from the trailer. In selected embodiments, the core transport system 124 can be unloaded, loaded with empty drill core trays 123D and sent back to the drill site 200 in less than a half hour.

The large capacity of the core transport system 124 can reduce a number of trips to and from the drill site 200 and/or the core transport system 124 can be configured for off-road transport to remove drill sites 200. The core transport system 124 likewise can be utilized by a single operator, such as a driver of a pickup truck or other tow vehicle 161 for towing the core transport system 124. The tow vehicle 161, for example, can comprise a four-wheel drive vehicle, such as a coupé utility (or ute), with a towing capacity of between two tons and five tons. In selected embodiments, the core transport system 124 can form an end of a production line after the inner tube and core processing system 123. Empty drill core trays 123D thereby can be offloaded from the core trailer and processed by the inner tube and core processing system 123, which can fill the drill core trays 123D with core material.

Figure 8:
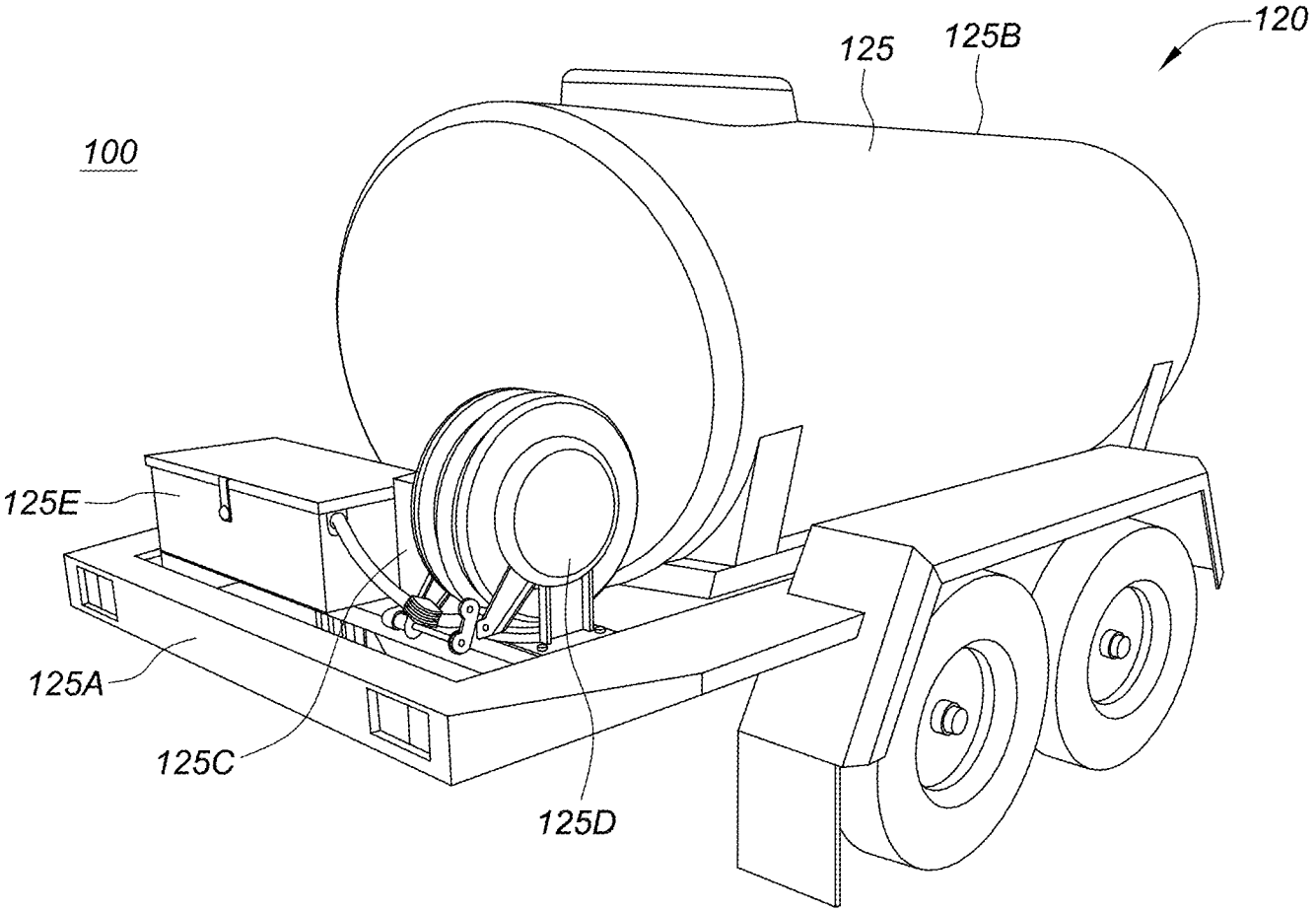
FIG. 8 is a detail drawing illustrating an exemplary embodiment of a fuel trailer system for the surface drilling system of FIG. 1.

An exemplary fuel trailer system (or means) 125 for the surface drilling system 100 is shown in FIG. 8. Turning to FIGS. 2 and 8, the fuel trailer system 125 is shown as comprising a trailer system (or means) 125A, a fuel tank system (or means) 125B, a fuel pump system (or means) 125C and/or a fuel hose reel system (or means) 125D. The fuel trailer system 125 optionally can include one or more safety devices (or means) 125E, such as a fire extinguisher and/or a spill kit system 163. Use of the fuel trailer system 125 advantageously can help reduce capital expenditure costs, require limited maintenance and can be towed via any suitable vehicle.

The fuel trailer system 125 can be operated via any suitable direct current (DC) and/or alternating current (AC) power source that is available at the drill site 200, such as a 12 VDC power available from a vehicle battery disposed at a suitable vehicle. In use, the fuel trailer system 125 can be used to provide fuel to, or to refuel, the drill rig system 110 and/or one or more of the drill rig support systems 120 of the surface drilling system 100. The fuel trailer system 125, for example, can provide fuel to the diaphragm pump system 174, one or more trucks or other vehicles, at least one generator (not shown), at least one air compressor system (or means) 157B and/or a self-priming centrifugal water pump system (or means) 172 of the surface drilling system 100. Additionally and/or alternatively, the fuel trailer system 125 can provide fuel to one or more systems of a camping system 300 for supporting the operators and other personnel associated with the surface drilling system 100 and/or the drill site 200.

Figure 9:
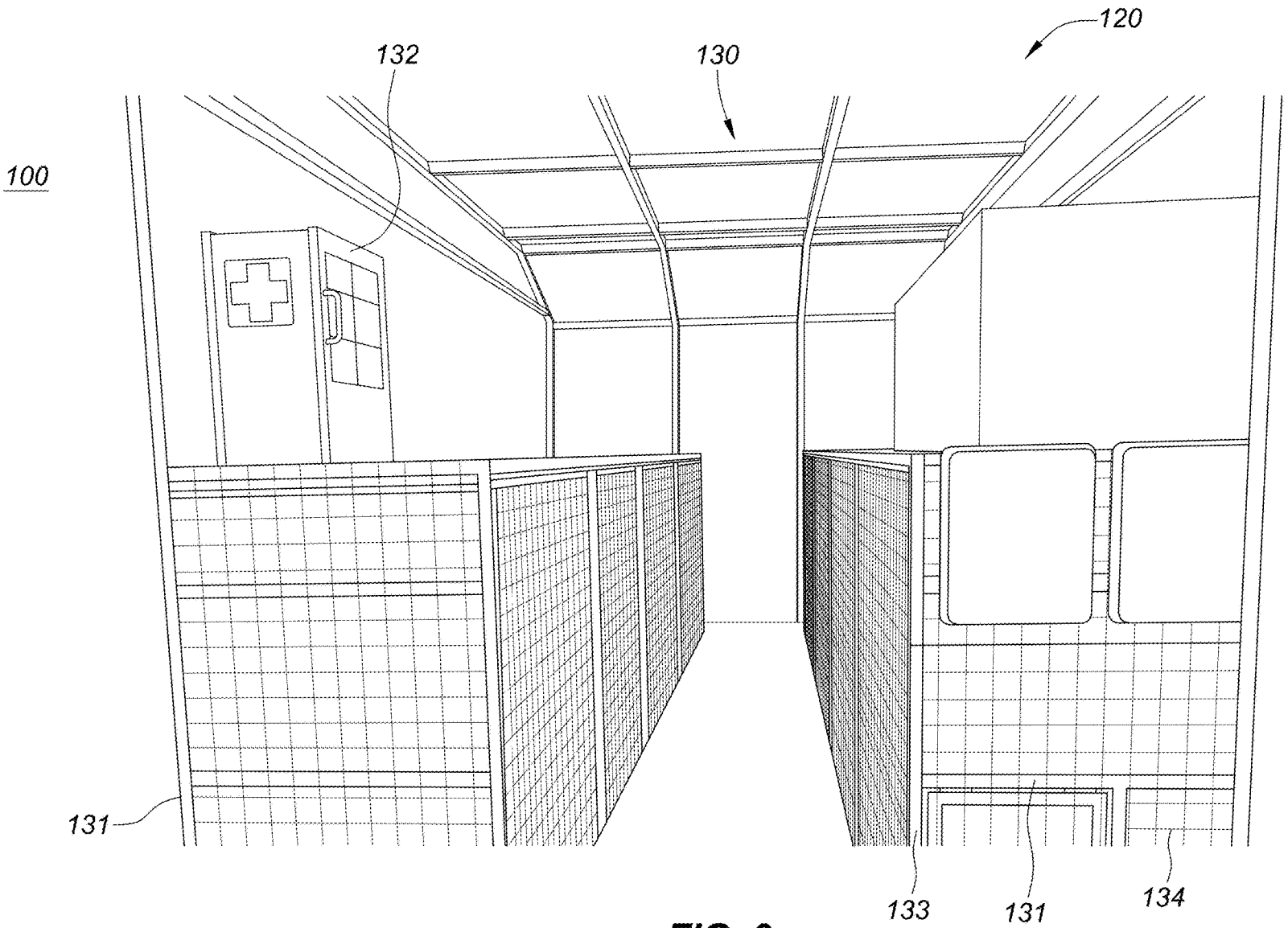
FIG. 9 is a detail drawing illustrating an exemplary embodiment of a logistics system for the surface drilling system of FIG. 1.

In selected embodiments, the surface drilling system 100 can include a logistics system (or means) 130 as illustrated in FIGS. 2 and 9. The logistics system 130, for example, can comprise a trailer system, such as a fully-enclosed trailer system, with transport and/or storage for consumables, spare parts, tools and other supplies for use by the surface drilling system 100 or otherwise at the drill site 200. The logistics system 130 optionally can provide a shaded workspace for the operators and other personnel associated with the surface drilling system 100 and/or the drill site 200. An awning system (not shown) of the logistics system 130, for instance, can provide shading for the drill rig control panel system 114.

If the logistics system 130 comprises the trailer system, the awning system can be disposed on one or more sides of the trailer system. The trailer system preferably requires little maintenance and/or can include a door on a side of the trailer system that is adjacent to the drill rig system 110 to facilitate access to the drill rig system 110 from the logistics system 130. One or more windows or other openings can be formed in the sides of the trailer system to help provide airflow through the logistics system 130, and/or the trailer system can include a double ceiling with spaced surfaces for better heat insulation. The trailer system can include a suspension system with two or more wheels and an optional spare wheel. For instance, the trailer system can include high-clearance, all terrain tires and suspension.

The logistics system 130 of FIGS. 2 and 9 is shown as including at least one storage cabinet systems 131. The storage cabinet systems 131 can be configured to provide storage shelves, storage slots and/or other types of storage cells for providing organized storage for the stored supplies. The storage cells can be provided with predetermined shapes, sizes and other dimensions, which may be uniform and/or different among the storage cells. In selected embodiments, the shape, size and other dimension of at least one storage cell can be adjustable to conform with the stored supplies.

The adjustable storage cells can be formed, for example, by providing a selected storage cabinet system 131 with multiple slots tightly spaced among each other on top and bottom of each storage shelf and inserting one or more wall inserts the top and bottom slots such that a predetermined distance between the wall inserts defines a storage space that is sufficient for receiving a preselected type of supplies. The defined storage space preferably can prevent the preselected supplies from rolling, sliding or otherwise moving within the storage space during transport. Advantageously, the top and bottom slots can be very tightly spaced to permit fine adjustments of the predetermined distance between the wall inserts for accommodating each preselected type of supplies. In selected embodiments, at least one storage shelf of the storage cabinet systems 131 can be long enough to transport drill rods 121A, inner tubes 122C and/or other long drilling supplies.

As shown in FIGS. 2 and 9, the storage cabinet systems 131 can include a frame 133 and a mesh 134 for enabling the drilling supplies stored within the storage cabinet systems 131 to be visible outside of the storage cabinet systems 131. If the storage cabinet systems 131 include door and side regions, for example, the door and side regions can be formed from the mesh 134. At least one of the storage shelves, storage slots and/or other types of storage cells alternatively can be formed from the mesh 134. The organized, highly visible storage advantageously can speed up stocktaking and/or reduce the chances of mistakes while stocktaking. The storage cabinet systems 131 can provide storage for a first aid kit 132 and/or a spill kit bin (not shown).

Additionally and/or alternatively, the logistics system 130 can include at least one work bench device (not shown). The work bench device can provide a workspace for the operators and other personnel associated with the surface drilling system 100 and/or the drill site 200. Optionally, the work bench device can provide storage for tools and other drilling supplies. One or more drill core blocks, for example, can be disposed on the work bench device.

Figure 10:
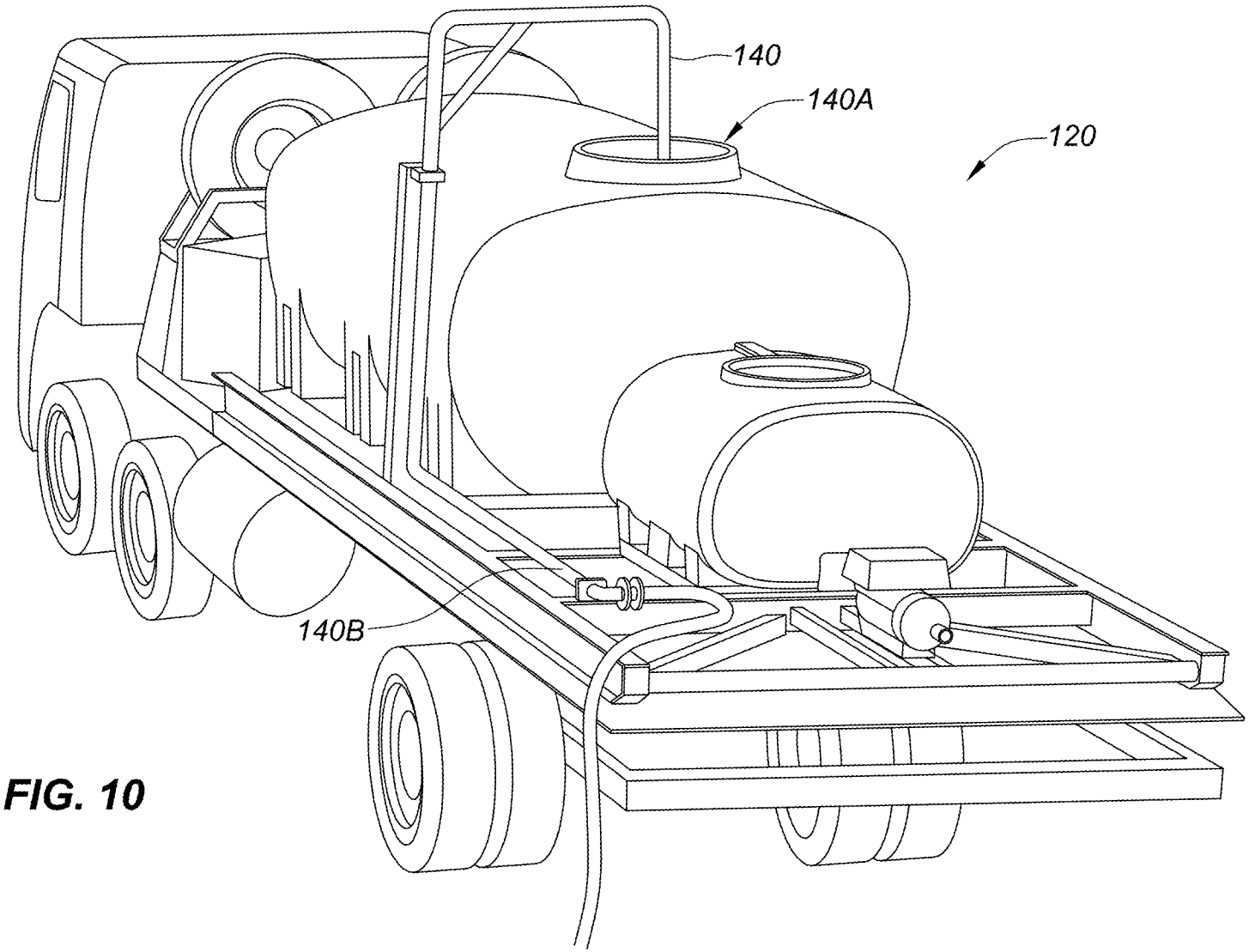
FIG. 10 is a detail drawing illustrating an exemplary embodiment of a water skid system for the surface drilling system of FIG. 1.
Figure 11A:
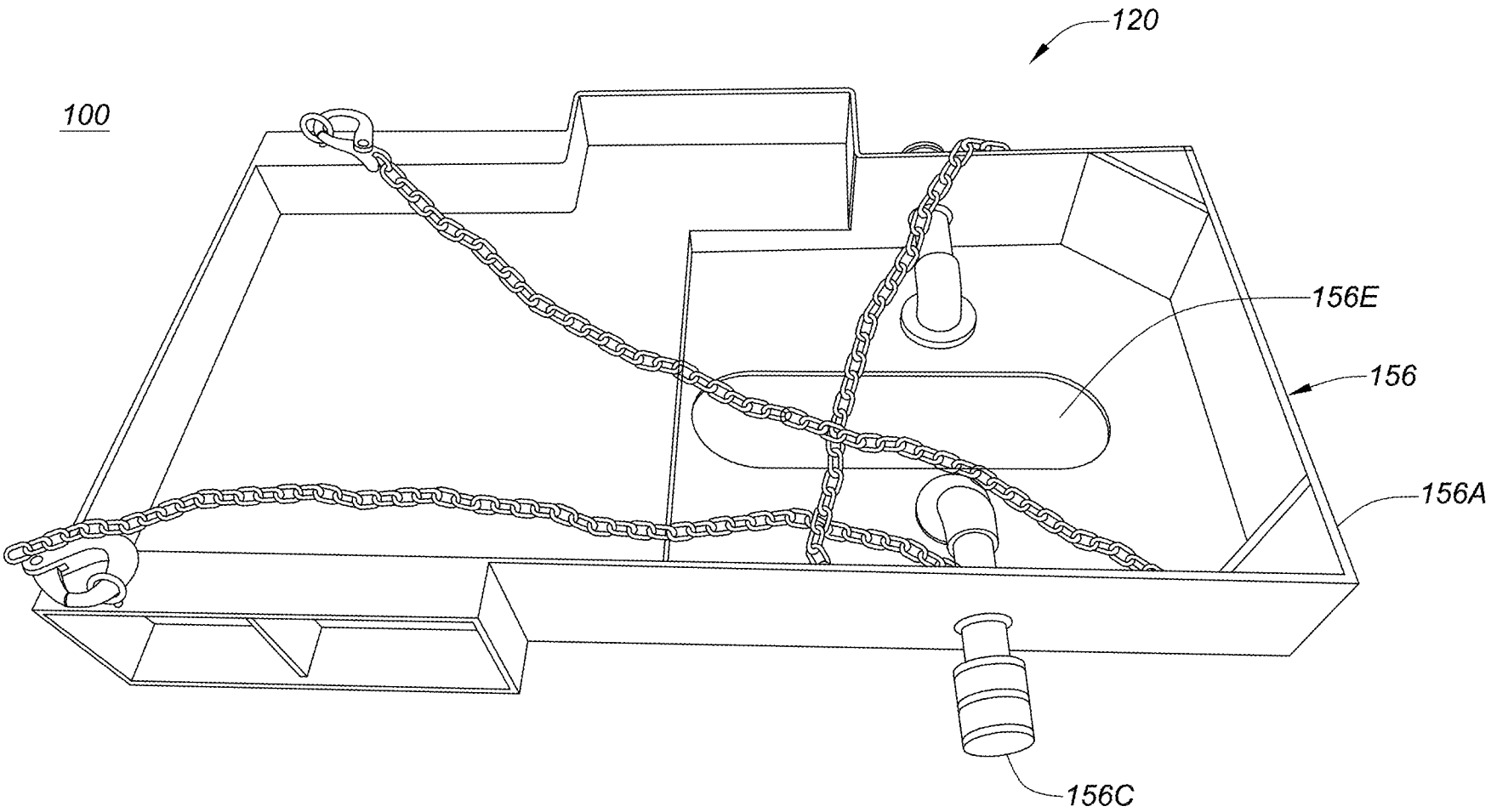
FIGS. 11A-B are detail drawings illustrating an exemplary embodiment of a collar tray system for the surface drilling system of FIG. 1.
Figure 11B:
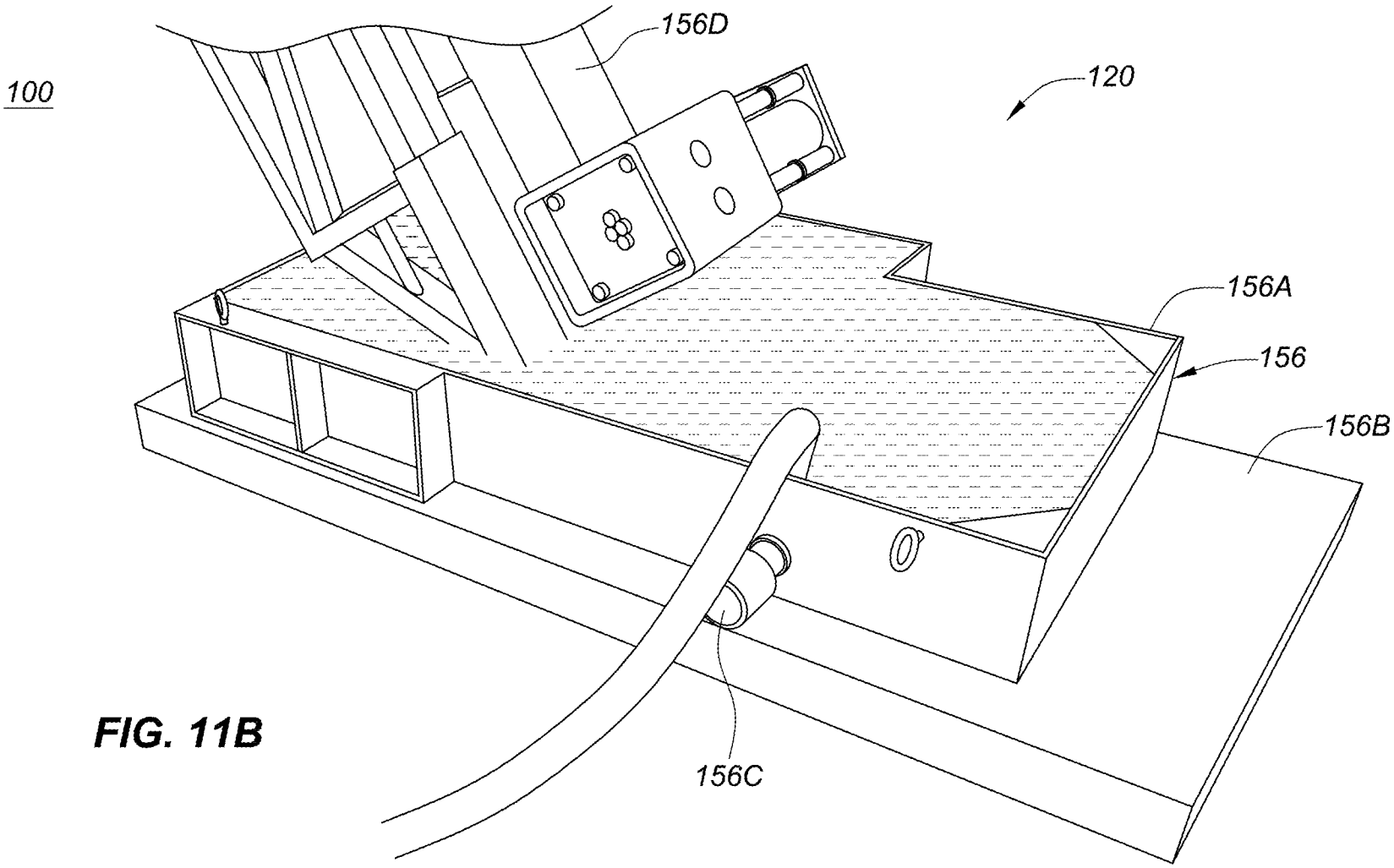
Figure 11C:
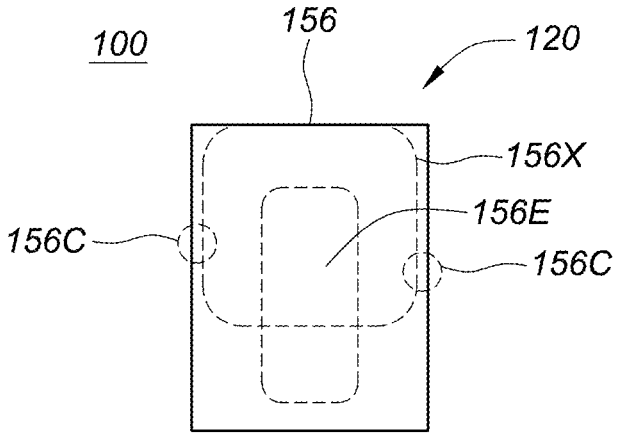
FIG. 11C is a detail drawing illustrating a top view of an exemplary alternative embodiment of the collar tray system of FIGS. 11A-B.
Figure 11D:
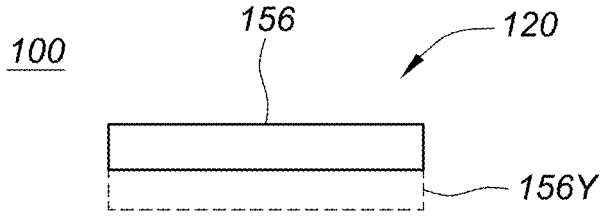
FIG. 11D is a detail drawing illustrating a side view of the collar tray system of FIG. 11C.

An exemplary water skid system 140 is shown in FIGS. 2 and 10. The water skid system 140 can store and transport water for use in drilling operations. In operation, the water skid system 140 can provide water to one or more drill rig support systems 120 for supporting the drill rig system 110. The water skid system 140, for example, can provide water to the mud tank system 157.

As shown, the water skid system 140 can include, but is not limited to, at least one water tank system 140A, a water pump system, an onboard water pump standpipe system 140B, and/or assorted valves, pipes and/or hoses. The onboard water pump standpipe system 140B and water pump system advantageously can enable the water skid system 140 receive water from an external source and/or provide water to an external destination; whereas, the independent water skid system 140 can store and/or transport a larger volume of water than conventional single-use, specialized water trucks. The large water capacity of the water skid system 140 thereby can require fewer water trips and/or reduce operational downtime associated with water-related issues.

The valves can allow for two-way flow for filling and emptying the water tank system 140A through the same pipework. In selected embodiments, the water skid system 140 can include a standardized shipping container, such as a standard twenty-foot shipping container with corner fittings for a twist-locking mechanism. The standardized shipping container advantageously can be configured to quick mounting with a truck or other towing vehicle (not shown). The water skid system 140 can be mounted with the towing vehicle and/or dismounted from the towing vehicle at any time. Unlike conventional single-use, specialized water trucks, the towing vehicle can be utilized for multiple purposes in support of the surface drilling system 100. The water skid system 140 likewise can be less expensive and/or quicker to build than a conventional single-use, specialized water truck and/or can need less maintenance.

As shown in FIG. 2, the surface drilling system 100 can include an optional suction hose strainer filter system (or means) 150. The suction hose strainer filter system 150 can be coupled with a suction hose 150A of the surface drilling system 100. In operation, the suction hose strainer filter system 150 can be configured for helping to prevent any large hard objects from entering the suction line 150A.

The surface drilling system 100 is illustrated as including a water distribution box system (or means) 151. The water distribution box system 151 can comprise a box or other system with pipe connections and valves for controlling water distribution at the surface drilling system 100. Stated somewhat differently, the water distribution box system 151 can include, but is not limited to, one or more pipes, one or more valves and/or one or more connection fittings. In operation, the water distribution box system 151 can couple with the onboard triplex pump system 171, the inner tube pump out attachment system 152 and/or the water swivel system 154 of the surface drilling system 100, without limitation.

Additionally and/or alternatively, the inner tube pump out attachment system 152 of the surface drilling system 100 can comprise a hose attention that can screw onto or otherwise couple with a selected inner tube 122C. The inner tube pump out attachment system 152 can couple with the water distribution box system 151 and/or can help flush drill core material from the selected inner tube 122C. The water distribution box system 151 and the inner tube pump out attachment system 152 can be coupled in any suitable manner, such as via a hose.

The hopper system 153 illustrated in FIG. 2 can be utilized for mixing one or more mud additives with water. In selected embodiments, the hopper system 153 can include, but is not limited to, one or more pipes, one or more funnels, one or more valves and/or one or more hose fittings. The hopper system 153 with or without a funnel, in operation, can create a jet of water for mixing the mud additives with the water. The hopper system 153, for example, can be disposed on the mud tank system 157 and/or can be coupled with the water distribution box system 151. The water distribution box system 151 and the hopper system 153 can be coupled in any suitable manner, such as via a hose.

The water swivel system 154 can be configured for sending or otherwise providing water into an interior region of the drill rods 121A. In selected embodiments, the water swivel system 154 can include, but is not limited to, at least one rotating joint, at least one hose fitting, at least one lifting lug and/or at least one rod thread. The water swivel system 154, for example, can be configured to couple with the water distribution box system 151, a selected drill rod 121A and/or the drill rig winch system. The water swivel system 154 thereby can screw onto or otherwise couple with the selected drill rod 121A; whereas, the drill rig winch system can lift the selected drill rod 121A. When coupled with a hose, the water swivel system 154 and provide water to an interior region of a drill string.

A drill bit 155 of the surface drilling system 100 can couple with a selected drill rod 121A and can be configured to cut and/or grind rock within the ground at the predetermined drill site 200. The surface drilling system 100 thereby can make the drillhole.

In selected embodiments, the collar tray system 156 can be placed around a drill collar 156D of the drill rig system 110 as shown in FIGS. 2 and 11A-D. The collar tray system 156 can include, but is not limited to, a collar tray 156A, the collar tray support system 156B, one or more suction inlets for drilling fluid, at least one external outlet 156C and/or one or more lifting lugs (not shown). The lifting lugs can enable the collar tray system 156 to be readily lifted, such as via the crane system 160A. The suction inlets preferably are disposed on both sides of the collar tray system 156 for flexibility of operation; whereas, the external outlet 156C can enable the collar tray system 156 to couple with the diaphragm pump system 174. The collar tray system 156 can couple with the diaphragm pump system 174 directly and/or indirectly, such as via a hose.

In selected embodiments, the collar tray support system 156B can comprise a wooden support 156X and/or foam insert 156Y for sealing the collar tray 156A with the collar tray 156A with the ground at the drill site 200, and/or an elongated hole 156E can be formed in collar tray 156A for accommodating the rod string. The elongated hole 156E can enable the collar tray system 156 to support a wide range of drilling angles. Exemplary supported angles of drilling can include, but are not limited to, drilling angles between thirty degrees and ninety degrees.

The collar tray system 156 advantageously can help seal the collar tray 156A with the ground, collect the drilling return water and/or ensure that the return water is pumped into the mud tank system 157 before drill cuttings settle. The collar tray support system 156B likewise can provide a dampening effect for reducing overall vibration of the drill rig mast system 112. Additionally and/or alternatively, the collar tray system 156 can help eliminate any ground disturbance at the drill site 200. When placed on uneven ground, the collar tray support system 156B can provide a good ground seal under the drill rig mast system 112. The collar tray system 156 thereby can avoid a need of conventional exploration diamond drilling equipment to dig holes in the ground for collecting return drill fluid or to dig canals in the ground for diverting the return drill fluid.

The collar tray system 156 likewise can have a fast setup time and/or can be loaded and offloaded at any time. The collar tray system 156, for example, can be suitable for drill sites 200 in which soil profile is absent and/or hard rocks are exposed at the surface making hole digging very difficult. In selected embodiments, the collar tray system 156 can be coupled with the diaphragm pump system 174 for faster and constant suction regardless of the level of fluids in the collar tray 156A. When connected to constantly-running diaphragm pump system 174, the collar tray system 156 can be installed without a need to stop drilling operations. The collar tray preferably is properly aligned with the drill rig mast system 112 and/or the drill rig deck system 115 during operation.

Figure 12A:
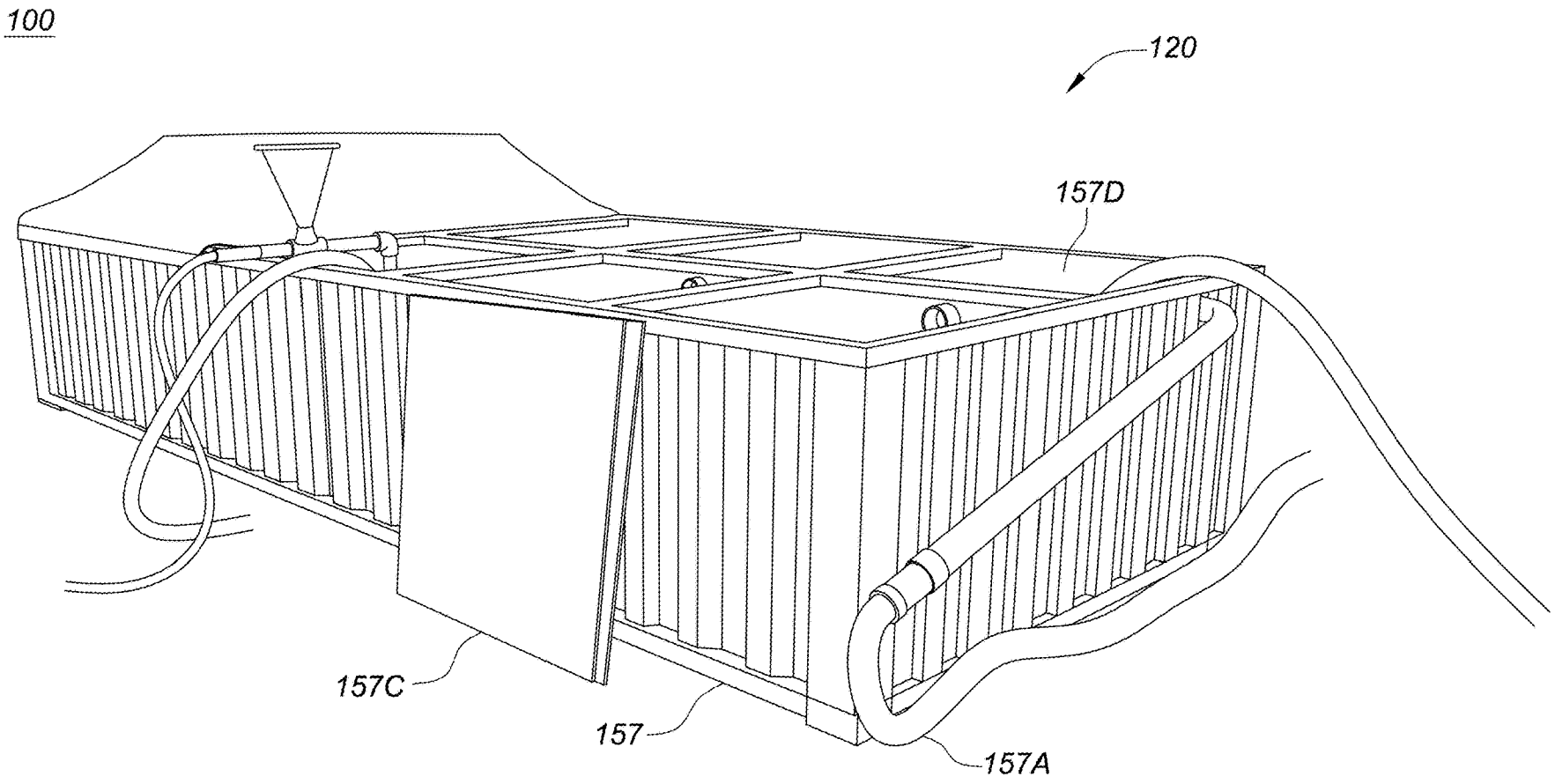
FIGS. 12A-F are detail drawings illustrating an exemplary embodiment of a mud tank system for the surface drilling system of FIG. 1.
Figure 12B:
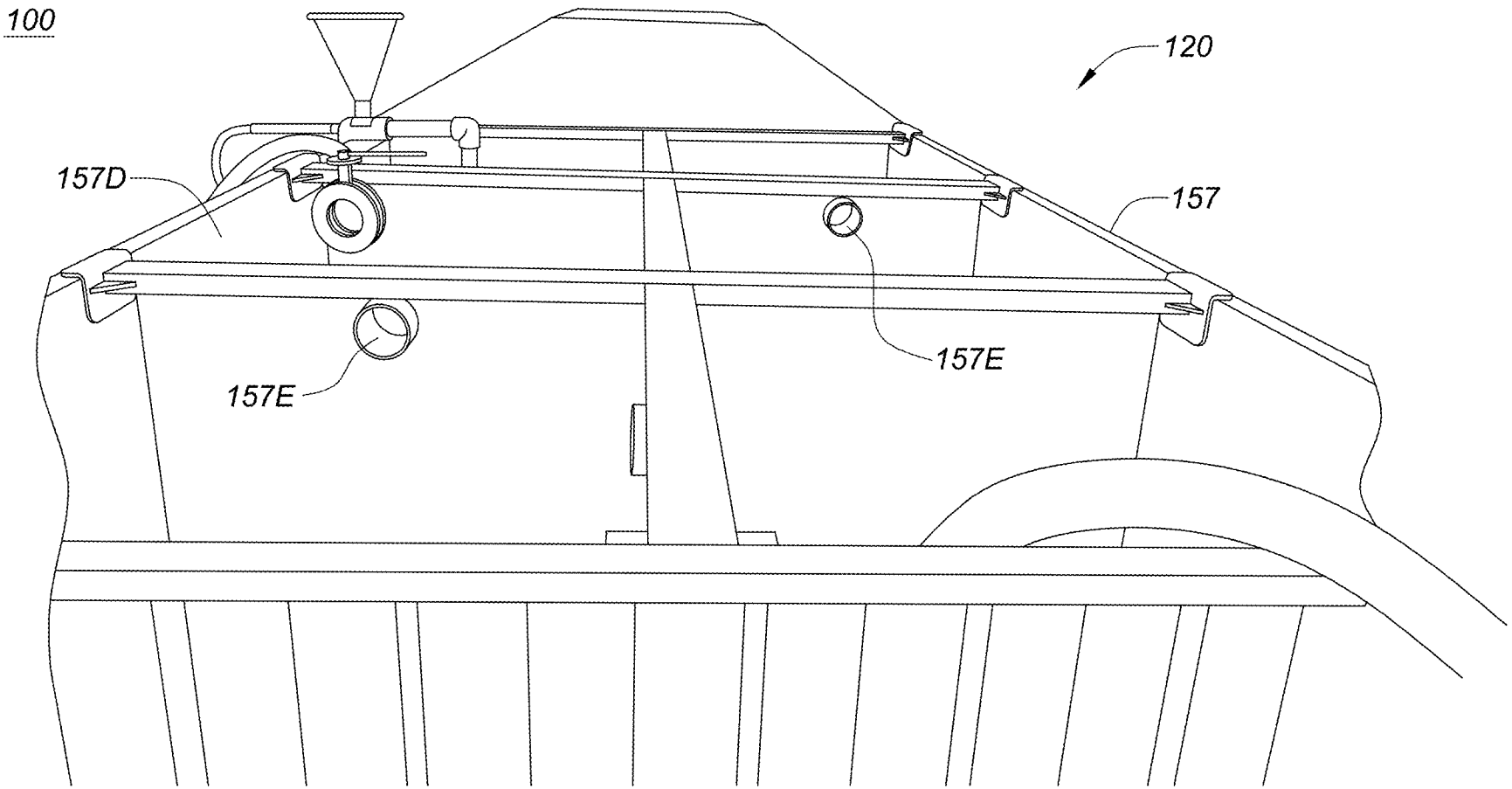
Figure 12C:
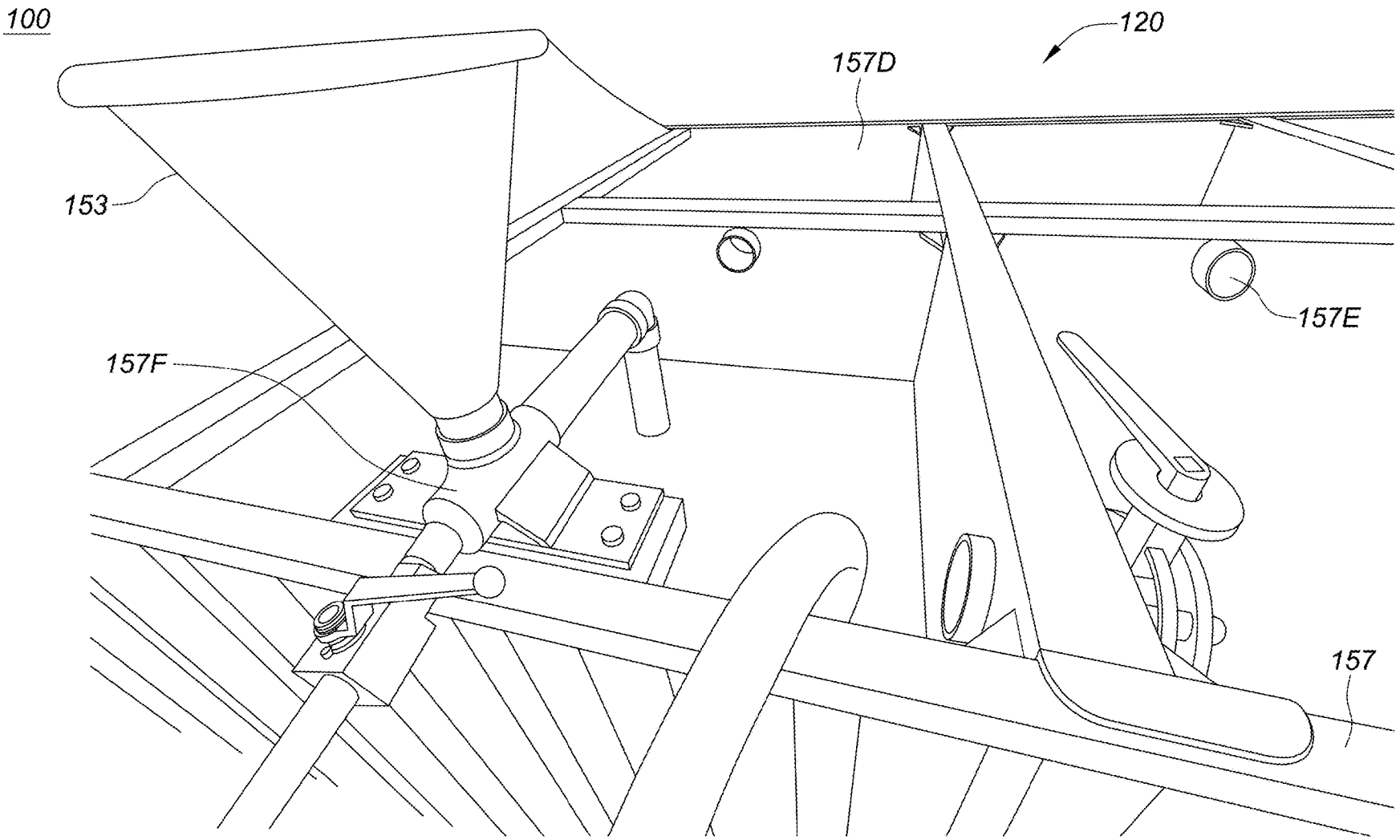
Figure 12D:
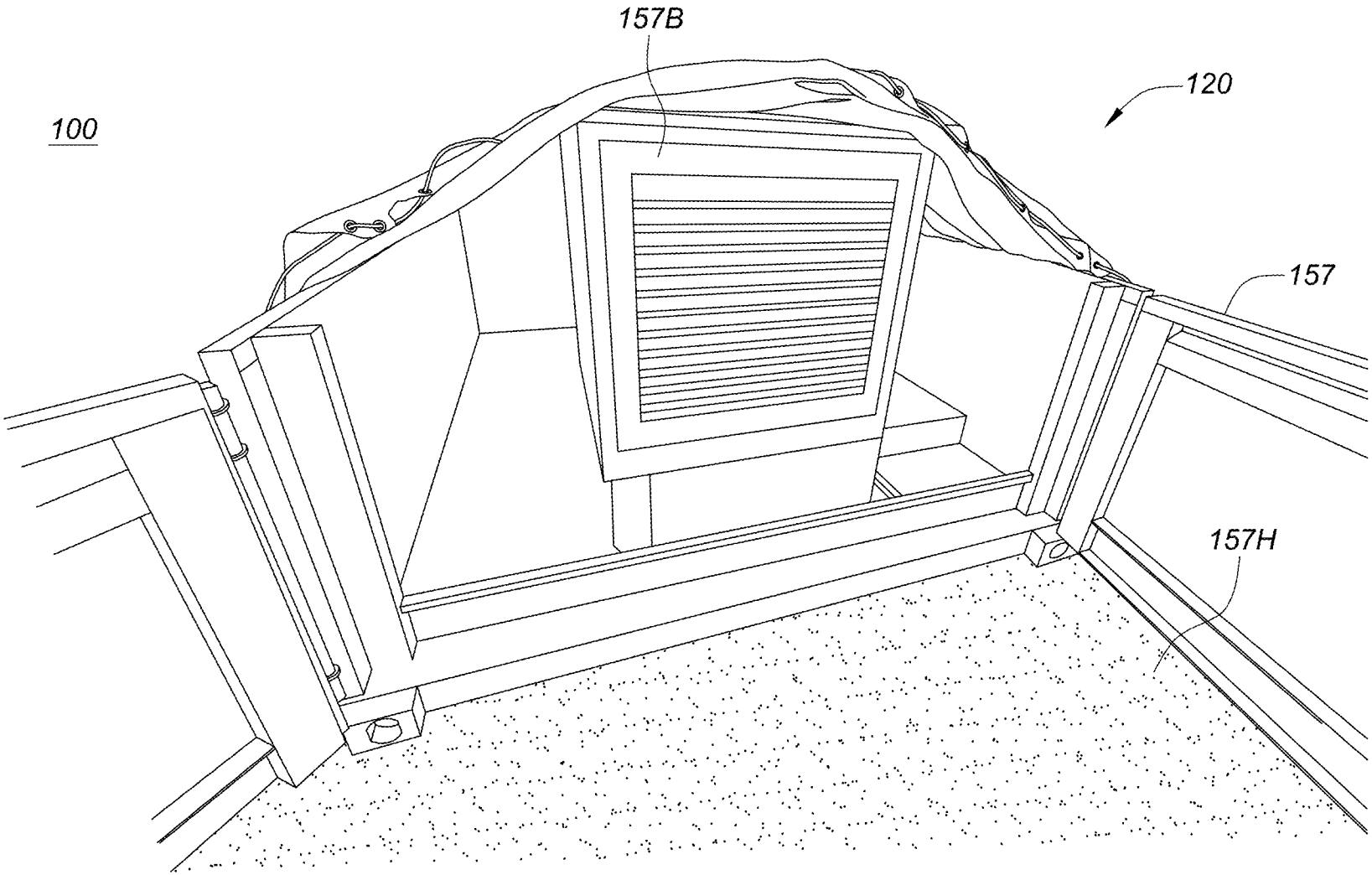
Figure 12E:
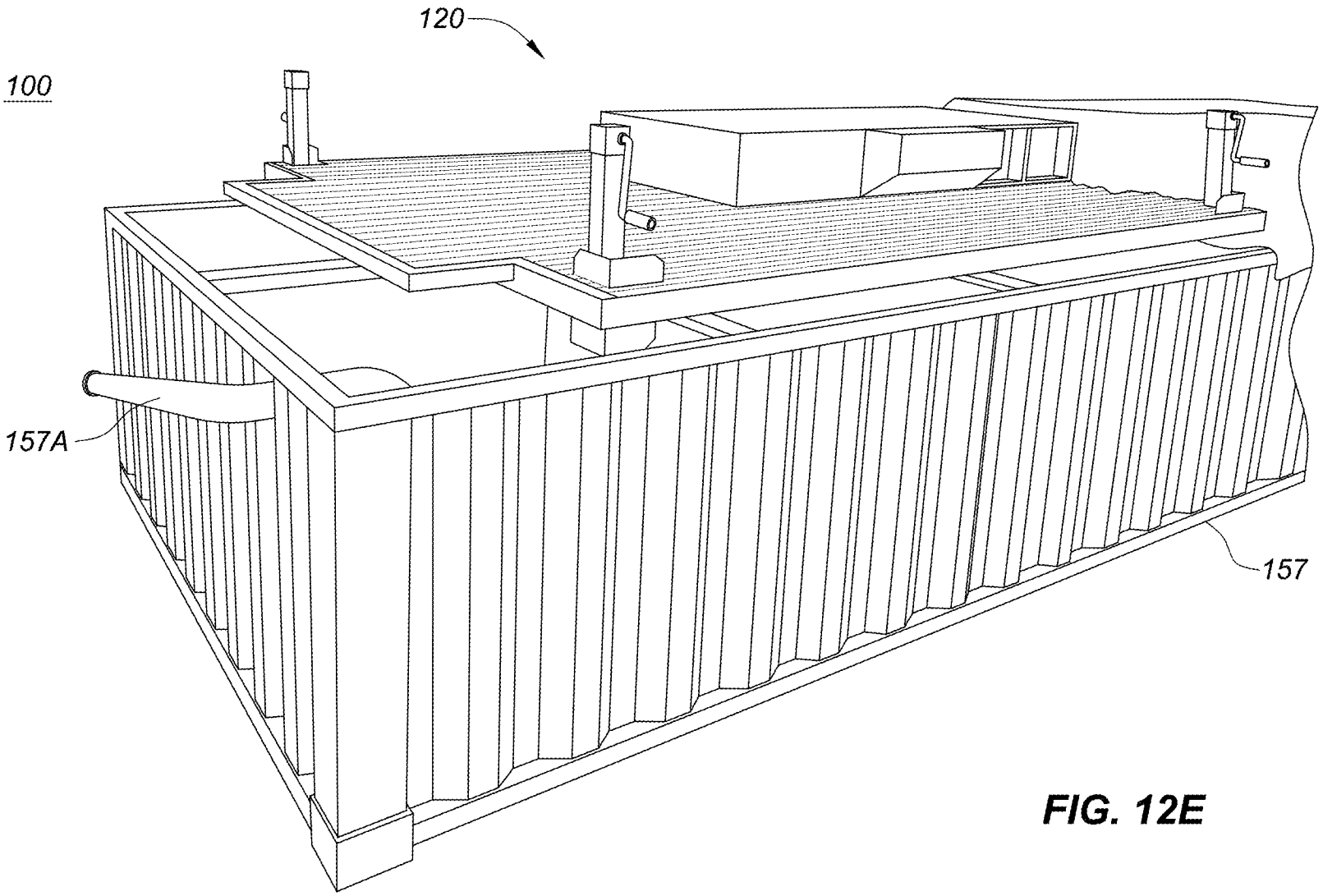

An exemplary embodiment of the mud tank system 157 is shown in FIGS. 2 and 12A-F. The mud tank system 157 can comprise a container system for mixing and/or cleaning drilling fluid (or mud) and, in selected embodiments, transport of related equipment. In selected embodiments, the mud tank system 157 can be provided as a fully-enclosed mud tank system. The mud tank system 157, for example, can clean the drilling fluid (and associated water) by circulating the drilling fluid through a plurality of holding cells 157D defined by the mud tank system 157. As shown in FIG. 12B-C, the holding cells 157D can be coupled via one or more valves and/or overflows 157E for facilitating the circulation of the drilling fluid between adjacent holding cells 157D. In selected embodiments, one or more the holding cells 157D can have at least one bag (not shown) inserted in the holding cell 157D to collect the settling sediment and drill cuttings. The bags, for example, can be secured to the crane system 160A for further possible dewatering, transport and/or disposal.

Figure 24:
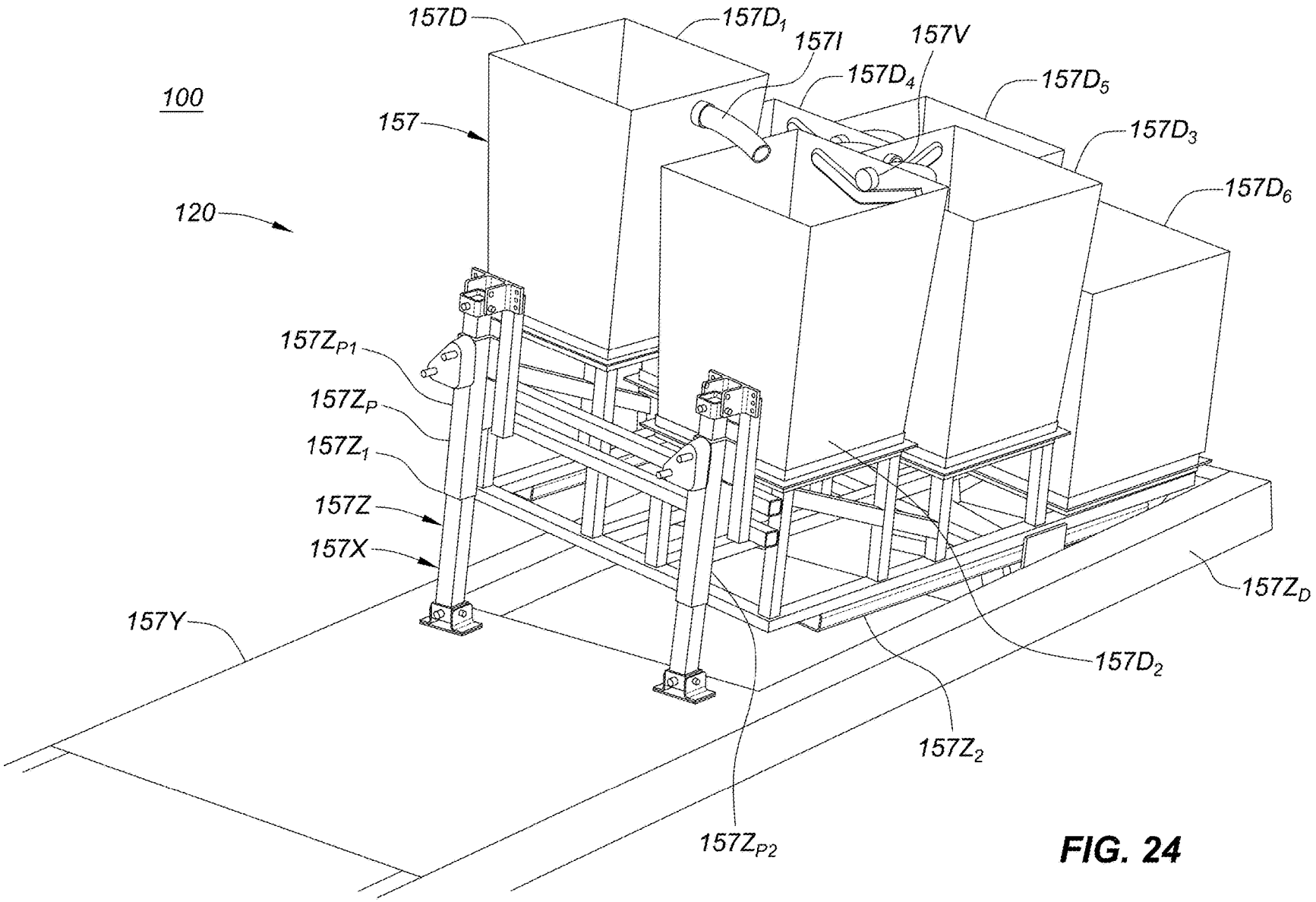
FIG. 24 is a detail drawing illustrating another exemplary alternative embodiment of the mud tank system of FIGS. 12A-F, wherein the mud tank system includes a leveling system.

Turning to FIG. 24, the mud tank system 157 is shown as including an optional leveling system (or means) 157X. The leveling system 157X advantageously can permit the mud tank system 157 to be set up on an uneven installation surface at the drill site 200. As illustrated in FIG. 24, the leveling system 157X can comprise a base system 157Y for engaging the installation surface and a universal leveling mechanism 157Z disposed between the base system 157Y and the holding cells 157D. The leveling system 157X thereby can organize the holding cells 157D, such as in a parallel configuration and/or a cascading configuration, for improving or otherwise facilitating fluid flow among the holding cells 157D.

The leveling mechanism 157Z of FIG. 24 is illustrated as including a mud tank elevation system 157$Z_1$ and a mud tank support framework system 157$Z_2$. The mud tank support framework system 157$Z_2$ can organize the holding cells 157D in any suitable manner, such as in at least one row and/or in at least one column. As shown in FIG. 24, for example, the mud tank support framework system 157$Z_2$ can organize the holding cells 157D in a first row with holding cell 157$D_1$ and holding cell 157$D_2$, in a second row with holding cell 157$D_3$ and holding cell 157$D_4$, and/or in a third row with holding cell 157$D_5$ and holding cell 157$D_6$. Additionally and/or alternatively, the holding cells 157D can be organized in a first column with the holding cell 157$D_1$, the holding cell 157$D_4$ and the holding cell 157$D_5$ and in a second column with the holding cell 157$D_2$, the holding cell 157$D_3$ and the holding cell 157$D_6$.

The mud tank support framework system 157$Z_2$ is shown in FIG. 24 as comprising a rectangular framework system with proximal and distal end regions 157$Z_P$, 157$Z_D$. If the distal end region 157$Z_D$ of the mud tank support framework system 157$Z_2$ is rotatably coupled with (or otherwise rotatable relative to) the base system 157Y, the mud tank elevation system 157$Z_1$ can be coupled with the proximal end region 157$Z_P$ of the mud tank support framework system 157$Z_2$. The mud tank elevation system 157$Z_1$ thereby can be configured to elevate the proximal end region 157$Z_P$ of the mud tank support framework system 157$Z_2$ and the associated holding cells 157D relative to the holding cells 157D associated with the distal end region 157$Z_D$ of the mud tank support framework system 157$Z_2$.

In selected embodiments, the mud tank elevation system 157$Z_1$ can comprise one or more jack systems (or means), such as standard semi-trailer mechanical jacks. The jack systems can be distributed about the mud tank support framework system 157$Z_2$. Additionally and/or alternatively, the mud tank support framework system 157$Z_2$ can include at least one shaft, at least one joint and/or at least one or more hinge.

The mud tank elevation system 157$Z_1$, for example, can include first and second mud tank elevation systems 157$Z_1$. The first mud tank elevation system 157$Z_1$, for example, can be coupled with and otherwise configured to elevate a first corner region of the mud tank support framework system 157$Z_2$ that is associated with a first holding cell 157$D_1$; whereas, the second mud tank elevation system 157$Z_1$ can be coupled with and otherwise configured to elevate a second corner region of the mud tank support framework system 157$Z_2$ that is associated with a second holding cell 157$D_2$. The mud tank elevation system 157$Z_1$ thereby can be configured to elevate the first holding cell 157D1 relative to the second holding cell 157$D_2$ and vice versa. The leveling system 157X thereby can elevate one or more selected holding cells 157D relative to one or more other holding cells 157D to level the mud tank system 157 for use at the uneven installation surface at the drill site 200. As desired, one or more valves 157V disposed between adjacent holding cells 157D optionally can include a hose 1457I or other mechanism for facilitating circulation of return drilling fluid and other liquids when the adjacent holding cells 157D are disposed at different elevations.

In selected embodiments, the mud tank system 157 can support multiple operation modes. The different operation modes can enable the mud tank system 157 to use a different group of holding cells 157D for cleaning the drilling fluid. A first exemplary operation mode can use a first number of holding cells 157D for cleaning the drilling fluid. In contrast, a second exemplary operation mode can use a second number of holding cells 157D for cleaning the drilling fluid, wherein the second number of holding cells 157D is greater than the first number of holding cells 157D. The mud tank system 157 thereby can support enhanced drilling fluid cleaning capabilities.

Figure 12F:
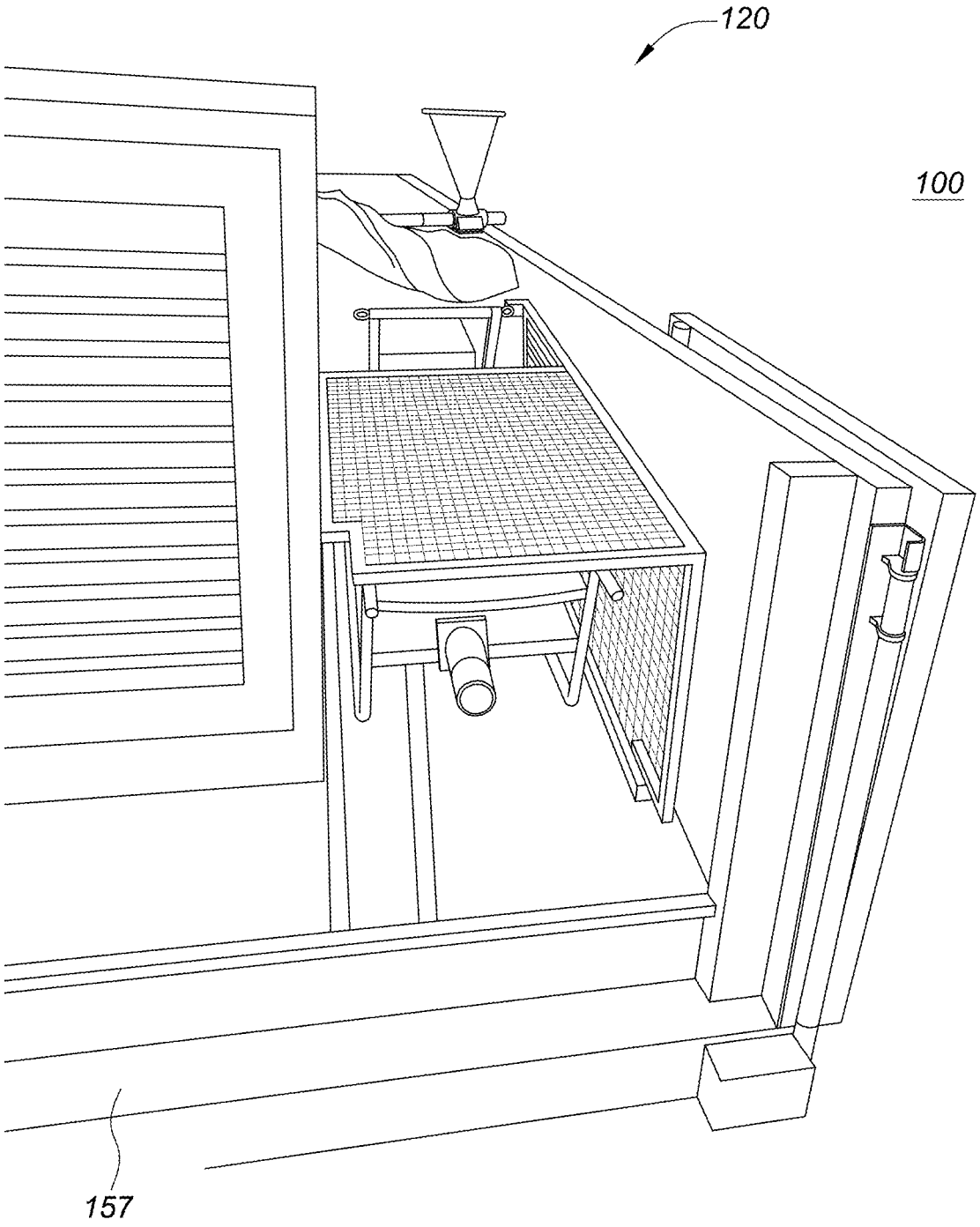

The mud tank system 157 optionally can provide mounting places for selected equipment associated with the surface drilling system 100 during operation and/or provide space for storing selected equipment associated with the surface drilling system 100 during transport as illustrated in FIG. 12F. In selected embodiments, the mud tank system 157 can be provided as a standardized container system, such as a standard twenty-foot shipping container with corner fittings for a twist-locking mechanism. The size of the standardized container system can help facilitate and accelerate storing the selected equipment associated with the surface drilling system 100 during transport. Use of the standardized container system likewise can facilitate transport of the mud tank system 157 via a truck or other tow vehicle 161 and reduce manufacturing costs for the mud tank system 157.

Figure 23A:
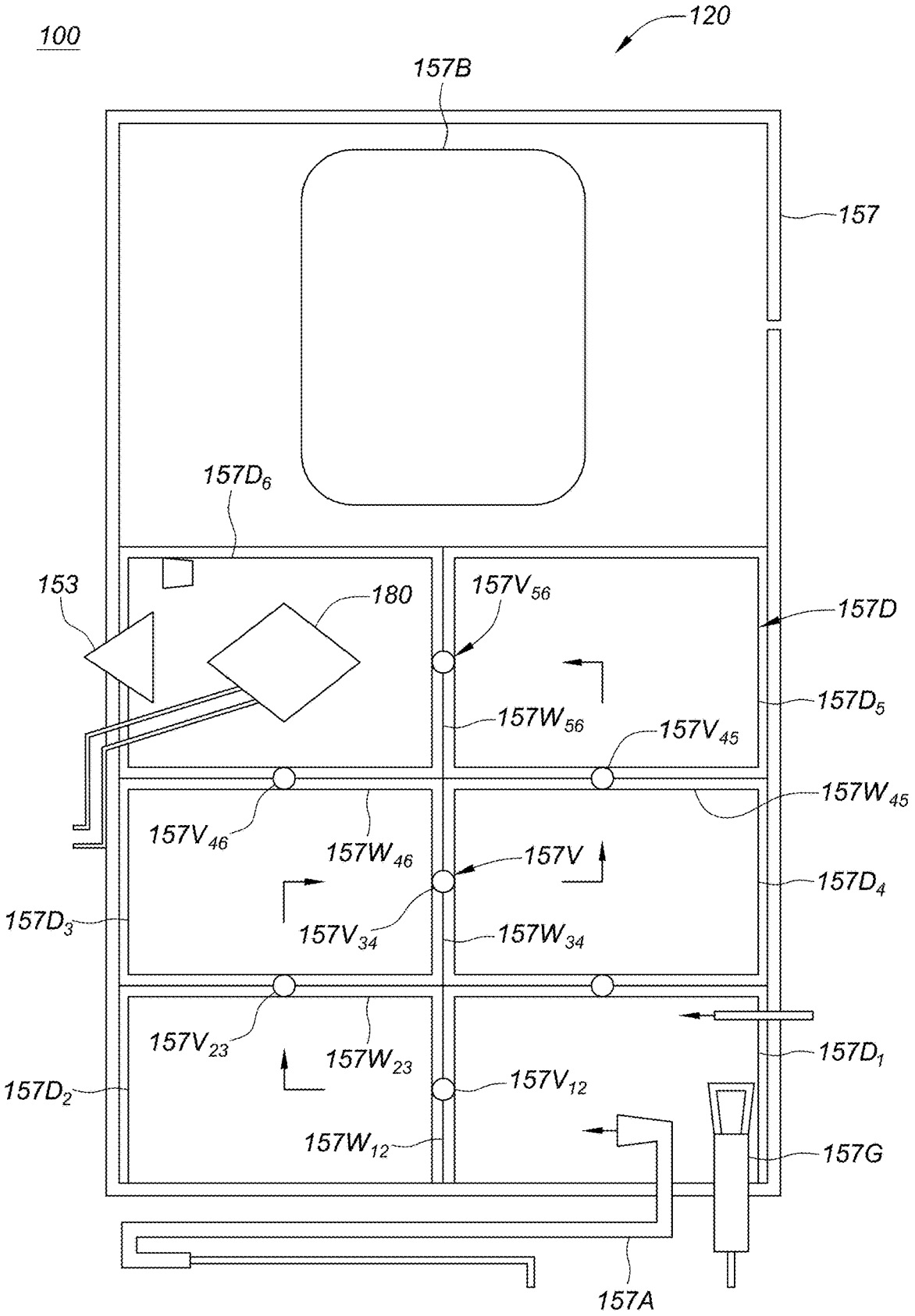
FIG. 23A is a detail drawing illustrating an exemplary alternative embodiment of the mud tank system of FIGS. 12A-F, wherein each holding cell of the mud tank system is utilized for cleaning return drilling fluid and water during operation.
Figure 23B:
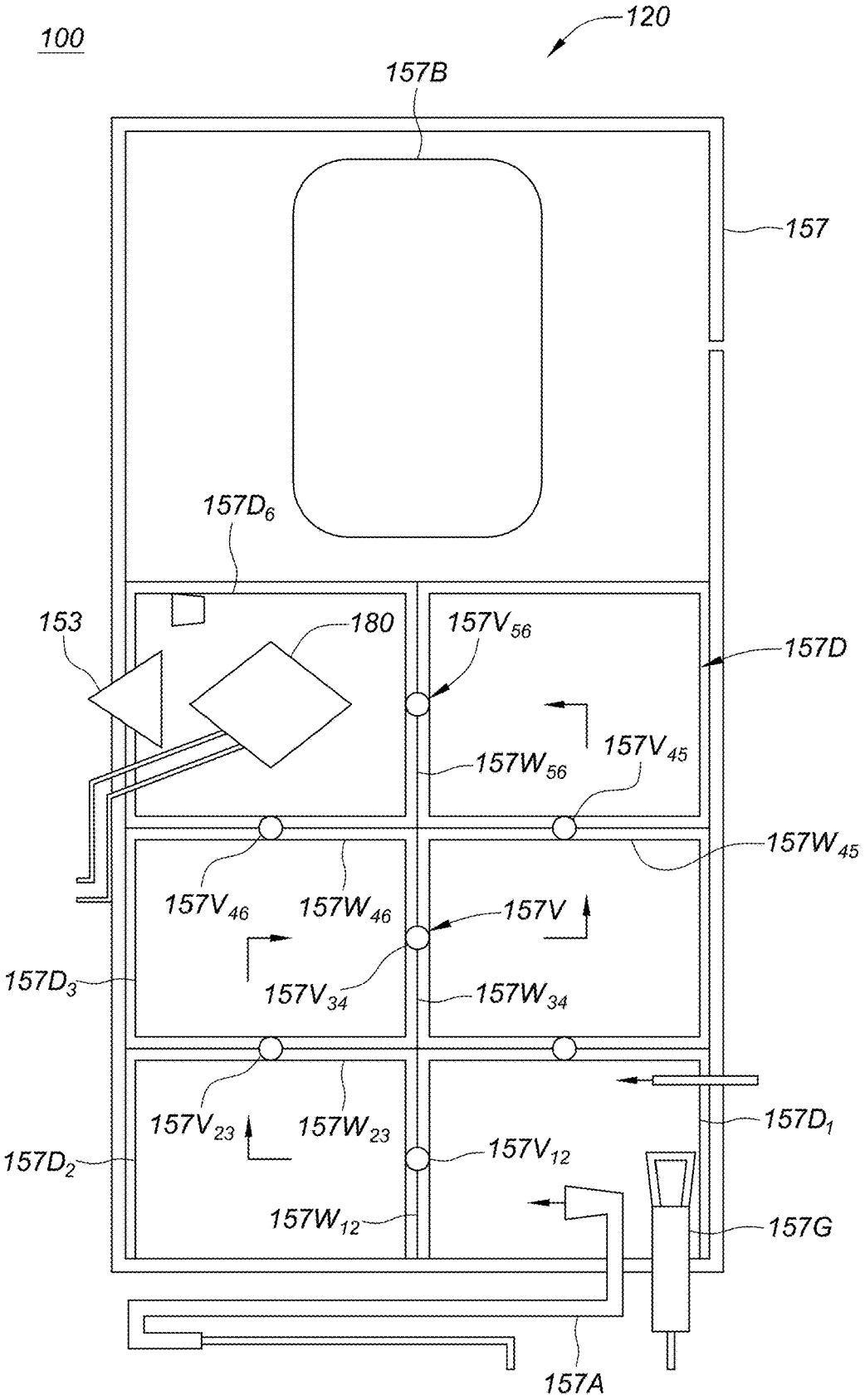
FIG. 23B is a detail drawing illustrating an exemplary alternative embodiment of the mud tank system of FIG. 23A, wherein a subset of the holding cells of the mud tank system is utilized for cleaning the return drilling fluid and water during operation.

The mud tank system 157 can comprise, but is not limited to, the holding cells 157D, the overflows 157E for coupling the holding cells 157D, one or more (overflow) valves 157V (shown in FIGS. 23-24) for opening and/or closing the overflows 157E, a cell lid 157C for each of the holding cells 157D, at least one mounting device 157F for mounting the hopper system 153 on the mud tank system 157, at least one pipe 157A for accepting return drilling fluid and water from the collar tray 156A as it is pumped by the diaphragm pump system 174 and/or an outlet (not shown) for enabling the return drilling fluid and water to enter a selected initial holding cell 157$D_1$ (shown in FIGS. 23A-B). The selected initial holding cell 157$D_1$, for example, can be designated for receiving the dirtiest return drilling fluid and water. Additionally and/or alternatively, the agitator system 180 and/or a water suction hose can be associated with a selected final holding cell 157$D_6$ (shown in FIGS. 23A-B), which can be designated for receiving the cleanest return drilling fluid and water.

In selected embodiments, each holding cell 157D of the mud tank system 157 can be utilized for cleaning return drilling fluid and water during operation. The mud tank system 157 of FIG. 23A is shown as having a plurality of holding cells 157. The holding cells 157 can include the initial holding cell 157$D_1$, the final holding cell 157$D_6$ and intermediate holding cells 157$D_2$, 157$D_3$, 157$D_4$, 157$D_4$ being operationally disposed between the initial holding cell 157$D_1$ and the final holding cell 157$D_6$ of the mud tank system 157.

Turning to FIGS. 2 and 23A, the triplex pump system 171, for example, can draw return drilling fluid and water from the final holding cell 157$D_6$, which can hold the cleanest return drilling fluid and water available from the mud tank system 157. The triplex pump system 171 can be configured to pump the return drilling fluid and water from the final holding cell 157$D_6$ of the mud tank system 157 to the water distribution box system 151. The water distribution box system 151, in turn, can provide the pumped return drilling fluid and water into the interior region of the drill rods 121A (shown in FIG. 4). The water distribution box system 151 can provide the pumped return drilling fluid and water to the drill rods 121A either directly or indirectly via one or more intermediate systems, such as the water swivel system 154.

The pumped return drilling fluid and water can flow through the interior region of the drill rods 121A until the drill bit 155 is reached. The return drilling fluid and water can reach a leading face (not shown) of the drillhole, pick up drill cuttings and travel through an annulus formed between the drill rods 121A and walls defining a perimeter of the drillhole until reaching the surface of the drill site 200. Upon reaching the surface of the drill site 200, the return drilling fluid and water can overflow into the collar tray system 156. The overflowed return drilling fluid and water can be provided to the initial holding cell 157$D_1$ of the mud tank system 157. The overflowed return drilling fluid and water, for example, can be pumped into the initial holding cell 157$D_1$ via the diaphragm pump system 174. The diaphragm pump system 174 preferably pumps the overflowed return drilling fluid and water into the initial holding cell 157$D_1$ in a rapid manner and before the picked-up drill cuttings settle.

The overflowed return drilling fluid and water disposed in the initial holding cell 157$D_1$ can circulate to a second intermediate holding cell 157$D_2$ of the mud tank system 157 via a first valve 157$V_{12}$ coupling the initial holding cell 157$D_1$ and the second intermediate holding cell 157$D_2$. Stated somewhat differently, the initial holding cell 157$D_1$ and the second intermediate holding cell 157$D_2$ can communicate via the first valve 157$V_{12}$. The first valve 157$V_{12}$ can be closed to inhibit communication between the initial holding cell 157$D_1$ and the second intermediate holding cell 157$D_2$ and/or can be opened to enable communication between the initial holding cell 157$D_1$ and the second intermediate holding cell 157$D_2$. The opened first valve 157$V_{12}$ can be disposed in an upper portion of a wall or other barrier 157$W_{12}$ separating the initial holding cell 157$D_1$ and the second intermediate holding cell 157$D_2$ and/or can permit the overflowed return drilling fluid and water to flow from the initial holding cell 157$D_1$ to the second intermediate holding cell 157$D_2$.

The return drilling fluid and water disposed in the second intermediate holding cell 157$D_2$ can circulate to a third intermediate holding cell 157$D_3$ of the mud tank system 157 via a second valve 157$V_{23}$ coupling the second intermediate holding cell 157$D_2$ and the third intermediate holding cell 157$D_3$. Stated somewhat differently, the second intermediate holding cell 157$D_2$ and the third intermediate holding cell 157$D_3$ can communicate via the second valve 157$V_{23}$. The second valve 157$V_{23}$ can be closed to inhibit communication between the second intermediate holding cell 157$D_2$ and the third intermediate holding cell 157$D_3$ and/or can be opened to enable communication between the second intermediate holding cell 157$D_2$ and the third intermediate holding cell 157$D_3$. The opened second valve 157$V_{23}$ can be disposed in an upper portion of a wall or other barrier 157$W_{23}$ separating the second intermediate holding cell 157$D_2$ and the third intermediate holding cell 157$D_3$ and/or can permit the overflowed return drilling fluid and water to flow from the second intermediate holding cell 157$D_2$ to the third intermediate holding cell 157$D_3$.

The return drilling fluid and water disposed in the third intermediate holding cell 157$D_3$ can circulate to a fourth intermediate holding cell 157$D_4$ of the mud tank system 157 via a third valve 157$V_{34}$ coupling the third intermediate holding cell 157$D_3$ and the fourth intermediate holding cell 157$D_4$. Stated somewhat differently, the third intermediate holding cell 157$D_3$ and the fourth intermediate holding cell 157$D_4$ can communicate via the third valve 157$V_{34}$. The third valve 157$V_{34}$ can be closed to inhibit communication between the third intermediate holding cell 157$D_3$ and the fourth intermediate holding cell 157$D_4$ and/or can be opened to enable communication between the third intermediate holding cell 157$D_3$ and the fourth intermediate holding cell 157$D_4$.

The opened third valve 157$V_{34}$ can be disposed in an upper portion of a wall or other barrier 157$W_{34}$ separating the third intermediate holding cell 157$D_3$ and the fourth intermediate holding cell 157$D_4$ and/or can permit the overflowed return drilling fluid and water to flow from the third intermediate holding cell 157$D_3$ to the fourth intermediate holding cell 157$D_4$. A sixth valve 157$V_{46}$ can be disposed in an upper portion of a wall or other barrier 157$W_{46}$ separating the third intermediate holding cell 157$D_3$ and the final holding cell 157$D_6$ is shown as being closed in FIG. 23A for inhibiting the overflowed return drilling fluid and water to flow from the third intermediate holding cell 157$D_3$ directly into the final holding cell 157$D_6$.

The return drilling fluid and water disposed in the fourth intermediate holding cell 157$D_4$ can circulate to a fifth intermediate holding cell 157$D_5$ of the mud tank system 157 via a fourth valve 157$V_{45}$ coupling the fourth intermediate holding cell 157$D_4$ and the fifth intermediate holding cell 157$D_5$. Stated somewhat differently, the fourth intermediate holding cell 157$D_4$ and the fifth intermediate holding cell 157$D_5$ can communicate via the fourth valve 157$V_{45}$. The fourth valve 157$V_{45}$ can be closed to inhibit communication between the fourth intermediate holding cell 157$D_4$ and the fifth intermediate holding cell 157$D_5$ and/or can be opened to enable communication between the fourth intermediate holding cell 157$D_4$ and the fifth intermediate holding cell 157$D_5$. The opened fourth valve 157$V_{45}$ can be disposed in an upper portion of a wall or other barrier 157$W_{45}$ separating the fourth intermediate holding cell 157$D_4$ and the fifth intermediate holding cell 157$D_5$ and/or can permit the overflowed return drilling fluid and water to flow from the fourth intermediate holding cell 157$D_4$ to the fifth intermediate holding cell 157$D_5$.

The return drilling fluid and water disposed in the fifth intermediate holding cell 157$D_5$ can circulate to the final holding cell 157$D_6$ of the mud tank system 157 via a fifth valve 157$V_{56}$ coupling the fifth intermediate holding cell 157$D_5$ and the final holding cell 157$D_6$. Stated somewhat differently, the fifth intermediate holding cell 157$D_5$ and the final holding cell 157$D_6$ can communicate via the fifth valve 157$V_{56}$. The fifth valve 157$V_{56}$ can be closed to inhibit communication between the fifth intermediate holding cell 157$D_5$ and the final holding cell 157$D_6$ and/or can be opened to enable communication between the fifth intermediate holding cell 157$D_5$ and the final holding cell 157$D_6$. The opened fifth valve 157$V_{56}$ can be disposed in an upper portion of a wall or other barrier 157$W_{56}$ separating the fifth intermediate holding cell 157$D_5$ and the final holding cell 157$D_6$ and/or can permit the overflowed return drilling fluid and water to flow from the fifth intermediate holding cell 157$D_5$ to the final holding cell 157$D_6$.

The return drilling fluid and water disposed in the initial holding cell 157$D_1$ thereby can circulate through each of the intermediate holding cells 157$D_2$, 157$D_3$, 157$D_4$, 157$D_4$ and ultimately be disposed in the final holding cell 157$D_6$ of the mud tank system 157. Thereby, the return drilling fluid and water disposed in the final holding cell 157$D_6$ can comprise the cleanest return drilling fluid and water available at the mud tank system 157. The agitator system 180 can agitate the cleanest return drilling fluid and water disposed in the final holding cell 157$D_6$ in the manner discussed in more detail herein. The triplex pump system 171 then can draw the cleanest return drilling fluid and water from the final holding cell 157$D_6$ for recirculation throughout the surface drilling system 100 as set forth above.

In selected embodiments, less than all of the holding cells 157D defined by the mud tank system 157 can be utilized for transforming the overflowed return drilling fluid and water disposed in the initial holding cell 157$D_1$ into the cleanest return drilling fluid and water available from the final holding cell 157$D_6$. Turning to FIGS. 2 and 23A, for example, the third valve 157$V_{34}$ and the fifth valve 157$V_{56}$ are illustrated as being closed; whereas, the sixth valve 157$V_{46}$ is shown as being open.

The return drilling fluid and water disposed in the third intermediate holding cell 157$D_3$ thereby can circulate directly to the final holding cell 157$D_6$ of the mud tank system 157 via the sixth valve 157$V_{46}$ coupling the third intermediate holding cell 157$D_3$ and the final holding cell 157$D_6$. Stated somewhat differently, the third intermediate holding cell 157$D_3$ and the final holding cell 157$D_6$ can communicate via the sixth valve 157$V_{46}$. The sixth valve 157$V_{46}$ can be closed to inhibit communication between the third intermediate holding cell 157$D_3$ and the final holding cell 157$D_6$ and/or can be opened to enable communication between the third intermediate holding cell 157$D_3$ and the final holding cell 157$D_6$. As shown in FIG. 23B, the sixth valve 157$V_{46}$ is opened to permit the return drilling fluid and water to flow from the third intermediate holding cell 157$D_3$ to the final holding cell 157$D_6$.

The return drilling fluid and water disposed in the initial holding cell 157$D_1$ thereby can circulate through a subset of intermediate holding cells 157$D_2$, 157$D_3$ and ultimately be disposed in the final holding cell 157$D_6$ of the mud tank system 157. Thereby, the return drilling fluid and water disposed in the final holding cell 157$D_6$ can comprise the cleanest return drilling fluid and water available at the mud tank system 157. The agitator system 180 can agitate the cleanest return drilling fluid and water disposed in the final holding cell 157$D_6$ in the manner discussed in more detail herein. The triplex pump system 171 then can draw the cleanest return drilling fluid and water from the final holding cell 157$D_6$ for recirculation throughout the surface drilling system 100 as set forth above.

As set forth above, the return drilling fluid and water advantageously is collected from within the drillhole and not, for example, at the collar tray system 156. A large proportion of the drill cuttings thereby are inhibited from setting and thus requiring manual shoveling and/or intermittent pumping. If the mud tank system 157 comprises a ground mud tank system, the return drilling fluid and water likewise can naturally flow into the mud tank system 157 where drill cuttings can settle and/or a portion of the cuttings and drilling fluid may dissipate into the ground. Furthermore, conventional mud tank systems typically include a smaller number of holding cells than the mud tank system 157 due to difficulty of precision groundworks. The smaller number of holding cells in the conventional mud tank systems can result in less filtration than the mud tank system 157. Although shown and described with reference to FIGS. 23A-B as comprising six holding cells 157 for purposes of illustration only, the mud tank system 157 can comprise any suitable number of holding cells 157, without limitation.

The mud tank system 157 advantageously can offer reduced environmental impact. In selected embodiments, the mud tank system 157 can operate without utilizing groundworks. The mud tank system 157 likewise can reduce risk of cross-contamination of the return drilling fluid, cuttings and water with the outside environment of the drill site 200. Returning to FIGS. 2 and 12A-F, by covering the holding cells 157D with the cell lids 157C, risk of evaporation of the return drilling fluid and water within the holding cells 157D and risk of animals drowning in, or being poisoned by, the return drilling fluid and water also are reduced.

The mud tank system 157 optionally can define one or more hoppers 157H and/or one or more storage cells (not shown) for storing at least one air compressor system 157B and/or other equipment associated with the surface drilling system 100. Exemplary equipment that can be stored in the storage cells can include the vacuum pump system 173, suction attachment 157G for the vacuum pump system 173, the diaphragm pump system 174, the agitator system 180 with its hydraulic hoses, the inner tube and core processing system 123, the collar tray system 156, the collar tray support system 156B, the drill rig deck system 115, the cell lids 157C, one or more air hoses (not shown), one or more water hoses (not shown), a watertight bunding 158A, a muds and oils storage bunding 162, one or more bulk bag systems (or means) 158C and/or a safety cage spin system (or means) 164, without limitation. The drill rig deck system 115, for example, can be placed on top of the mud tank system 157 with the deck jack legs of the drill rig deck system 115 being received by the holding cells 157D and the collar tray system 156 can be placed on top of the drill rig deck system 115 and the mud tank system 157 and secured with one or more straps (not shown).

Advantageously, use of the mud tank system 157 can avoid a need of conventional exploration diamond drilling equipment to dig holes in the ground for collecting return drill fluid or to dig canals in the ground for diverting the return drill fluid. The surface drilling system 100 with the mud tank system 157 thereby can be faster to set up than conventional exploration diamond drilling equipment. Additionally and/or alternatively, operation of the surface drilling system 100 can be streamlined by removing a need for groundworks contractors. When integrated with the air compressor system 157B, the vacuum pump system 173, the muds and oils storage bunding 162, the water pump standpipe system 140B, the vacuum pump standpipe system 158B, the bulk bag systems 158C and other related equipment, the surface drilling system 100 with the mud tank system 157 likewise can enable full drill waste management and disposal and support drilling operations with smaller and larger amounts of water.

The mud tank system 157 can be cleaned in any suitable manner. Each holding cell 157D can be cleaned by way of being fitted with a removable waste bag, which, once full, can be removed from the holding cell 157D. For example, the waste bag can be lifted out of the holding cell 157D in any suitable manner such as via the crane system 160A. The removed waste bag can be then processed for dewatering, transport and/or disposal. A new removable waste bag can be fitted in the cleaned holding cell 157D.

In selected embodiments, the mud tank system 157 can be cleaned via the vacuum pump system 173. The vacuum pump system 173, for example, can be powered via the compressor system 157B and advantageously can pump settled drill cuttings from some or preferably each of the holding cells 157D of the mud tank system 157. The vacuum pump system 173 can pump the residual drilling fluid, water and settled drill cuttings from the holding cells 157D and into the bulk bag systems 158C of the fluid containment system 158 via the vacuum pump standpipe outlet 158D. The bulk bag systems 158C can contain the drill cuttings but permit the water to seep through the bag material and to form a pool bounded and retained by the watertight bunding 158A.

When full, a first bulk bag system 158C can be removed from the fluid containment system 158, closed off from the vacuum pump standpipe outlet 158D and set aside. The vacuum pump standpipe outlet 158D can be moved to a second bulk bag system 158C, which can be configured to receive residual drilling fluid, water and settled drill cuttings from the holding cells 157D. Once a predetermined number of bulk bag systems 158C are filled, a second fluid containment system 158 with additional bulk bag systems 158C optionally can be formed if the mud tank system 157 requires further cleaning. The additional bulk bag systems 158C can be filled until the mud tank system 157 has been cleaned of the residual drilling fluid and drill cuttings.

The watertight bunding 158A, the bulk bag systems 158C and other components of the fluid containment system 158 can be permitted to dry. The drying process can take days, weeks, months or longer, as needed. The dried bulk bag systems 158C can be collected via the logistics vehicle 160 or other available vehicle at the drill site 200 for transport to a waste management facility for disposal. As needed, the crane system 160A can be utilized to dispose the dried bulk bag systems 158C onto the logistics vehicle 160. The dried watertight bunding 158A and other components of the fluid containment system 158 can be cleaned and otherwise prepared for reuse.

Unlike conventional mud tank systems, the mud tank system 157 thereby can be cleaned in a simple and cost-effective manner and without use of external contractors, such as, for example vacuum trucks, which are widely used to support drilling operations and are a costly and time-consuming service that can cause operational delays. The mud tank system 157 likewise can avoid use of expensive vacuum trucks, which are needed to clean conventional mud tank systems.

The air compressor system 157B can be configured to provide pressurized air. In selected embodiments, the air compressor system 157B can comprise a diesel engine powered air compressor system and/or can provide the pressurized air for running the vacuum pump system 173. The air compressor system 157B can be coupled with any suitable equipment associated with the surface drilling system 100. The air compressor system 157B, for example, can be coupled with the vacuum pump system 173 via one or more hoses and/or can be disposed in the mud tank system 157 in the manner discussed in more detail herein.

Figure 13:
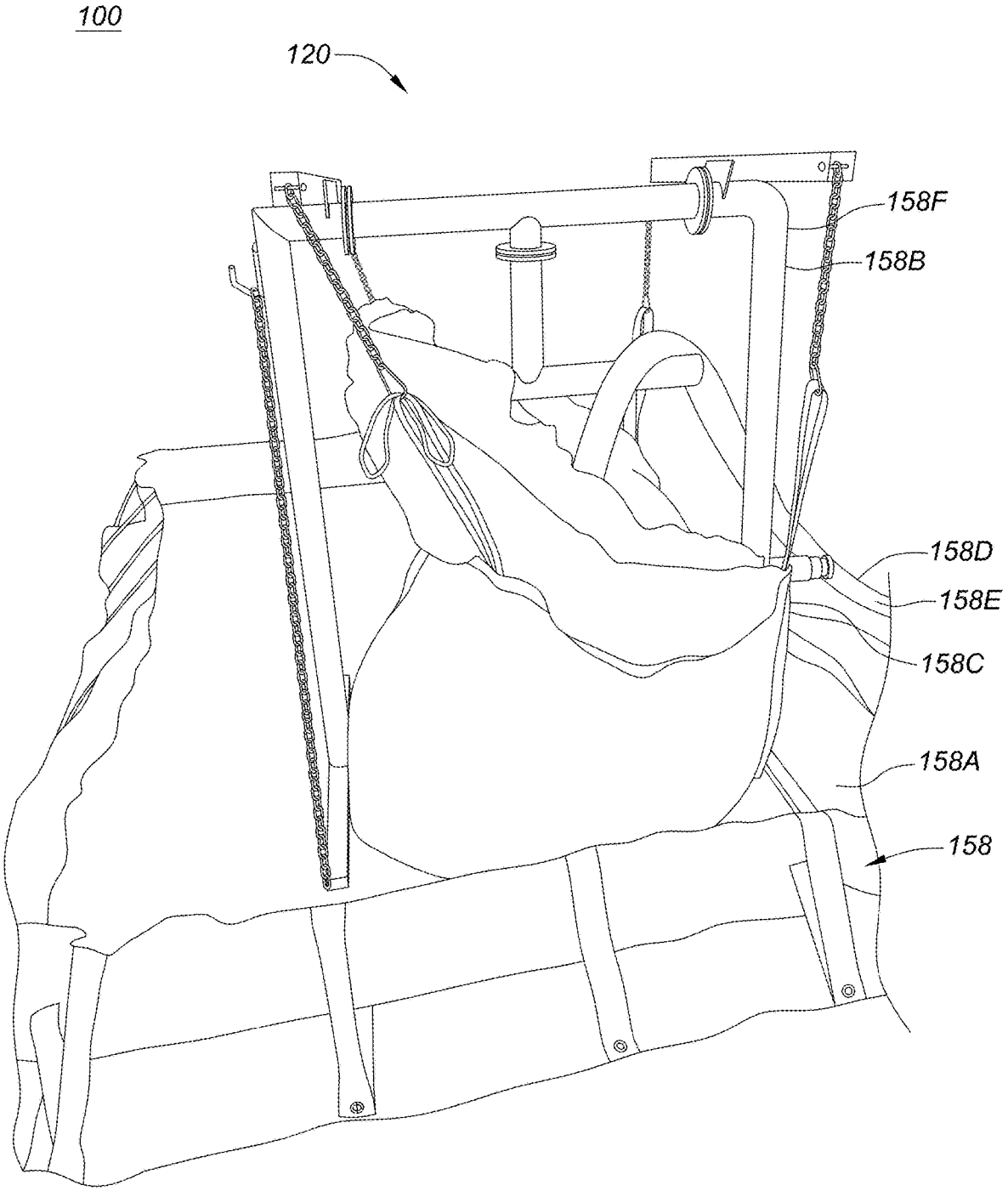
FIG. 13 is a detail drawing illustrating an exemplary embodiment of a fluid containment system for the surface drilling system of FIG. 1.

An exemplary fluid containment system (or means) 158 for the surface drilling system 100 is shown in FIGS. 2 and 13. Turning to FIGS. 2 and 13, the fluid containment system 158 can include, but is not limited to, the watertight bunding 158A, the vacuum pump standpipe system 158B, a vacuum pump standpipe outlet 158D, and/or one or more bulk bag systems 158C. The watertight bunding 158A advantageously can prevent fluids from spilling on the ground of the drill site 200, for example, when the bulk bag system 158C is being filled with residual drilling fluid, water and drill cuttings and/or when the mud tank system 157 is being cleaned.

The vacuum pump standpipe system 158B advantageously can comprise a standalone standpipe with at least one attachment for a water hose 158E and a support frame 158F for ground stability as well as support points for the bulk bag system 158C. The vacuum pump standpipe system 158B for the vacuum pump system 173 can be placed in the watertight bunding 158A along with the bulk bag system 158C. The vacuum pump standpipe system 158B and the vacuum pump system 173 can be coupled via the water hose 158E. The bulk bag system 158C can be coupled with the vacuum pump standpipe system 158B while being filled with residual drilling fluid, water and drill cuttings.

Figure 14:
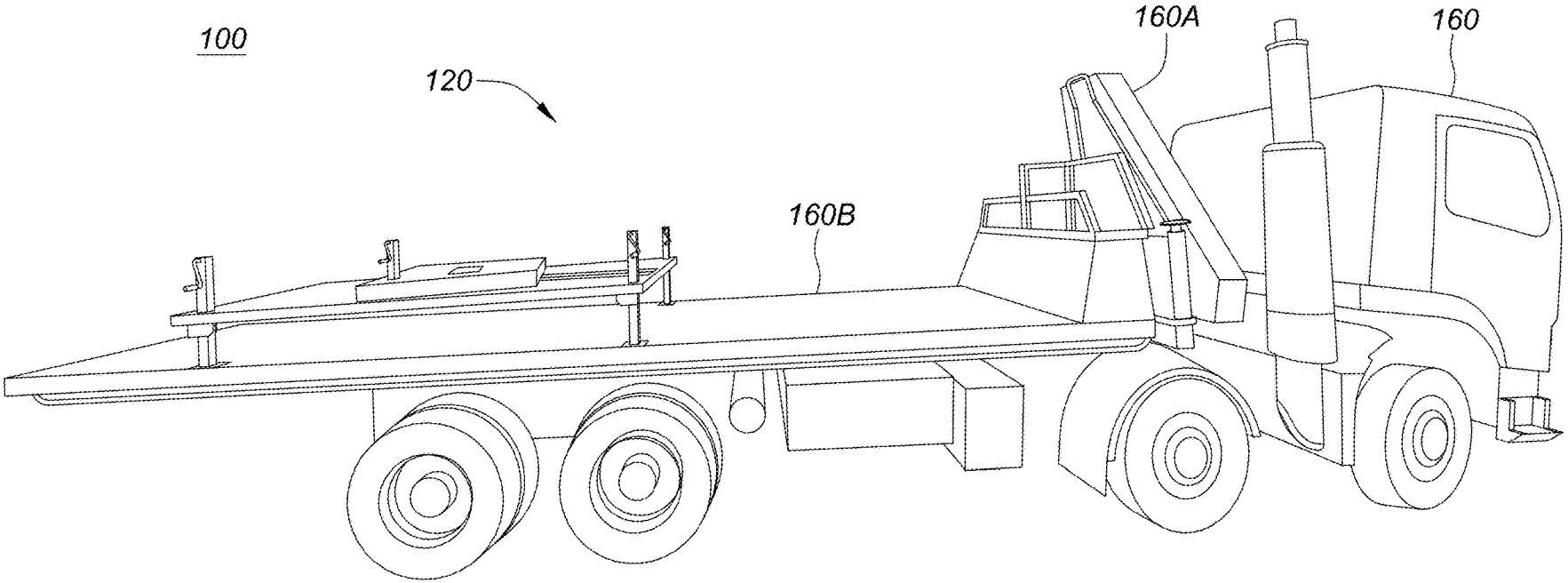
FIG. 14 is a detail drawing illustrating an exemplary embodiment of a logistics vehicle for the surface drilling system of FIG. 1.

An exemplary logistics vehicle 160 for the surface drilling system 100 is shown in FIGS. 2 and 14. Turning to FIGS. 2 and 14, the logistics vehicle 160 is shown as including a crane system 160A and/or a tilt-tray loading system 160B. In selected embodiments, the logistics vehicle 160 can be configured to support a standardized shipping container, such as a standard twenty-foot shipping container with corner fittings for a twist-locking mechanism. The logistics vehicle 160 advantageously can transport loads up to thirty tons GVM/GVWR or more. The logistics vehicle 160 optionally can perform loading operations using the crane system 160A and/or the tilt-tray loading system 160B. Exemplary crane systems 160A can have a loading capacity between one and five tons; whereas, exemplary tilt-tray loading systems 160B can support a loading capacity between five and twenty tons. The logistics vehicle 160, for example, can be adapted to transport bulk bags 158C with drill waste.

The logistics vehicle 160 advantageous can be configured to serve multiple functions in support of the surface drilling system 100. For instance, the logistics vehicle 160 can transport the water skid system 140, the mud tank system 157, the rod skid system 121 and/or a utility skid system (not shown) via the tilt-tray loading system 160B. The logistics vehicle 160 can operate as a conventional water truck when transporting the water skid system 140 and/or as a utility vehicle when transporting the utility skid system. As a utility vehicle, the logistics vehicle 160 can resupply various items, transport blackwater and/or transport and freshwater. Additionally and/or alternatively, the crane system 160A can used for various loading operations, such as loading and/or unloading the drill rig deck system 115, the collar tray system 156 and/or the bulk bags 158C, without limitation.

In selected embodiments, the tow vehicle 161 can comprise a four-wheel drive light vehicle with a towing capacity between one and five tons or more. The tow vehicle 161 advantageous can be configured to serve multiple functions in support of the surface drilling system 100. The tow vehicle 161 advantageous can be configured to tow any trailer within the towing capacity of the tow vehicle 161. For example, the tow vehicle 161 can tow the logistics vehicle 160, the core transport system 124, the fuel trailer system 125, a living system (or means) 400 (shown in FIG. 15) and/or a kitchen system (or means) 500 (shown in FIG. 15), without limitation.

The muds and oils storage bunding 162 advantageously can collect spills from any fluid containers placed on the muds and oils storage bunding 162. During transport, the muds and oils storage bunding 162 can be disposed within a storage cell of the mud tank system 157.

The spill kit system 163 can contain absorbent materials for absorbing spilled oil, fuel and/or other liquids. Optionally, the spill kit system 163 can be utilized for absorbing oil, fuel and/or other liquids disposed on tools (not shown) for cleaning up the liquid spills. In selected embodiments, the spill kit system 163 can include, but is not limited to, the absorbent materials, the tools for cleaning up the liquid spills and/or a storage bin (not shown) for storing the absorbent materials and the tools.

The safety cage spin system 164 can be utilized for restricting access to an accessible area of rotating parts of the drill rig system 110. In selected embodiments, the safety cage spin system 164 can be coupled with the drill rig mast system 112 and/or configured for transport via the mud tank system 157.

The tool rack system 165 can comprise a plurality of racks (not shown) each including a plurality of hangers (not shown). In use, the tool rack system 165 can be disposed on the ground at the drill site 200. Each hanger can include a tool, a first aid kit and other items for use by the operators and other personnel associated with the surface drilling system 100 and/or the drill site 200. The hangers preferably are within easy reach of the drilling system operators and other personnel.

In selected embodiments, the spill absorbent matting 166 can be disposed below selected equipment associated with the surface drilling system 100. The selected equipment can be prone to spillage of fluids or other materials. Exemplary selected equipment can include the drill rig system 110, the onboard triplex pump system 171, the self-priming centrifugal water pump system 172, the diaphragm pump system 174 and other equipment of the surface drilling system 100, without limitation.

In the manner discussed in more detail herein, the surface drilling system 100 can include one or more pump systems (or means) 170. The pump systems 170 can include, but are not limited to the onboard triplex pump system 171, the self-priming centrifugal water pump system 172, vacuum pump system 173 and/or the diaphragm pump system 174. The onboard triplex pump system 171, for example, can be configured to pump water or drilling fluids with high pressure at low volumes. The onboard triplex pump system 171 can supply water for drilling operations of the drill rig system 110, hopper operations of the hopper system 153, inner tube pump-out operations of the inner tube and core processing system 123 and/or the water distribution box system 151. In selected embodiments, the onboard triplex pump system 171 can be coupled with, otherwise disposed at, the drill rig system 110.

The self-priming centrifugal water pump system 172 advantageously can pump water with low pressure at high volumes. In selected embodiments, the self-priming centrifugal water pump system 172 can be used to load water into the water skid system 140. The self-priming centrifugal water pump system 172 optionally can be coupled with, otherwise disposed at, the water skid system 140.

The vacuum pump system 173 can be powered by air for pumping solid and/or liquid materials. In operation, the vacuum pump system 173 can be configured to clean drill cuttings, residual mud and other materials from the holding cells 157D of the mud tank system 157 into the bulk bag systems 158C. The vacuum pump system 173 can be coupled with the suction attachment 157G during use and/or can be disposed in a storage cell of the mud tank system 157 during transport.

Additionally and/or alternatively, the diaphragm pump system 174 can pump the return drilling fluid and water from the collar tray system 156 into a selected initial holding cell 157$D_1$ (shown in FIGS. 23A-B) of the mud tank system 157. The selected initial holding cell 157$D_1$, for example, can be designated for receiving the dirtiest return drilling fluid and water. Advantageously, the diaphragm pump system 174 can safely run dry and thus wait for water to appear. The diaphragm pump system 174 thereby can be configured to run all the time in selected embodiments. The diaphragm pump system 174 optionally can be disposed in a storage cell of the mud tank system 157 during transport.

In the manner discussed in more detail above with reference to FIG. 2, the agitator system 180 can be associated with a selected final holding cell 157$D_6$ (shown in FIGS. 23A-B) of the mud tank system 157. The selected final holding cell 157$D_6$ can be designated for receiving the cleanest return drilling fluid and water. The agitator system 180 can be configured to constantly agitate the selected final holding cell 157$D_6$ to prevent mud additives from settling out of solution. In selected embodiments, the agitator system 180 can be connected with an auxiliary hydraulic system (not shown) of the drill rig system 110. The agitator system 180 can be connected with the auxiliary hydraulic system directly and/or indirectly via an intermediate system, such as the drill rig control panel system 114. The agitator system 180 optionally can be disposed in a storage cell of the mud tank system 157 during transport.

Figure 21:
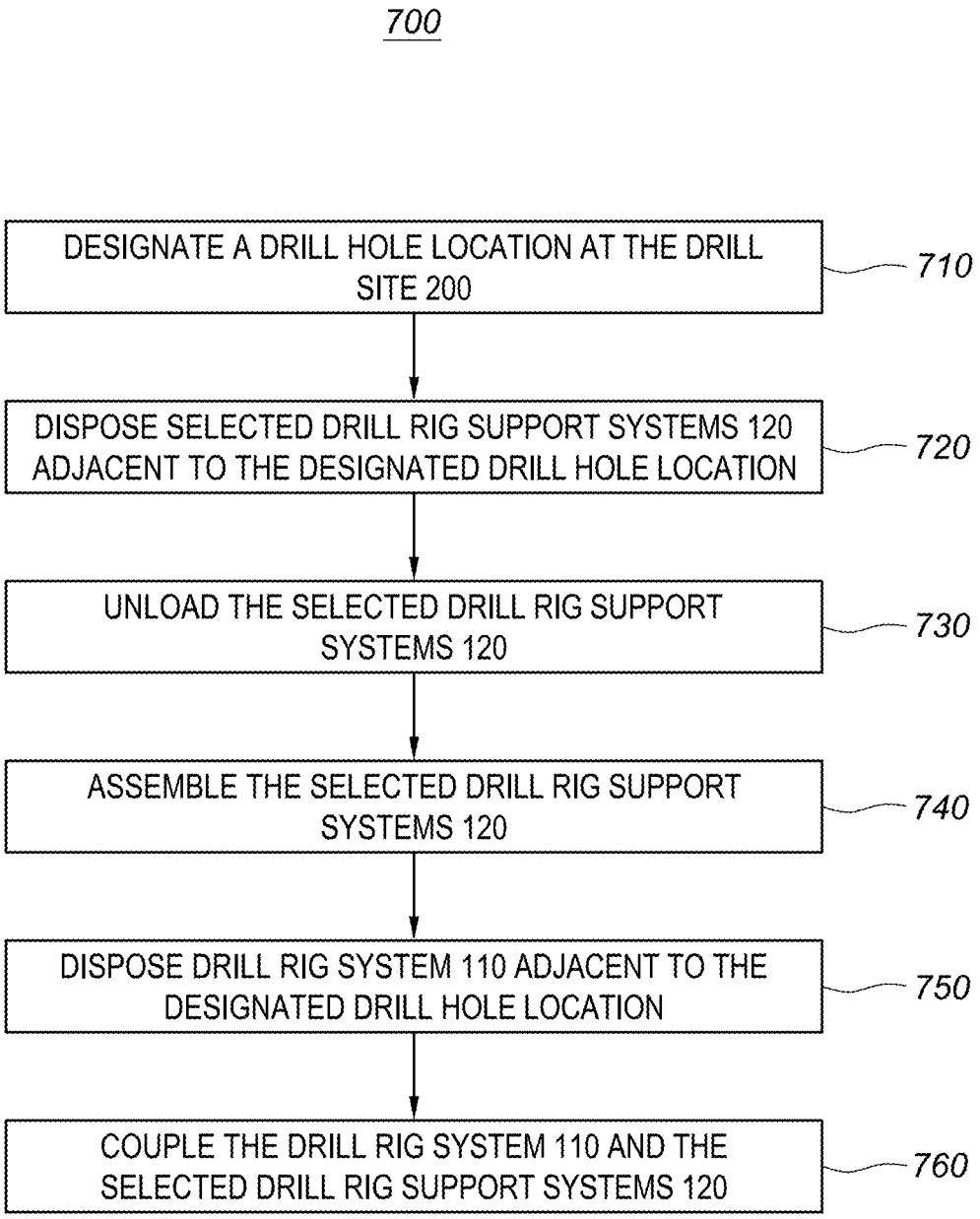
FIG. 21 is a top level flow chart illustrating an exemplary method for setting up the surface drilling system of FIG. 1.

The surface drilling system 100 can be assembled in any suitable manner. An exemplary method 700 for setting up the drill rig system 110 and the drill rig support systems 120 at the predetermined drill site 200 is illustrated in FIG. 21. With reference to FIGS. 2 and 21, a drill hole location at the predetermined drill site 200 can be designated, at 710. Selected drill rig support systems 120 can be disposed adjacent to the designated drill hole location, at 720. The selected drill rig support systems 120 can be unloaded, at 730, and assembled, at 740. At 750, the drill rig system 110 can be disposed adjacent to the designated drill hole location. The drill rig system 110 and the selected drill rig support systems 120 can be coupled, at 760.

In selected embodiments, the set up method 700 can include, at 710, disposing the rod skid system 121 in front of the designated drill hole location. The rod skid system 121 can be positioned such as for the trace of the drillhole axis to go through the middle of the rod skid system 121. Sufficient space should be left for fitting the collar tray system 156 and the drill rig deck system 115. The rod skid system 121 can be unloaded adjacent to the designated drill hole location. Additionally and/or alternatively, the fuel trailer system 125, the mud tank system 157 and/or the logistics system 130 can be disposed at suitable locations at the drill site 200.

The diaphragm pump system 174, the collar tray support system 156B, the muds and oils storage bunding 162 and other equipment can be unloaded from the mud tank system 157, at 730, disposed at suitable locations at the drill site 200, and, as needed, assembled, at 740. Heavier equipment, such as the collar tray system 156 and/or the drill rig deck system 115, can be unloaded and positioned via the crane system 160A (shown in FIG. 14) of the logistics vehicle 160 (shown in FIG. 14). Any unnecessary inserts, such as deck inserts, can be removed and placed in a safe location, such as under the drill rig deck system 115.

Additionally and/or alternatively, the agitator system 180, the vacuum pump system 173, the fluid containment system 158, the suction attachment 157G, the inner tube and core processing system 123, the spill absorbent matting 166 and the associated hydraulic hoses, air hoses and water/drilling hoses can be unloaded from the mud tank system 157 and, as needed, assembled. The hopper system 153, for example, can be coupled with the mud tank system 157. Other equipment, such as the tool rack system 165 and/or the vacuum pump standpipe system 158B can be unloaded from the rod skid system 121. The core transport system 124 likewise can be disposed at suitable location at the drill site 200.

The drill rig system 110 can be disposed adjacent to the designated drill hole location, at 750, and the spill absorbent matting 166 can be positioned. The drill rig system 110 then can be aligned with the drill hole.

At 760, the drill rig system 110 and the selected drill rig support systems 120 can be coupled. Stated somewhat differently, the various previously-unloaded hydraulic hoses, air hoses and water/drilling hoses can be installed. The collar tray system 156 and the diaphragm pump system 174, for example, can be coupled via one or more hoses. At least one hose can couple the diaphragm pump system 174 with the mud tank system 157. The water distribution box system 151 likewise can be coupled with the hopper system 153 via a first hose, can be coupled with the water swivel system 154 via a second hose and/or can be coupled with the inner tube pump out attachment system 152 via a third hose.

In selected embodiments, the suction hose strainer filter system 150 can be coupled with the triplex pump system 171 via a water hose. The vacuum pump system 173 can be coupled with the suction attachment 157G via a fourth hose and/or can be coupled with the vacuum pump standpipe system 158B via a fifth hose. An air hose can couple the air compressor system 157B with the vacuum pump system 173. The agitator system 180 and the drill rig control panel system 114 can be coupled with one or more hydraulic hoses.

The safety cage spin system 164 optionally can be unloaded from the mud tank system 157 and disposed on the drill rig system 110. One or more side awnings of the logistics system 130 can be opened for offering shade to the drill rig operators, other personnel associated with the surface drilling system 100 and/or other individuals at the drill site 200. The water skid system 140 can be disposed at the drill site 200. In selected embodiments, the water skid system 140 can be coupled with the logistics vehicle 160 to facilitate water carting operations. Water, for example, can be transferred from the water skid system 140 to the mud tank system 157. A predetermined amount of water can be transferred until a water level at the mud tank system 157 attains a predetermined water level, such as eighty percent of a capacity of the holding cells 157D. The cell lids 157C optionally can be removed from the holding cells 157D and stored. A water hose can couple the mud tank system 157 with the centrifugal water pump system 172.

The fluid containment system 158 can be unloaded from the logistics system 130 and assembled. In selected embodiments, the exclusion zone fencing can be disposed around a perimeter of the fluid containment system 158.

Figure 15:
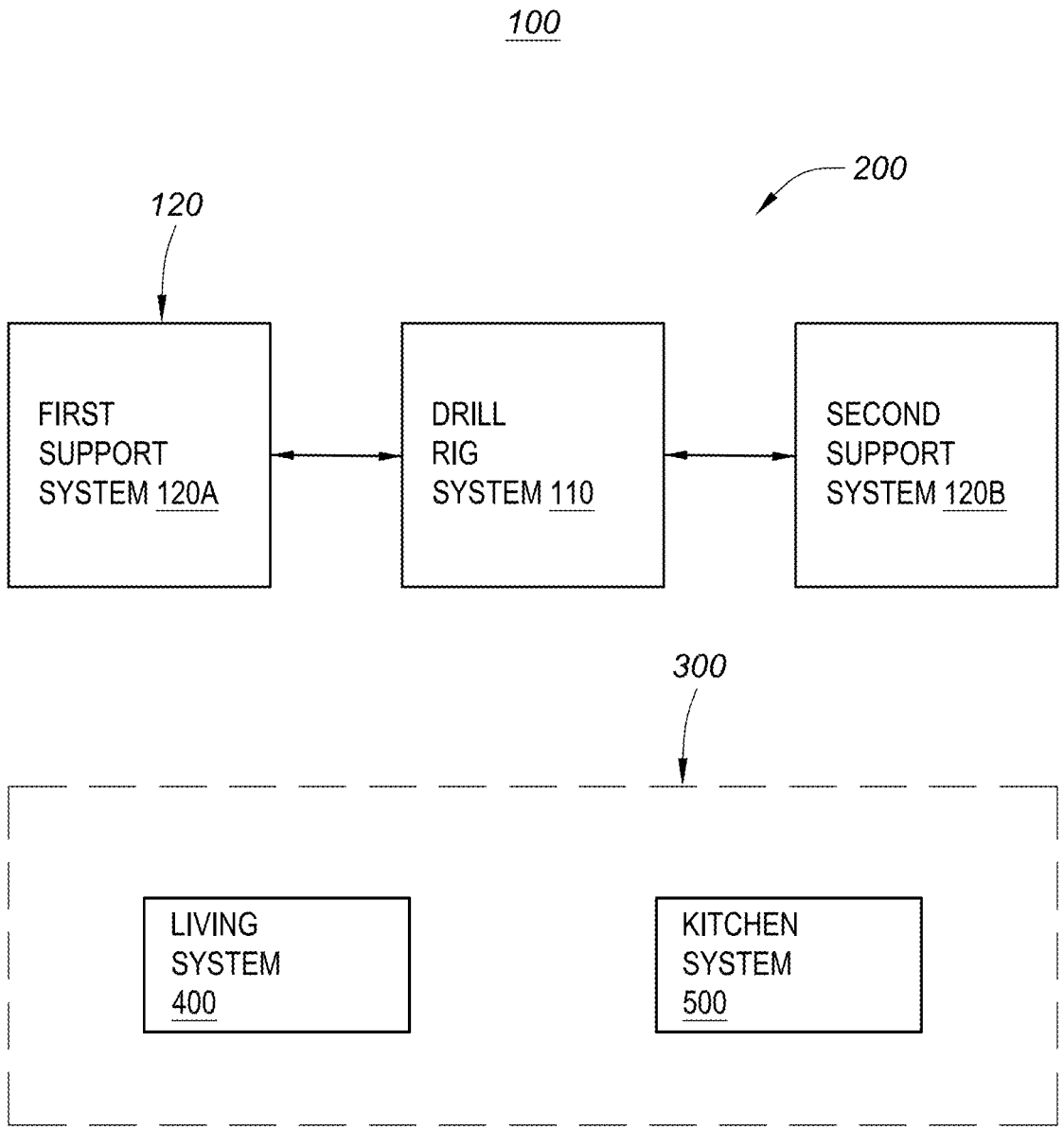
FIG. 15 is a top level block diagram illustrating another exemplary alternative embodiment of the surface drilling system of FIG. 1, wherein the surface drilling system is associated with a camping system for housing operators of the surface drilling system.

As shown in FIG. 15, the surface drilling system 100 optionally can include a camping system (or means) 300 for housing operators of the surface drilling system 100. Preferably being proximal to the drill rig system 110, the camping system 300 can be disposed at any suitable predetermined distance from the drill rig system 110.

The camping system 300 is shown in FIG. 15 as including a living system (or means) 400 and/or a kitchen system (or means) 500. The living system 400 can be provided in any suitable manner. In selected embodiments, the living system 400 can comprise a towable trailer system that be configured to be towed or otherwise transported via the tow vehicle 161 (shown in FIG. 2).

Turning to FIGS. 16 and 17A-D, the living system 400 can comprise a heavily insulated, air-conditioned accommodation unit with a plurality of rooms, including at least one sleeping room 410 and/or a living room 420, to help ensure comfortable rest for the operators of the surface drilling system 100. The sleeping room 410, for example, can include a bed 412, a bedside table 414 and an internal air conditioning system 416. Additionally and/or alternatively, the living room 420 can include a refrigerator and/or freezer 422, a table 424 with chairs (not shown), and an internal air conditioning system 426 in selected embodiments. The living system 400 can provide a large storage capacity and can store food and other provisions for one month or longer.

Figure 16:
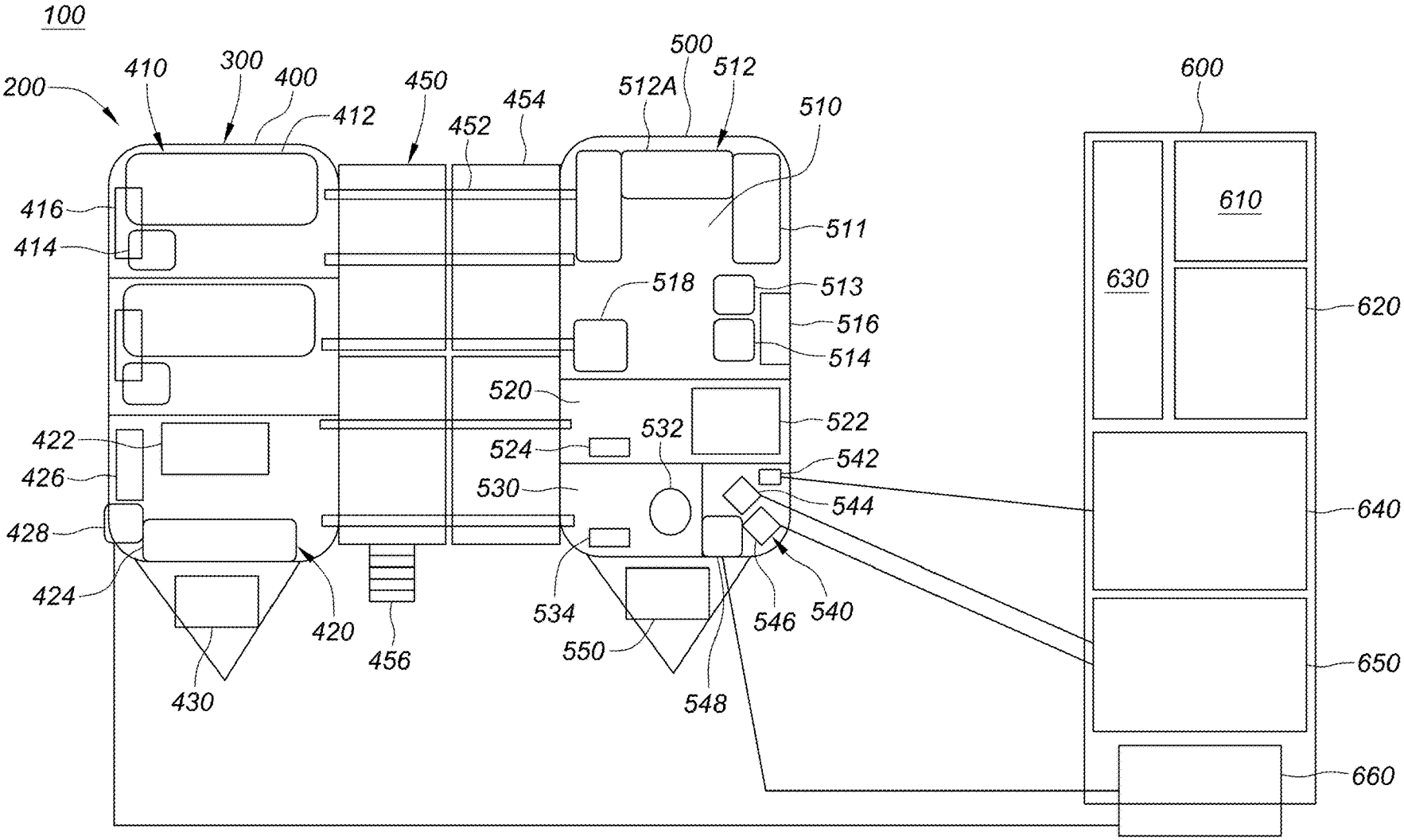
FIG. 16 is a detail drawing illustrating an exemplary alternative embodiment of the camping system of FIG. 15, wherein the camping system includes a living system, a kitchen system and an optional utility system
Figure 17A:
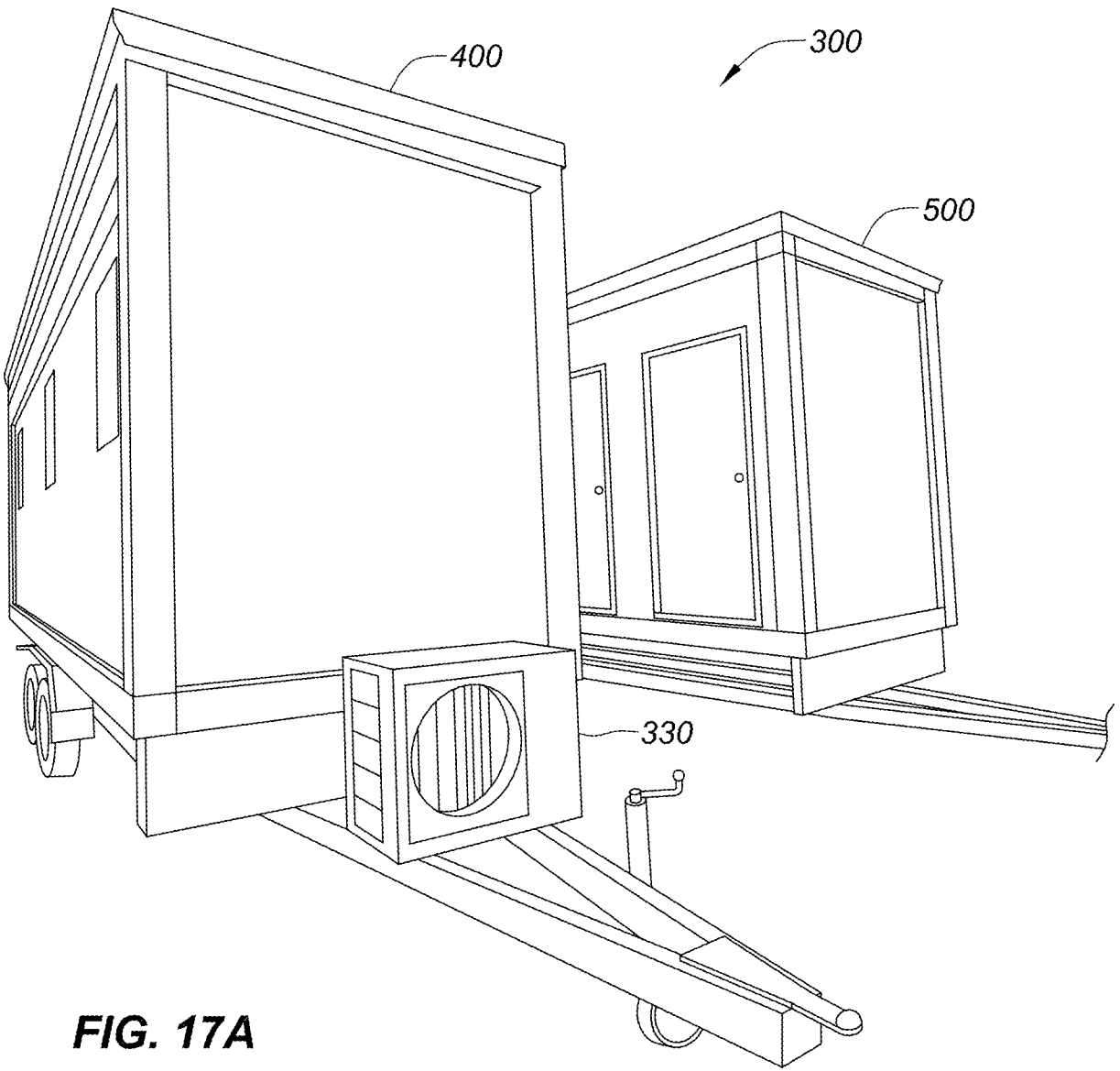
FIGS. 17A-D are detail drawings illustrating an exemplary embodiment of the living system for the camping system of FIG. 15.
Figure 17B:
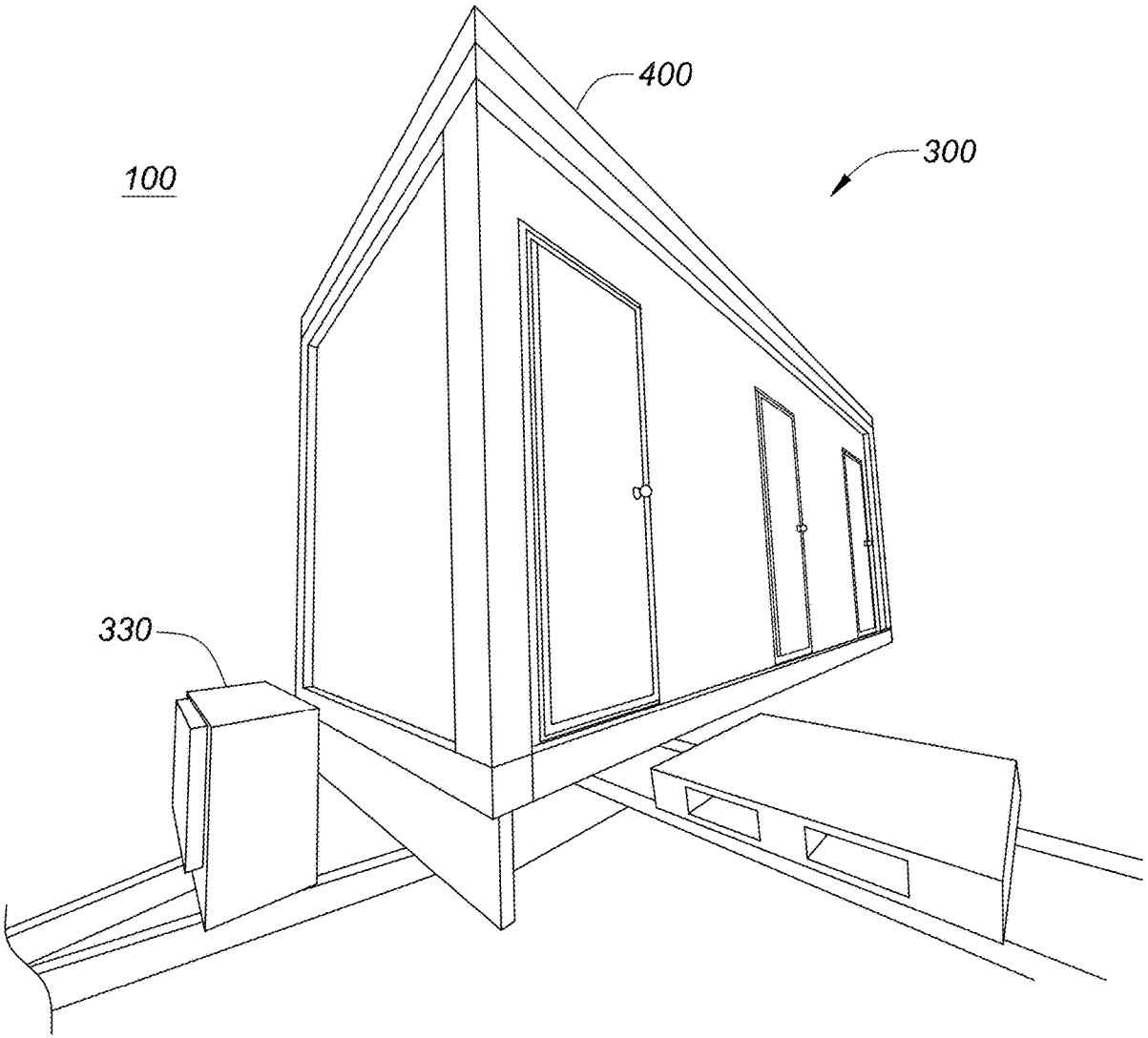
Figure 17C:
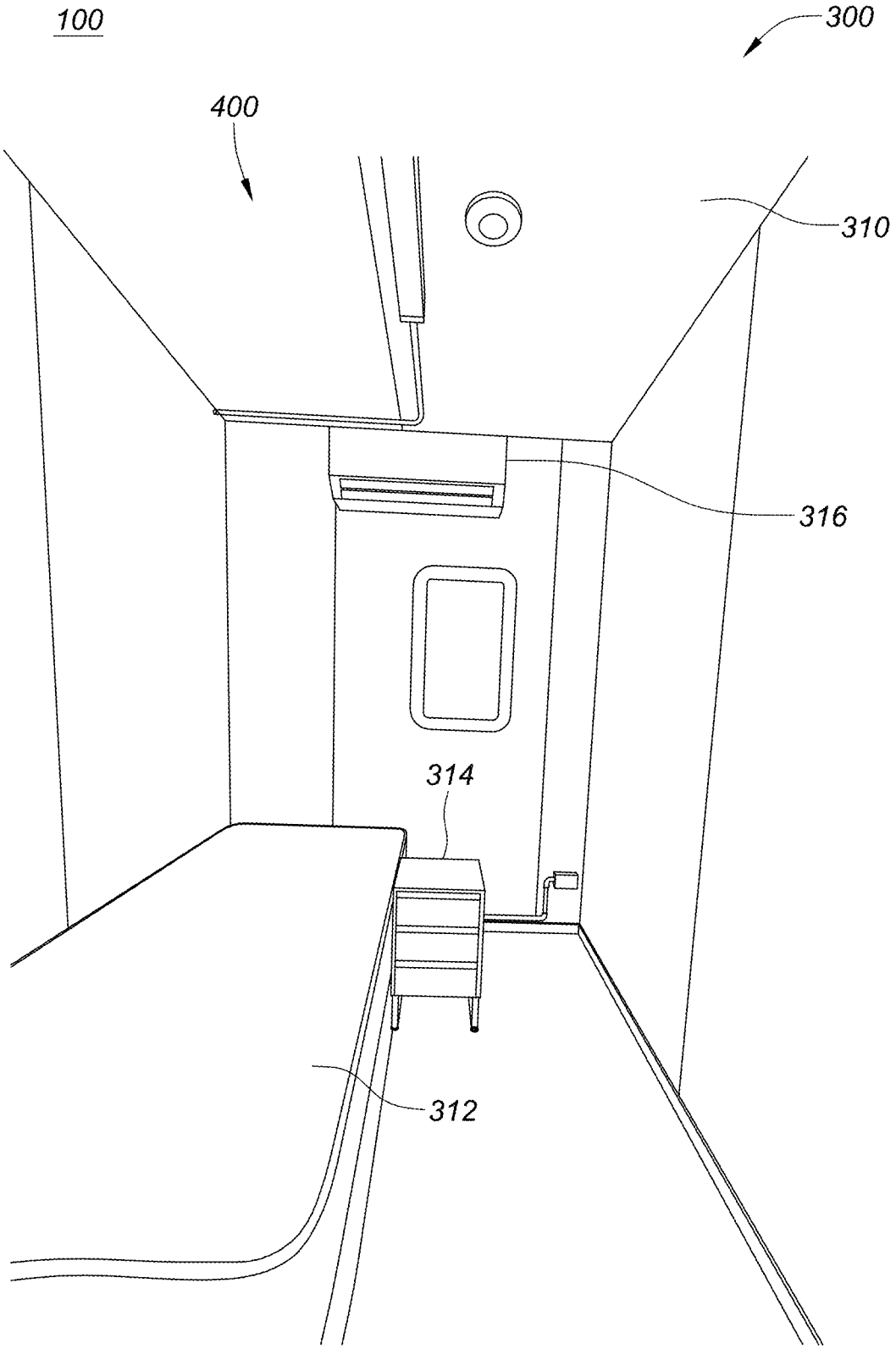
Figure 17D:
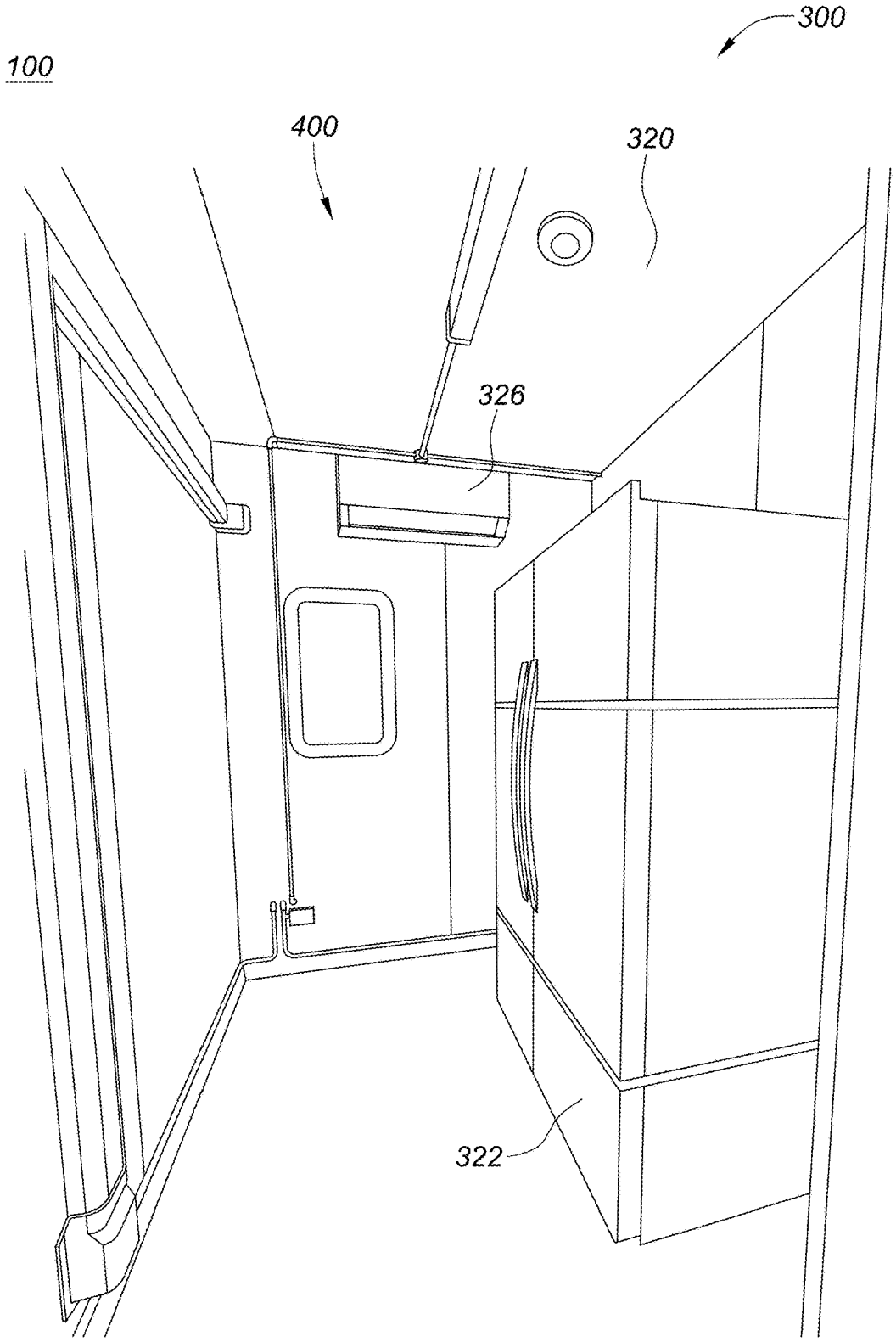

An optional electrical distribution system (or means) 428 likewise can be disposed at the living system 400, such as inside or outside of the living room 420 as illustrated in FIG. 16. In selected embodiments, the living system 400 can further include an external air conditioning system 430 for further ensuring the comfortable rest for the operators of the surface drilling system 100. The external air conditioning system 430 can include a protective cover (not shown) for protecting the external air conditioning system 430 during transit.

The living system 400 advantageously can provide large rooms 410, 420 for the operators of the surface drilling system 100. The heavy insulation, air-conditioning and large load capacity can help make the living system 400 more comfortable in hot desert environments at which mineral exploration drilling can be performed and reduce operational down time for resupply relative to conventional operator accommodation units. If provided as a towable trailer system, the living system 400 can be quickly mobilized and provide lower capital expenditures and operating cost due to removed need for external contractors to move the conventional operator accommodation units. The living system 400 likewise can be disposed adjacent to the drill site 200 for the convenience of the operators.

The kitchen system 500 likewise can be provided in any suitable manner. In selected embodiments, the kitchen system 500 can comprise a towable trailer system that be configured to be towed or otherwise transported via the tow vehicle 161 (shown in FIG. 2). Turning to FIGS. 16 and 18A-E, the kitchen system 500 can comprise a heavily insulated, air-conditioned accommodation unit with a plurality of rooms, including a kitchen room 510, a shower room 520 and/or a bathroom 530, to ensure comfortable food preparation, washing showering and toilet facilities for the operators of the surface drilling system 100.

Figure 18A:
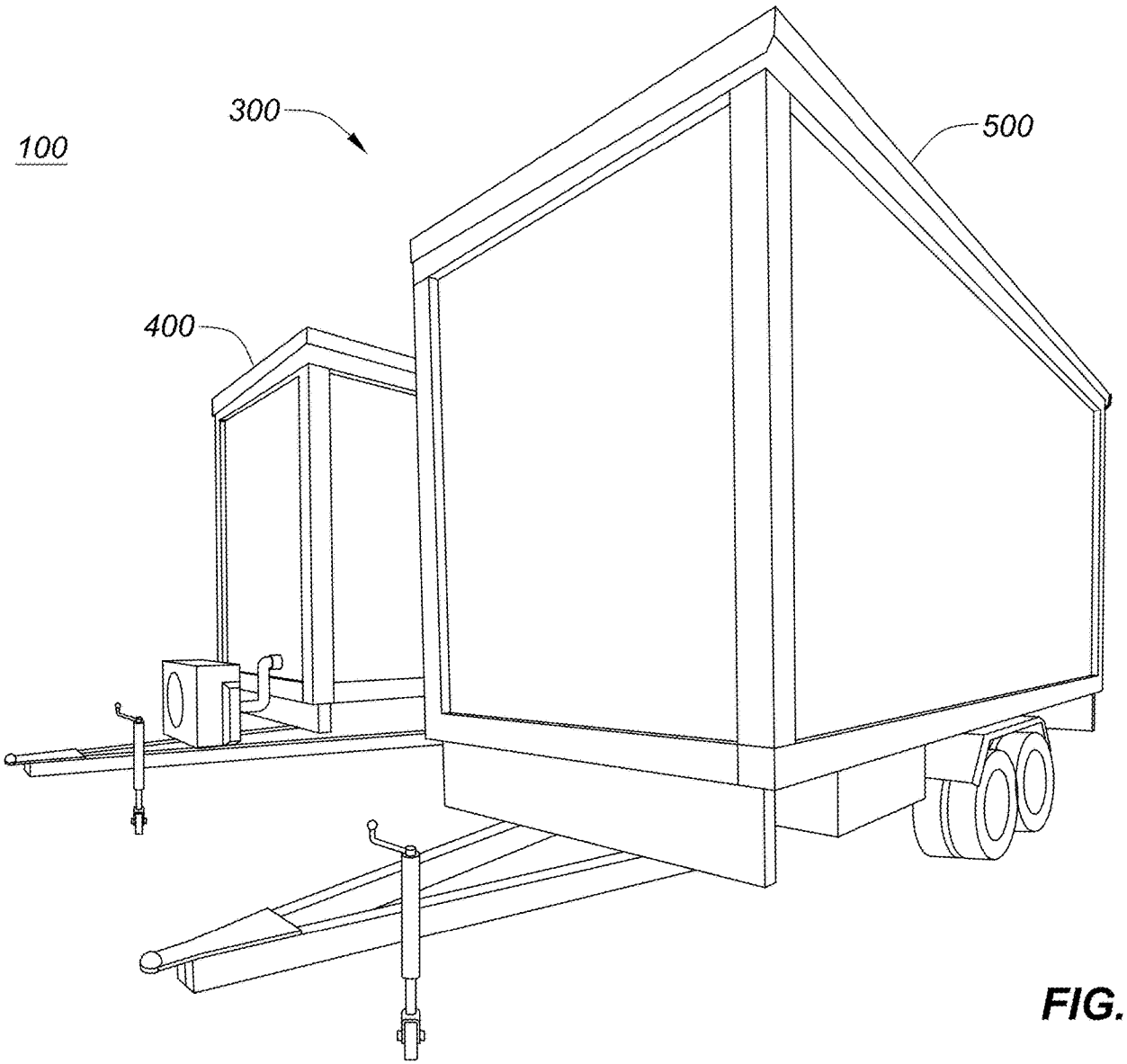
FIGS. 18A-E are detail drawings illustrating an exemplary embodiment of the kitchen system for the camping system of FIG. 15.
Figure 18B:
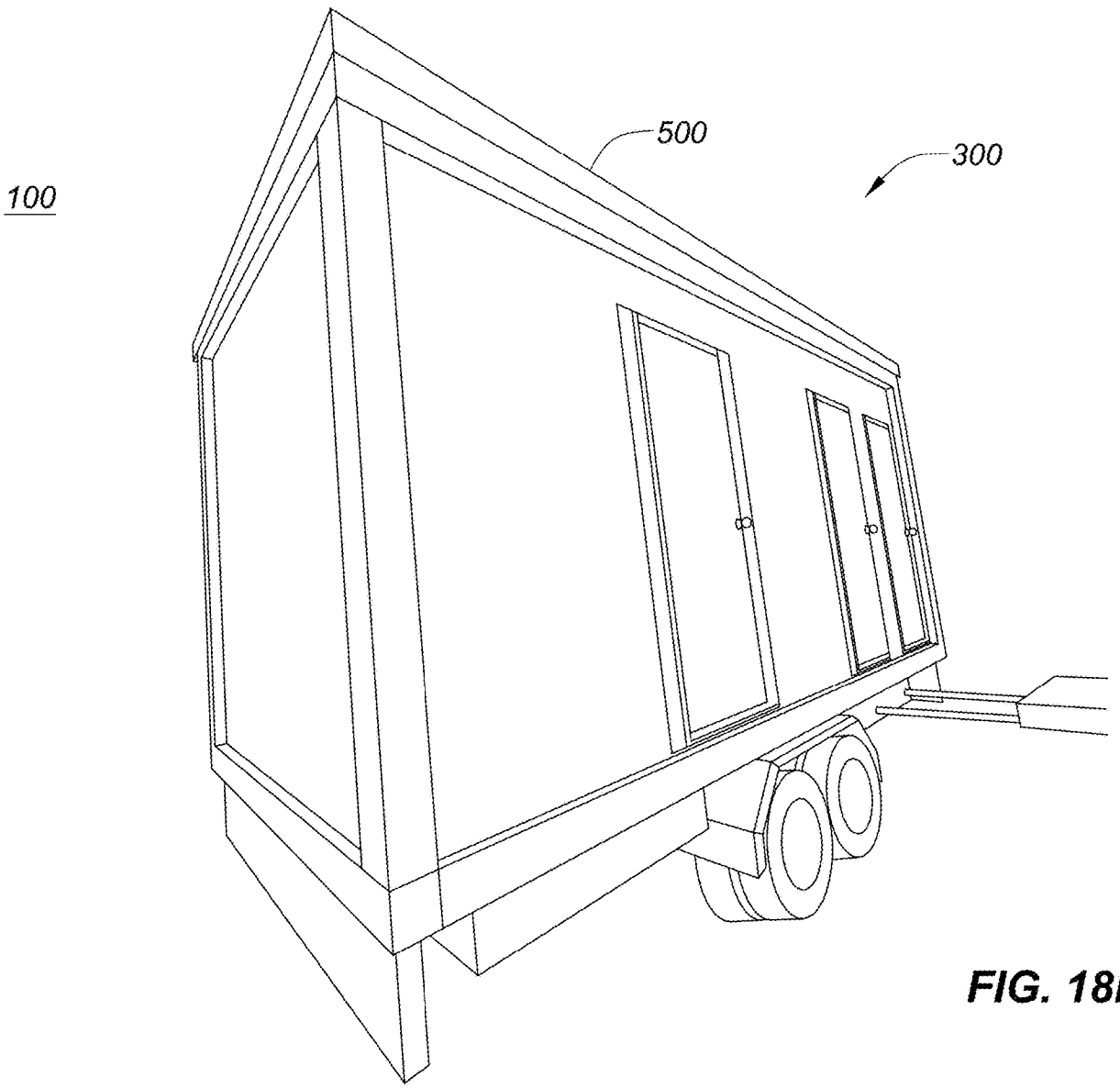
Figure 18C:
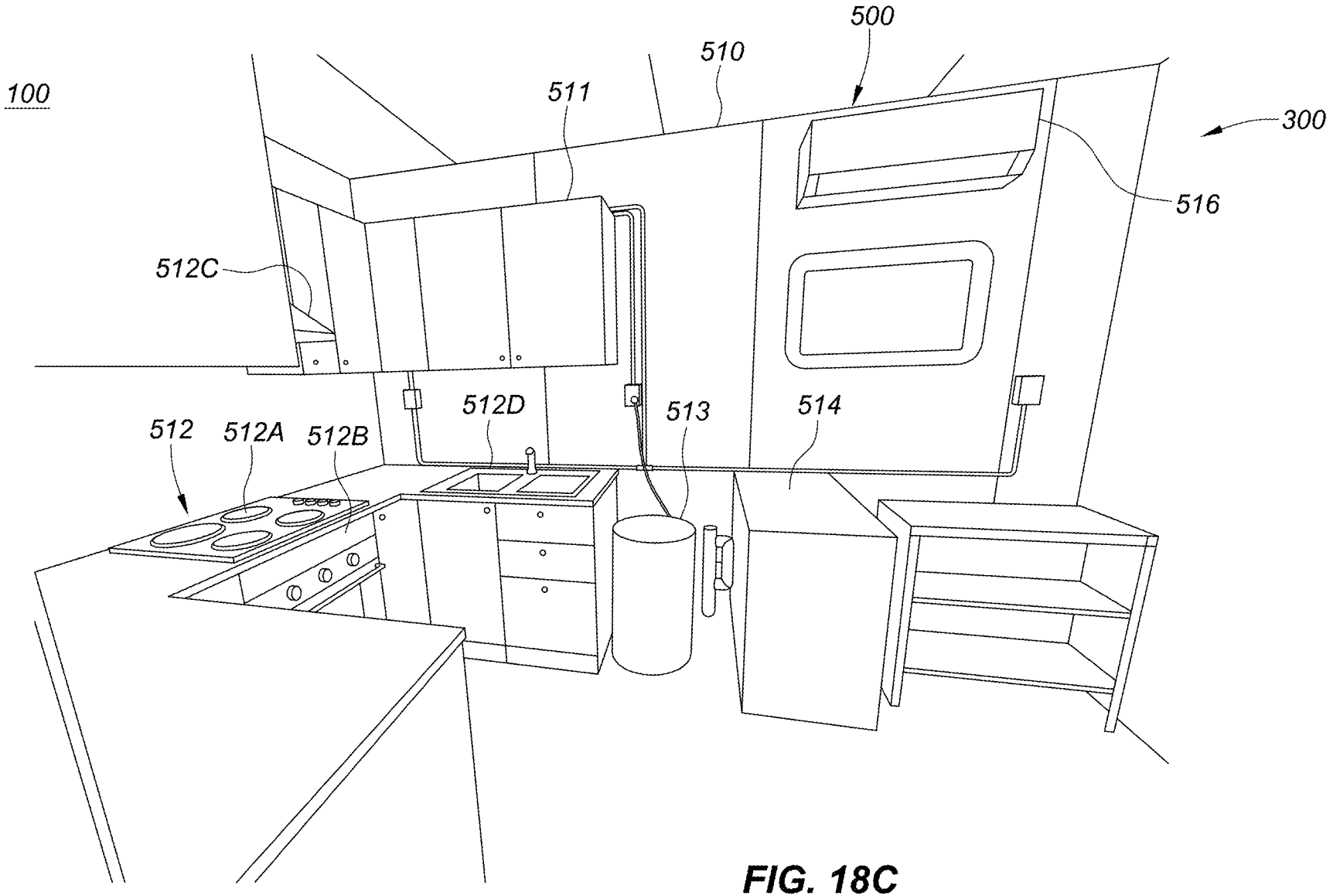
Figure 18D:
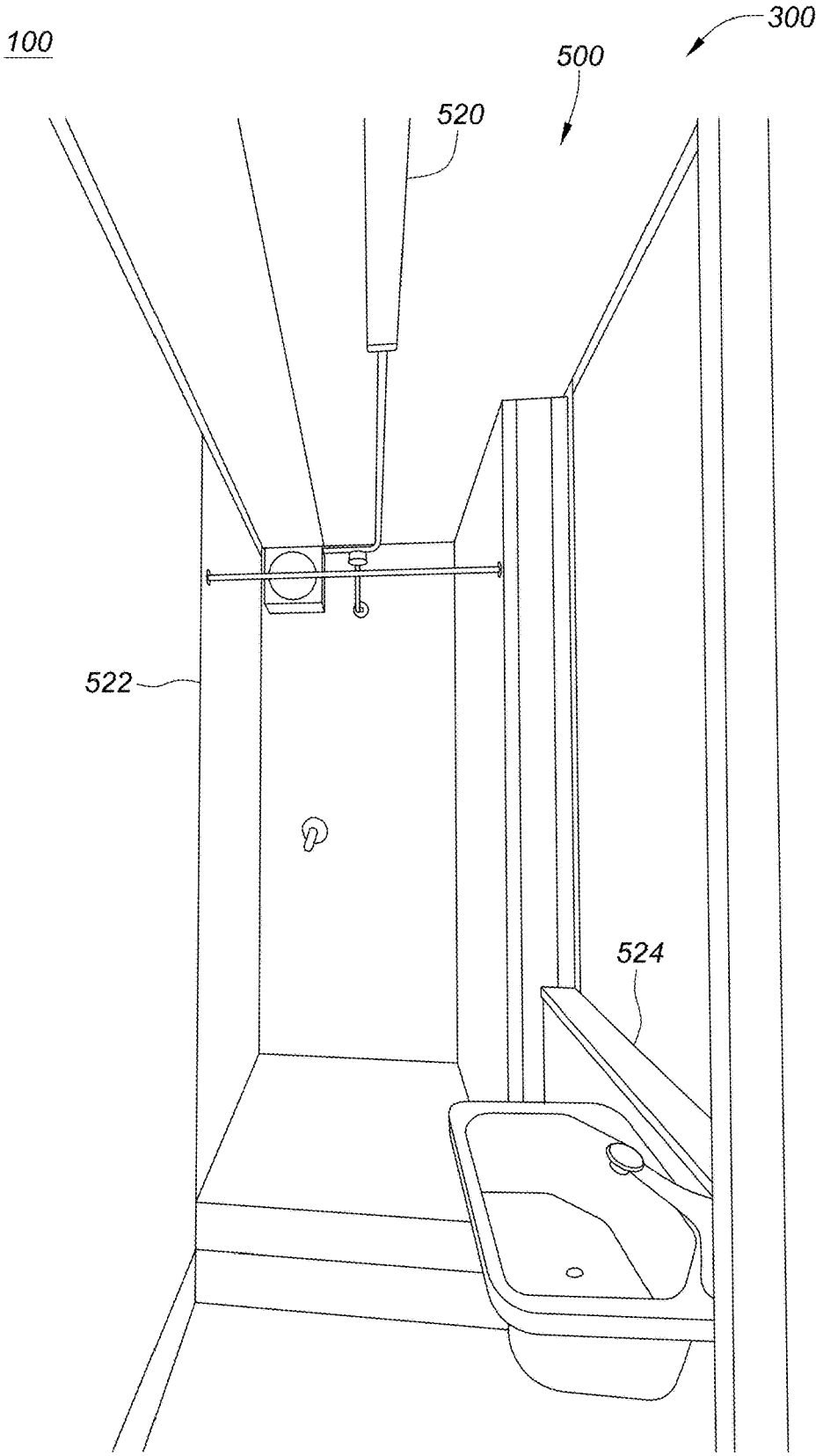
Figure 18E:
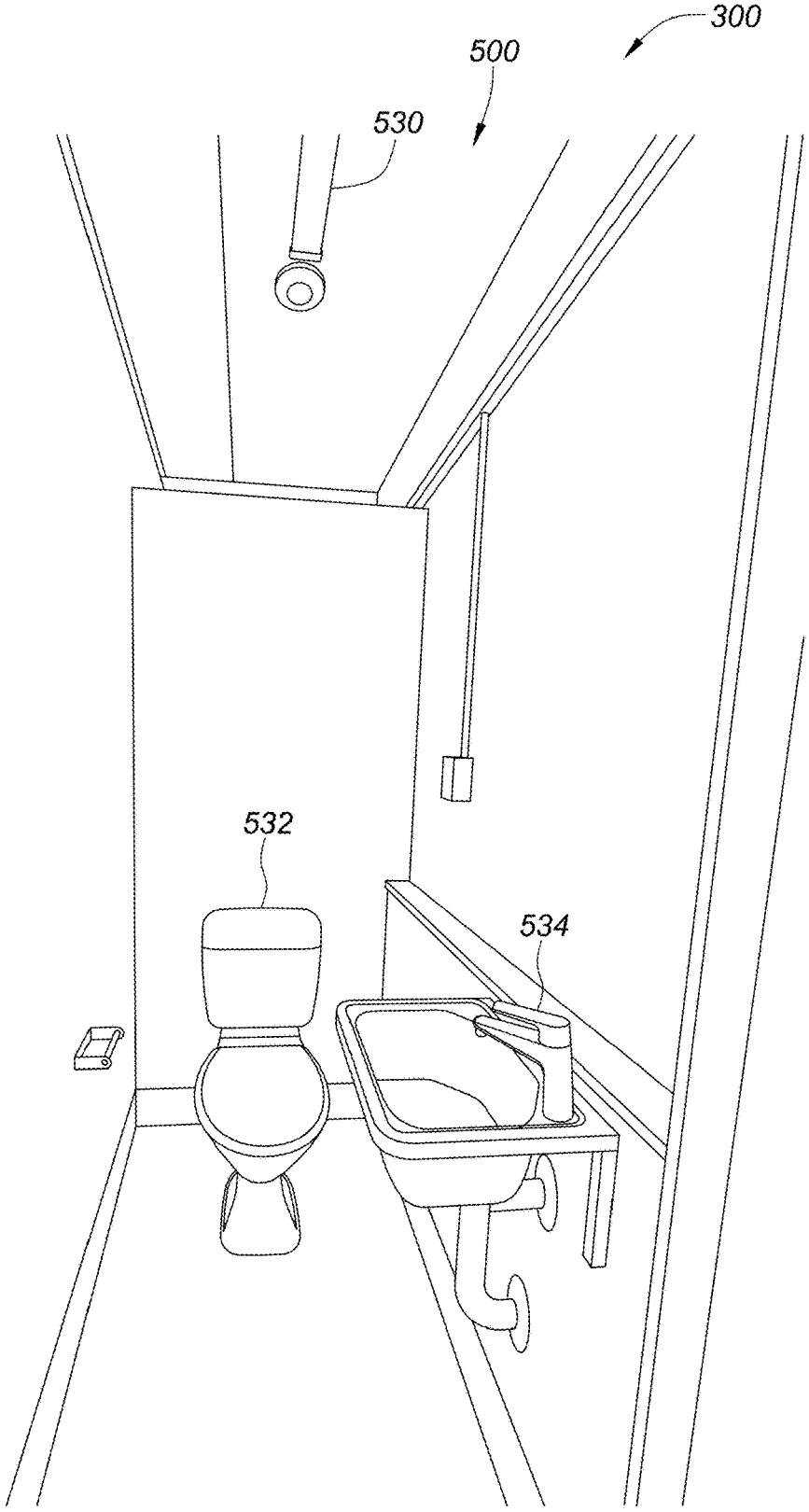
Figure 19A:
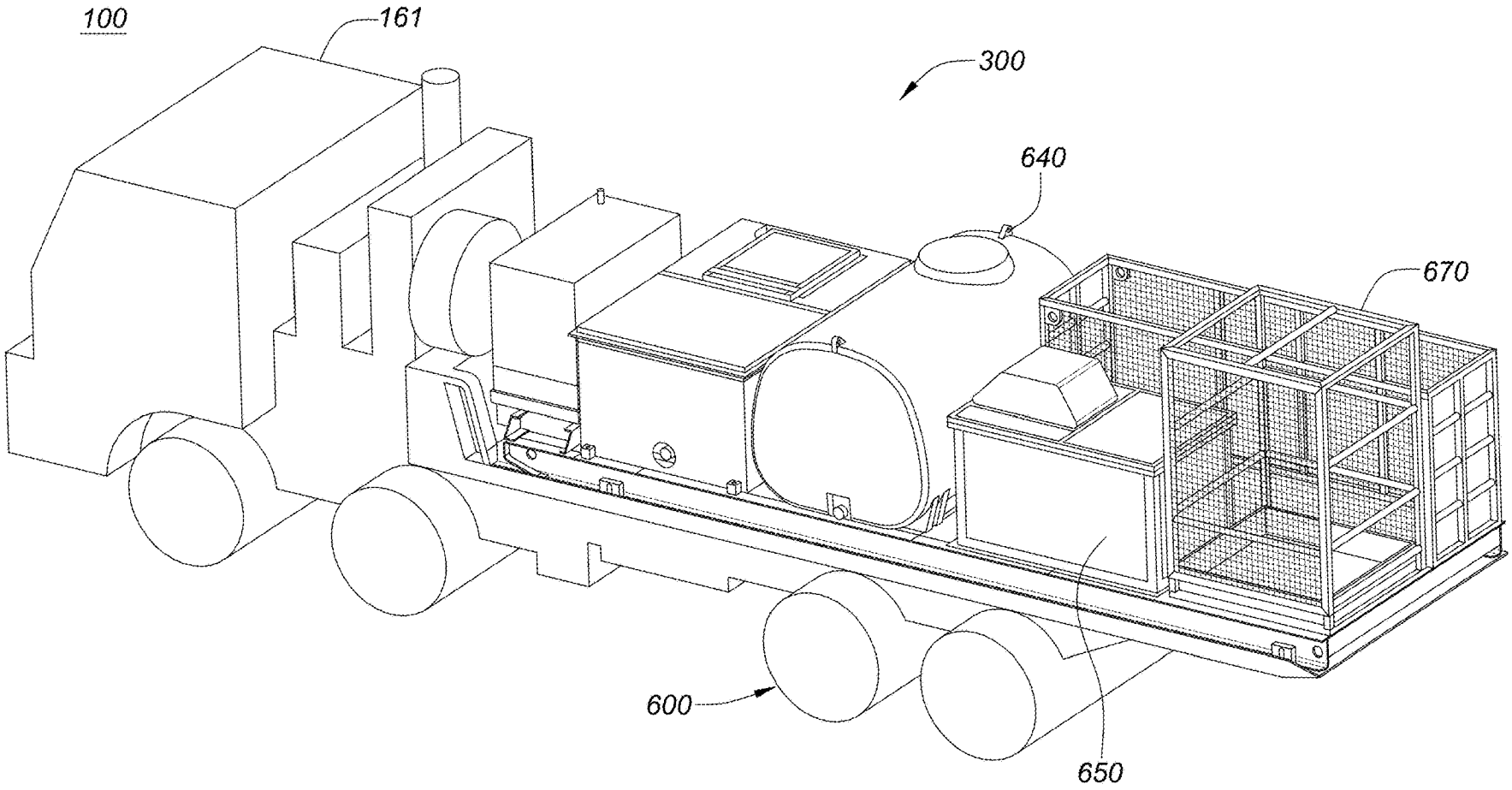
FIGS. 19A-D are detail drawings illustrating an exemplary embodiment of the utility system for the camping system of FIG. 15.
Figure 19B:
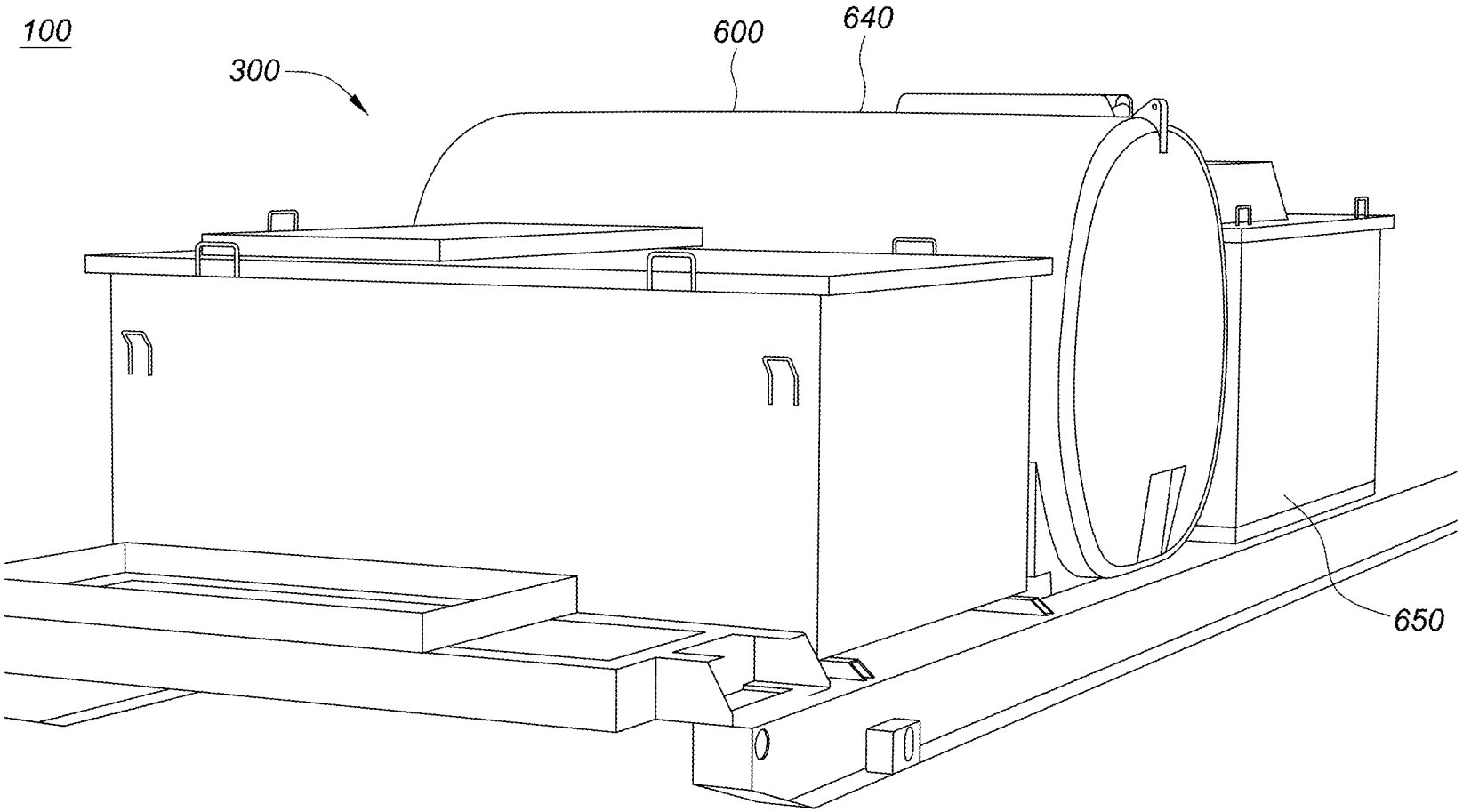
Figure 19C:
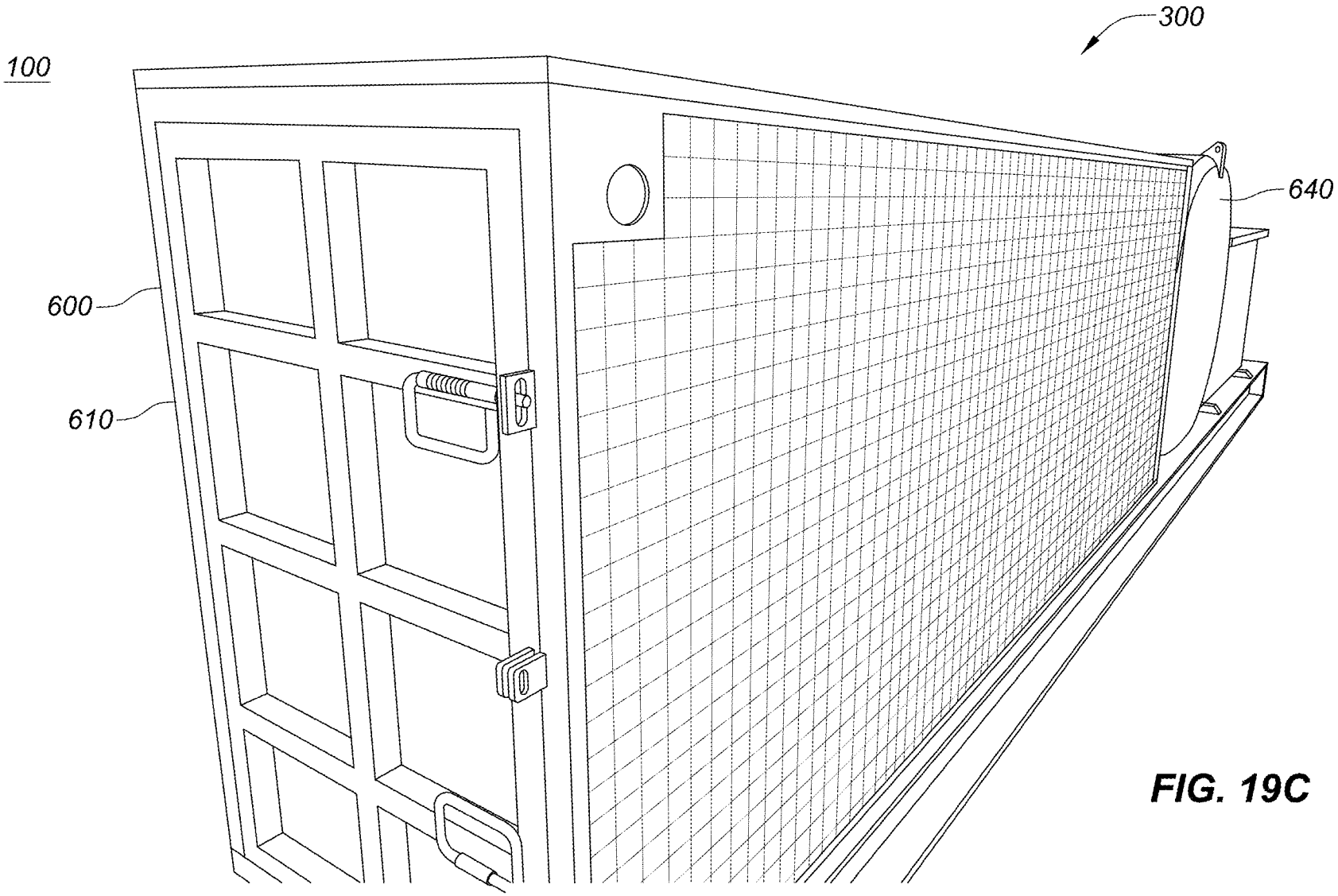
Figure 19D:
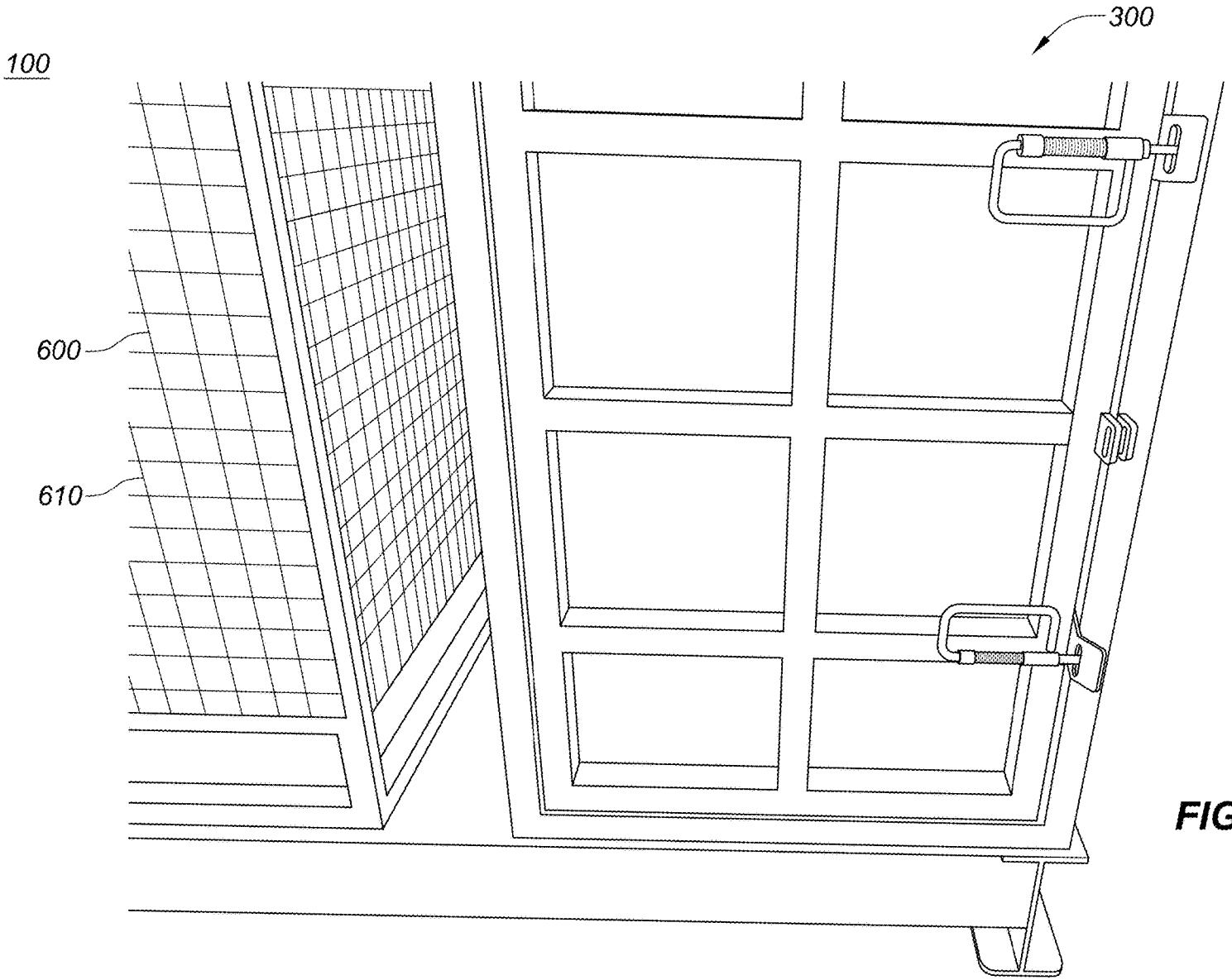

The kitchen room 510, for example, can include conventional kitchen appliances 512 and other furnishings. As illustrated in FIG. 18C, the kitchen room 510 is shown as including a stove 512A, an oven 512B, a ventilation hood 512C and a sink 512D. The kitchen room 510 optionally can include a storage system 511 with benches, cabinets and/or drawers, a hot water system 513, a washing machine 514, an internal air conditioning system 516 and/or a table 518 with chairs (not shown), without limitation. The kitchen system 500 advantageously can provide a large storage capacity and can store food and other provisions for one month or longer.

The shower room 520 is illustrated as including a shower 522 and a faucet 524 with a drain; whereas, the bathroom 530 is shown as including a toilet 532 and a faucet 534 with a drain. In selected embodiments, the kitchen system 500 can further include an external air conditioning system (not shown) for further ensuring the comfortable rest for the operators of the surface drilling system 100. The external air conditioning system can include a protective cover (not shown) for protecting the external air conditioning system during transit.

The kitchen system 500 advantageously can provide large rooms 510, 520, 530 for the operators of the surface drilling system 100. The heavy insulation, air-conditioning and large load capacity can help make the kitchen system 500 more comfortable in hot desert environments at which mineral exploration drilling can be performed and reduce operational down time for resupply relative to conventional operator accommodation units. If provided as a towable trailer system, the kitchen system 500 can be quickly mobilized and provide lower capital expenditures and operating cost due to removed need for external contractors to move the conventional operator accommodation units. The kitchen system 500 likewise can be disposed adjacent to the drill site 200 for the convenience of the operators.

Additionally and/or alternatively, the kitchen system 500 can provide a utility room 540. The utility room 540 can include a water distribution system (or means) 542 with an external connection (not shown) to an external water source, such as a clean water (or freshwater) system (or means) 640 (shown in FIG. 16), and an electrical distribution system (or means) 548 for coupling with an external power source, such as a generator system (or means) 660 (shown in FIG. 16). In selected embodiments, the utility room 540 can include a greywater pump system (or means) 544 for pumping greywater from drains of the shower 522, sink 512D and faucets 524, 534 of the kitchen system 500 to a waste water tank, such as a blackwater tank system (or means) 650 (shown in FIG. 16). The utility room 540 optionally can include a blackwater pump system (or means) 546 for pumping blackwater waste from the toilet 532 of the kitchen system 500 to the blackwater tank system 650 or other waste water tank. In selected embodiments, the greywater pump system 544 and/or the blackwater pump system 546 can receive power from the generator system 660 or other external power source.

The camping system 300 optionally can include a utility system (or means) 600 as shown in FIGS. 16 and 19A-D. The utility system 600 can provide electricity, fresh water, waste water disposal and other utilities for the camping system 300 and can be provided in any suitable manner. In selected embodiments, the utility system 600 can comprise a skid system and/or a towable trailer system that be configured to be towed or otherwise transported via the tow vehicle 161. The utility system 600 preferably comprises a standardized shipping container, such as a standard twenty-foot shipping container with corner fittings for a twist-locking mechanism.

Turning to FIGS. 16 and 19A-D, the utility system 600 is shown as including the clean water system 640, the blackwater tank system 650 and the generator system 660. The clean water system 640 can provide clean water to the water distribution system 542 of the kitchen system 500 in the manner discussed above; whereas, the blackwater tank system 650 preferably comprises a fully-bunded backwater tank system and can receive the greywater from the shower 522, sink 512D and faucets 524, 534 of the kitchen system 500 and the blackwater waste from the toilet 532 of the kitchen system 500. The generator system 660 can provide electrical power to the kitchen system 500 via the electrical distribution system 548.

A storage system 610 of the utility system 600 can be provided as one or more pallet-sized transport cages in selected embodiments and can store and transport hoses, cables and other equipment and supplies for the camping system 300. The storage system 610, for example, can provide hoses for coupling the clean water system 640 with the water distribution system 542 and the blackwater tank system 650 with the greywater pump system 544 and/or the blackwater pump system 546. One or more electrical cables for coupling the generator system 660 with the kitchen system 500 likewise can be included in the storage system 610. In selected embodiments, the storage system 610 can include a storage system door (not shown) and/or a storage system lid (not shown) for enabling the storage system 610 to be loaded manually and/or via the crane system 160A (shown in FIG. 14).

The utility system 600 optionally can include a fuel tank system (or means) 620. The fuel tank system 620 can comprise a fully-bunded fuel tank system for storing and transporting a predetermined capacity of fuel to the camping system 300. Although suitable for storing any suitable capacity of any type of fuel, the fuel tank system 620, for example, can store up to twelve hundred liters of diesel fuel.

Additionally and/or alternatively, the utility system 600 can include a drill rod storage system (or means) 630. The drill rod storage system 630 can store a predetermined number of bundled drill rods 121A (shown in FIG. 4). In selected embodiments, the drill rod storage system 630 can include a storage system door (not shown) and/or a storage system lid (not shown) for keeping the drill rods 121A secure during transit and enables the drill rod storage system 630 to be loaded via the crane system 160A.

The utility system 600 advantageously can provide mobile integrated blackwater, greywater, clearwater and generator solution. In other words, the utility system 600 can affordably address the problem of water supply and waste management in a highly mobile, remote and temporary environment. The utility system 600 therefore offers increased mobility and lower cost that conventional camping systems.

Figure 20A:
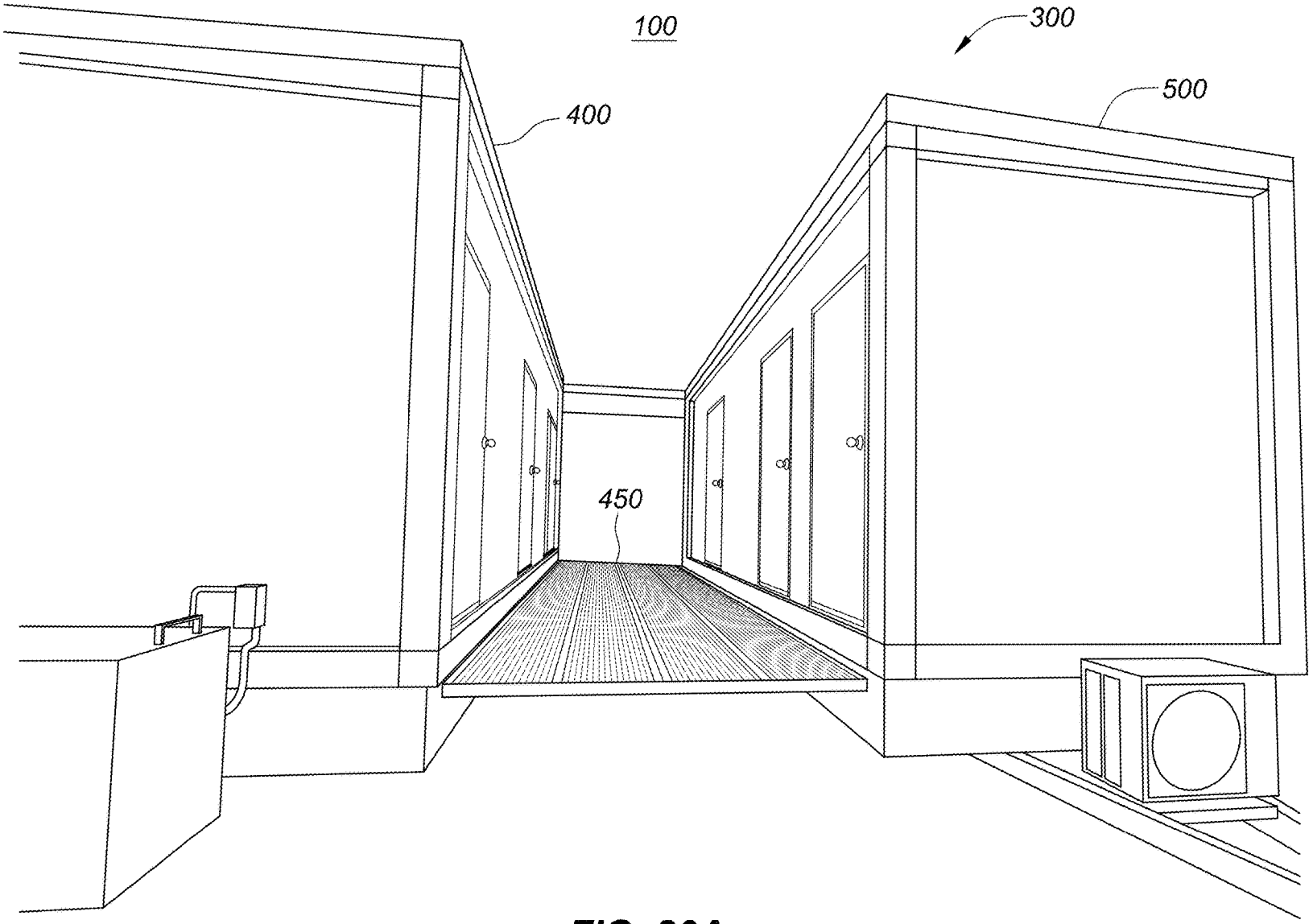
FIGS. 20A-B are detail drawings illustrating an exemplary embodiment of a camp deck system disposed between the living system and the kitchen system of the camping system of FIG. 15.
Figure 20B:
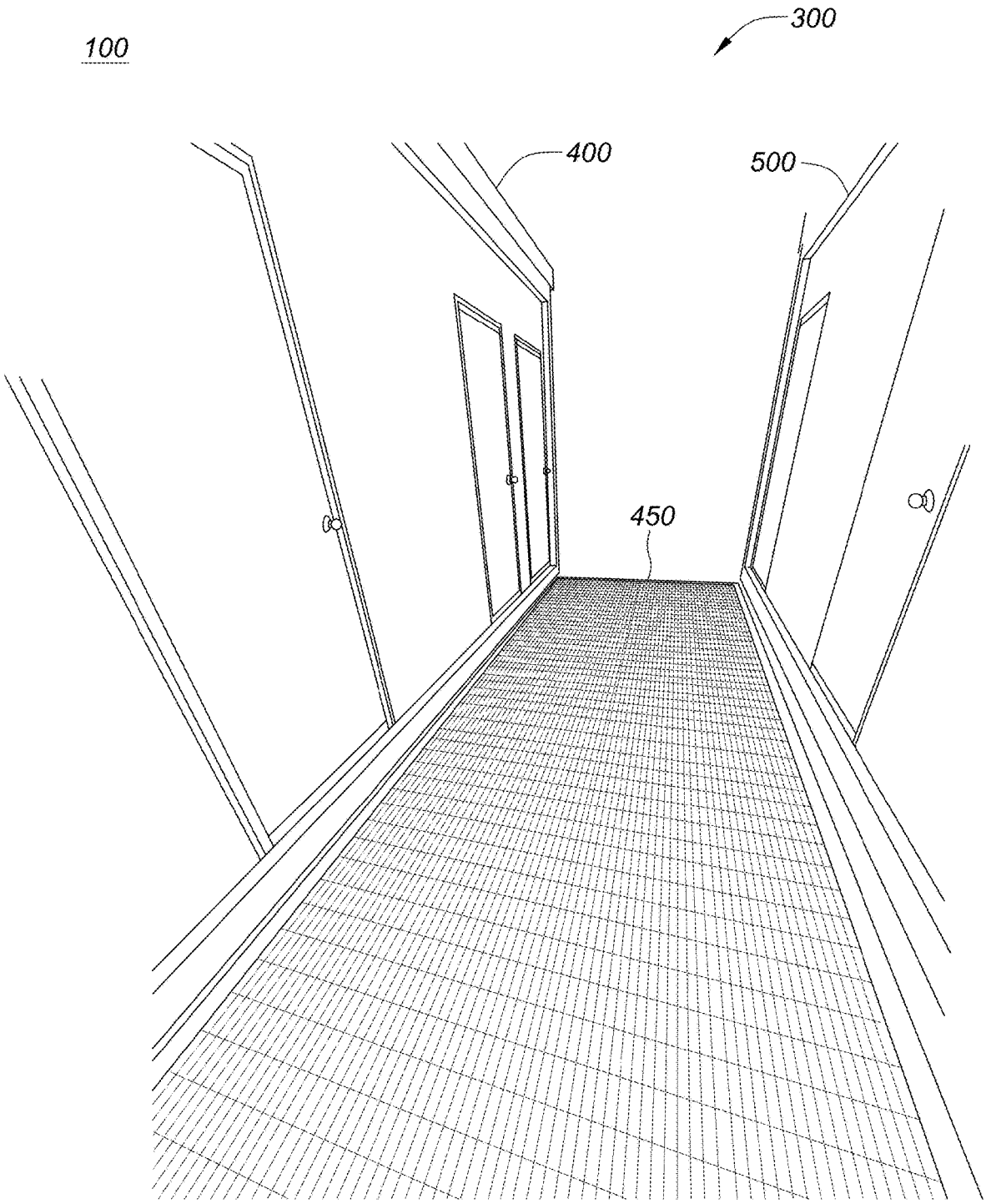

In selected embodiments, a camp deck system (or means) 450 can be disposed between the living system 400 and the kitchen system 500 as shown in FIGS. 16 and 20A-B. The camp deck system 450 can be configured for providing a level surface above the ground to access the living system 400 and the kitchen system 500 in a safe and easy manner. Turning to FIGS. 16 and 20A-B, the camp deck system 450 can include a plurality of deck support beams 452 that span a predetermined distanced between the living system 400 and the kitchen system 500 and at least one deck platform 454 that can rest on the deck support beams 452 to form the camp deck system 450. If the camp deck system 450 comprises an elevated camp deck system, a set of deck stairs 456 can be disposed adjacent to the camp deck system 450 and span between ground level and the elevation of the camp deck system 450. The camp deck system 450 can be stored in the drill rod storage system 630 of the utility system 600 for transport.

Figure 22:
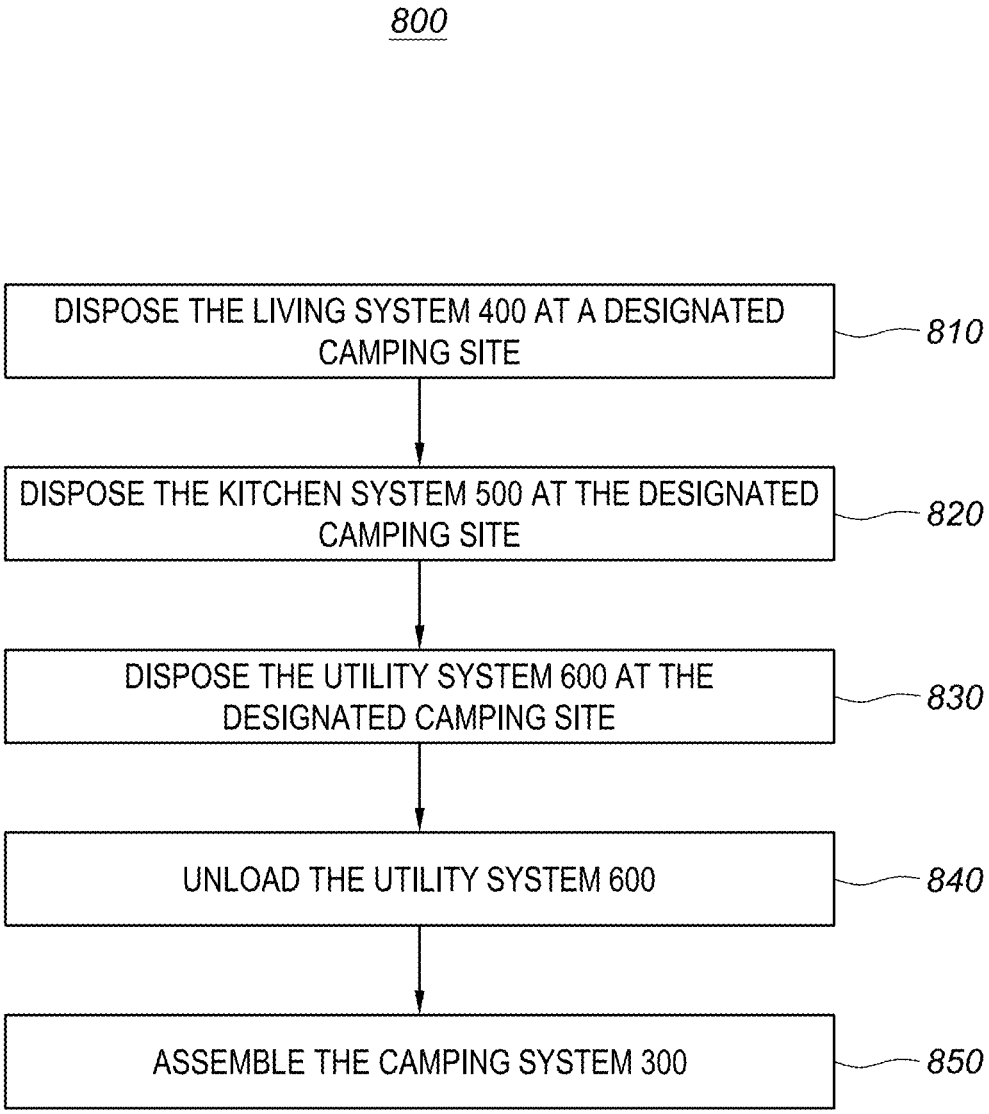
FIG. 22 is a top level flow chart illustrating an exemplary method 700 for setting up the camping system of FIG. 15.

The camping system 300 can be assembled in any suitable manner. An exemplary method 800 for setting up the camping system 300 at a predetermined camping site is illustrated in FIG. 22. With reference to FIGS. 16 and 22, a camping site can be designated. The camping site can be disposed at any suitable location relative to the drill site 200 and preferably is disposed proximal to the drill site 200.

The method 800 can include, at 810, disposing the living system 400 at the designated camping site. The kitchen system 500 can be disposed at the designated camping site, at 820; whereas, the utility system 600 can be disposed at the designated camping site, at 830. If provided as trailer systems, the living system 400, the kitchen system 500 and the utility system 600 can be parked at the designated camping site. Although shown and described with reference to FIG. 22 as disposing the living system 400, the kitchen system 500 and then the utility system 600 at the designated camping site for purposes of illustration only, the living system 400, the kitchen system 500 and the utility system 600 can be disposed at the designated camping site in any predetermined sequence.

The utility system 600 can be unloaded, at 840. In selected embodiments, the water hoses, electrical cables and other camp system materials can be unloaded from the utility system 600 and, as needed, assembled. The camp system materials, for example, can be stored in the storage system 610 of the utility system 600.

At 850, the utility system 600 can be assembled. At least one freshwater hose, for example, can couple the clean water system 640 of the utility system 600 with the shower 522, sink 512D and faucets 524, 534 of the kitchen system 500. Additionally and/or alternatively, the drains of the shower 522, sink 512D and faucets 524, 534 of the kitchen system 500 can be coupled with the blackwater tank system 650 of the utility system 600 via one or more greywater hoses; whereas, the toilet 532 of the kitchen system 500 can be coupled with the blackwater tank system 650 of the utility system 600 via one or more blackwater hoses. At least one electrical cable can couple the electrical distribution system 548 of the kitchen system 500 with the generator system 660 of the utility system 600.

If the camping system 300 includes the camp deck system 450, the deck support beams 452, the deck platforms 454 and/or the deck stairs 456 can be unloaded from the drill rod storage system 630 of the utility system 600, at 840. The camp deck system 450 can be assembled, at 850, by coupling proximal end regions of the deck support beams 452 with the living system 400 and coupling distal end regions of the deck support beams 452 with the kitchen system 500. The deck platform 454 can be disposed on the deck support beams 452 to form the camp deck system 450. If the camp deck system 450 comprises an elevated camp deck system, the deck stairs 456 can be disposed adjacent to the camp deck system 450 and span between ground level and the elevation of the camp deck system 450.

In selected embodiments, one or more of the features disclosed herein can be provided as a computer program product. The computer program product, for example, can be encoded on one or more non-transitory machine-readable storage media, such as magnetic, optical and/or electronic storage media of any kind and without limitation. As used herein, a phrase in the form of at least one of A, B, C and D herein is to be construed as meaning one or more of A, one or more of B, one or more of C and/or one or more of D. Likewise, a phrase in the form of A, B, C or D as used herein is to be construed as meaning A or B or C or D. For example, a phrase in the form of A, B, C or a combination thereof is to be construed as meaning A or B or C or any combination of A, B and/or C.

The disclosed embodiments are susceptible to various modifications and alternative forms, and specific examples thereof have been shown by way of example in the drawings and are herein described in detail. It should be understood, however, that the disclosed embodiments are not to be limited to the particular forms or methods disclosed, but to the contrary, the disclosed embodiments are to cover all modifications, equivalents, and alternatives.

What is claimed is:

1. A surface drilling system for surface mineral exploration diamond core drilling at a predetermined drill site via a drill rig system having a drill rig mast system coupled with a drill bit for cutting a drillhole within a ground at a drilling location of the drill site, comprising:

a containerized rod skid system for transporting one or more drill rods for coupling the drill rig mast system with the drill bit;

a containerized mud tank system for providing drilling fluid to the drill rig system and cleaning return drilling fluid received from the drill rig system;

a containerized water skid system for providing water to said mud tank system for mixing the drilling fluid and cleaning the return drilling fluid; and a collar tray system for capturing and reconditioning the return drilling fluid for use by the drill rig system, said collar tray system defining an elongate opening for supporting a predetermined range of drilling angles for the drill rig system and including one or more suction inlets for receiving the return drilling fluid from the drill rig system, at least one external outlet for providing reconditioned drilling fluid to the drill rig system, a foam ground seal support system for preventing leaks of the return drilling fluid and the reconditioned drilling fluid and a wooden damper for reducing drilling vibration, wherein said rod skid system, said mud tank system and said water skid system are configured for transport via a tilt-tray system of a logistics vehicle.

2. The surface drilling system of claim 1, wherein said rod skid system, said mud tank system and said water skid system each comprise a twenty-foot shipping container with corner fittings for a twist-locking mechanism.

3. The surface drilling system of claim 2, wherein said mud tank system and said water skid system can provide storage for selected equipment associated with the surface drilling system during transport.

4. The surface drilling system of claim 1, wherein said rod skid system includes:

an adjustable ramp system having a surface for supporting the drill rods and having distal and proximal end regions;

dunnage for being disposed between said ramp system and the drill rods and protecting the drill rods from damage;

at least one mechanical jack system being coupled with the proximal end region of said ramp system and being configured to elevate the proximal end region of said ramp system relative to the distal end region of said ramp system; and a headboard system, a backboard system and a plurality of support beams being disposed around a periphery of said ramp system and being configured to retain the drill rods within said rod skid system, and wherein said rod skid system maintains a predetermined lifting height for the drill rods.

5. The surface drilling system of claim 4, wherein said headboard system comprises a plurality of headboard inserts including a first headboard insert that can be added to the headboard system for increasing a height of the headboard system and a second headboard insert that can be removed from the headboard system for decreasing the height of the headboard system; and wherein said backboard system comprises a plurality of backboard inserts including a first backboard insert that can be added to the backboard system for increasing a height of the backboard system and a second backboard insert that can be removed from the backboard system for decreasing the height of the backboard system.

6. The surface drilling system of claim 4, wherein said rod skid system maintains a predetermined lifting height at all times throughout the use and depletion of the drill rods.

7. The surface drilling system of claim 1, further comprising an inner tube and core processing system for removing core material collected within an inner tube of a selected drill rod previously coupled with the drill rig mast system with the drill bit during drilling operations.

8. The surface drilling system of claim 7, wherein said inner tube and core processing system comprises:

a flat table top defining at least one water catchment drain and including an inner tube processing system having a grill system for stabilizing the selected drill rod when disposed on said table top;

one or more table legs for supporting said table top; and at least one water catchment tray for receiving water draining from said table top via the at least one water catchment drain during removal of the core material from the selected drill rod.

9. The surface drilling system of claim 8, wherein at least one of said table legs comprises a jack table leg for levelling said table top when said inner tube and core processing system is disposed on an uneven surface.

10. The surface drilling system of claim 1, wherein said mud tank system comprises a plurality of holding cells with adjacent first and second holding cells being separated by an intermediate barrier with a valve device disposed at an upper portion of the intermediate barrier, the valve device being configured to be alternately closed to inhibit communication between the first and second holding cells and opened to enable communication between the first and second holding cells, selected valve devices being opened to enable circulation of the return drilling fluid received from the drill rig system at an initial holding cell through a preselected number of intermediate holding cells to a final holding cell for providing the drilling fluid to the drill rig system.

11. The surface drilling system of claim 10, wherein said mud tank system comprises a leveling system with a mud tank support framework system for organizing the holding cells in a cascading configuration and a jack system for elevating first holding cells associated with a proximal end region of said mud tank support framework system relative to second holding cells associated with a distal end region of said mud tank support framework system, wherein said leveling system levels the first and second holding cells when said mud tank system is disposed on an uneven surface.

12. The surface drilling system of claim 10, wherein circulation of the return drilling fluid through the holding cells of said mud tank system cleans the return drilling fluid received from the drill rig system and generates clean drilling fluid for the drill rig system.

13. The surface drilling system of claim 10, wherein a number of the selected valve devices can be controlled for adjusting the preselected number of intermediate holding cells through which the return drilling fluid is circulated.

14. The surface drilling system of claim 10, wherein a bulk bag system is disposed in a selected holding cell of said mud tank system and collects water and settled drill cuttings from the circulated return drilling fluid, and further comprising a fluid containment system for receiving the bulk bag system from the selected holding cell, said fluid containment system including a watertight bunding system for containing water seeping from the bulk bag system and maintaining the drill cuttings in the bulk bag for disposal.

15. The surface drilling system of claim 14, further comprising a vacuum pump system for pumping the water and the drill cuttings from the selected holding cell of said mud tank system to said fluid containment system, wherein said vacuum pump system is stored in a predetermined holding cell of said mud tank system during transport.

16. The surface drilling system of claim 1, wherein the predetermined range of drilling angles supported by the elongate opening defined by the collar tray system is between thirty degrees and ninety degrees.

17. The surface drilling system of claim 1, further comprising a camping system being disposed at a camping site that is proximal to the predetermined drill site and being configured for housing surface drilling system personnel, said camping system including a containerized living system, a containerized kitchen system and a containerized utility system.

18. The surface drilling system of claim 17, wherein said living system, said kitchen system and said utility system each comprise a twenty-foot shipping container with corner fittings for a twist-locking mechanism.

19. The surface drilling system of claim 17, wherein said living system includes an external air conditioning system and provides at least one sleeping room with a bed, a bedside table and an internal sleeping room air conditioning system and living room with a refrigerator, a table with chairs and an internal living room air conditioning system, wherein said kitchen system provides food storage and includes at least one electrical appliance, an internal kitchen air conditioning system, a faucet with a faucet drain, a shower with a shower drain and a toilet, and wherein said utility system includes a clean water tank system for providing clean water to the faucet and the shower, a blackwater tank system for receiving greywater from the faucet drain and the shower drain and blackwater from the toilet and a generator system for providing electrical power to the external air conditioning system, the internal sleeping room air conditioning system, the internal living room air conditioning system, the internal kitchen air conditioning system and the at least one electrical appliance.

20. The surface drilling system of claim 17, further comprising an elevated deck system disposed between said living system and said kitchen system, the elevated deck system including a plurality of deck support beams each having a proximal end region coupled with said living system and a distal end region coupled with said kitchen system, at least one deck platform disposed on the deck support beams, and a set of deck stairs spanning between a ground level of the camping site and the at least one deck platform.

* * * * *